US006832605B2

(12) United States Patent
Farrell

(10) Patent No.: US 6,832,605 B2
(45) Date of Patent: Dec. 21, 2004

(54) PNEUMATIC GUN

(76) Inventor: Kenneth Farrell, 19202 - SE. 184th St., Renton, WA (US) 98058

( * ) Notice: Subject to any disclaimer, the term of this patent is extended or adjusted under 35 U.S.C. 154(b) by 0 days.

(21) Appl. No.: 10/206,013

(22) Filed: Jul. 26, 2002

(65) Prior Publication Data

US 2003/0047175 A1 Mar. 13, 2003

Related U.S. Application Data

(60) Provisional application No. 60/363,450, filed on Mar. 11, 2002, and provisional application No. 60/307,923, filed on Jul. 26, 2001.

(51) Int. Cl.[7] ..... F41B 11/00

(52) U.S. Cl. ..... 124/76; 124/73

(58) Field of Search ..... 124/72, 73, 74, 124/75, 76, 77

(56) References Cited

U.S. PATENT DOCUMENTS

| | | | | | |
|---|---|---|---|---|---|
| 2,223,093 | A | | 11/1940 | Brewer | |
| 2,505,972 | A | | 5/1950 | Johnson | |
| 2,817,328 | A | | 12/1957 | Gale | |
| 2,940,438 | A | | 6/1960 | Merz | |
| 3,547,095 | A | | 12/1970 | Vadas | |
| 3,612,026 | A | | 10/1971 | Vadas | |
| 4,936,282 | A | * | 6/1990 | Dobbins et al. | 124/74 |
| 5,063,905 | A | | 11/1991 | Farrell | |
| 5,257,614 | A | * | 11/1993 | Sullivan | 124/73 |
| 5,349,938 | A | | 9/1994 | Farrell | |
| 5,476,087 | A | | 12/1995 | Kunimoto | |
| 5,477,843 | A | | 12/1995 | Kunimoto | |
| 5,509,399 | A | | 4/1996 | Poor | |
| 5,634,456 | A | | 6/1997 | Perrone | |
| 5,878,736 | A | * | 3/1999 | Lotuaco, III | 124/71 |
| 6,026,797 | A | | 2/2000 | Maeda | |
| 6,112,734 | A | | 9/2000 | Kunimoto | |
| 6,142,136 | A | | 11/2000 | Velasco | |
| 6,561,176 | B1 | * | 5/2003 | Fujimoto et al. | 124/76 |
| 6,637,420 | B2 | * | 10/2003 | Moritz | 124/73 |

OTHER PUBLICATIONS

Tippmann Pneumatics, Inc., Model 98 Owner's Manual. Pages 10–11. Undated. (Downloaded from www.tippmann.com on Apr. 23, 2003.).

Tippmann Pneumatics, Inc., 98 Custom Owner's Manual. Pages 10–11. Undated. (Downloaded from www.tippmann.com on Apr. 23, 2003.).

* cited by examiner

*Primary Examiner*—Jack Keith
*Assistant Examiner*—Troy Chambers

(57) ABSTRACT

A pneumatic gun with separate hammer and recock piston function. Separate structures are provided for an impacter and for a recock piston. The recock piston engages the impacter during recocking. The impacter is latched in a cocked position, while the recock piston and bolt are returned to a closed bolt position after recocking the impacter, in readiness for firing. The gun fires from a closed bolt. Upon release by the impacter sear, the impacter moves to open a normally closed valve, directly or indirectly, to discharge compressed gas for firing a projectile and for recocking the gun. Various impacter shapes, recock piston shapes, and valve structures and operation are feasible while achieving the advantages of firing from a closed bolt in a semi-automatic gun.

43 Claims, 23 Drawing Sheets

210
272
PB1
PB2
362
300
309
309P
309R
332
336
345
330
307W
313S
313B
333
331
326
328
355
312
315
311
350
351
395
397
306
349
381
354
383
389
385
386
302E
308S
399
387
393
391
302
303
301
362F
362FC
362B
362RC
302C
302T
338
205
348
366
308W
308
268
306S
302B
236
308T
307
260
348
307W
347

210
PB1
PB2
272
272
562F
509
532
567
530
537
545
506
529
528
517
533
551
502I
520
533
531
511
512

534
526
509P
524
585
583
550
502E
583
503RC
549
500
562
566
502C
508S
538
502
503
501
509R
503P
502B
503U
205
236
508W
508
26B
509S
347
507
260
508T
507W
548

PNEUMATIC GUN

RELATED PATENT APPLICATIONS

This invention is related to my U.S. Provisional Patent Applications Ser. No. 60/307,923 filed on Jul. 26, 2001, entitled Pneumatic Gun, and Ser. No. 60/363,450 filed on Mar. 11, 2002, entitled Paintball Loader, the disclosures of each of which are incorporated herein in their entirety by this reference.

TECHNICAL FIELD

This invention relates to semiautomatic pneumatic guns. More specifically, the invention is related to pneumatic guns having hammer assemblies for firing projectiles such as pellets, BBs, or paintballs.

BACKGROUND

Pneumatic guns are popular for firing various projectiles, such as pellets, BB's, and frangible paint-filled balls known as "paintballs". In firing pneumatic guns, the user pulls a trigger to initiate a sequence of operation of components that results in the release of compressed gas that propels the projectile from the gun. The firing process in guns also continues with recocking the gun, so that it is again ready to fire. Loading of the next projectile in succession to be fired is considered to be a part of the recocking process.

Of particular interest to me are semiautomatic guns of the type that utilize a normally-closed, impact-openable gas regulating valve and a hammer. More particularly, I am interested in pneumatic guns of the type having a hammer that serves the dual functions of (1) impacting a valve actuator to open the valve and thus release compressed gas to fire the gun, and (2) responding to the urging of some of the released compressed gas to recock the gun. Typically in a gun of this type, when the gun is ready to fire, the hammer is restrained in the cocked position, rearward in the gun, by a trigger-actuated sear. When the user pulls the trigger to initiate firing, the sear moves and releases the hammer. Then, the hammer moves forward to the firing, valve-impact position. The normally-closed valve restrains compressed gas within a gas reservoir until the valve is opened briefly by the impact of the hammer moving forward under spring urging toward the valve. A portion of the released gas travels through a propulsion gas passageway to meet the rear of a projectile then in the gun firing chamber. The projectile is propelled forward and out through the barrel of the gun. Another portion of the released gas provides the motive force to return the hammer and associated gun parts back to the cocked position, thereby automatically preparing the gun for the next shot. Such guns have proven to be very popular, especially for firing paintballs, probably because their simplicity makes them relatively economical to build and operate.

When such a gun is fired, various functions relating to loading must be performed before another projectile can be propelled from the gun. One common prior art design in such guns is to provide a bolt in a longitudinally translating configuration constrained to move with the hammer. Two functions performed by such a gun bolt include (a) opening a gun loading port to permit the next projectile in succession to be fired to enter into the breech of the gun, and (b) closing the loading port and chambering the projectile, that is, moving the projectile forward from the breech into the firing chamber of the gun so it is properly positioned and ready for receipt of propulsion gas. Because the hammer in such a gun design is held rearward in the cocked position when the gun is ready to fire, the bolt has not yet performed function of closing the loading port and chambering the projectile. Hence the gun is said to fire from an "open bolt".

As an open bolt gun is fired, the bolt moves forward with the hammer to close the loading port and chamber the projectile. Generally the projectile enters the loading port just as the gas released for propulsion reaches its rear surface. In such open bolt designs, the hammer performs two very different functions. First, it provides the impact function to open a valve to release compressed gas as the gun is fired. Second, it serves to receive the motive force of the gas released for recocking, and in response thereto, move the associated gun components to perform the recocking function.

A pneumatic gun can also be provided that fires from a closed rather than an open bolt. That is, the bolt closes the loading port and chambers the new projectile as part of the recocking process of preparing the gun to be fired again, rather than as the first part of the firing operation that occurs after the trigger is pulled. Generally in prior art closed-bolt guns, the hammer is required to perform only the valve impacting function. In such prior art guns, other mechanisms are provided to move the bolt, and, in some cases, to recock the hammer.

Firing with a closed bolt is potentially beneficial for several reasons. Since the bolt does not travel with the hammer when the hammer moves (toward the valve) upon firing, fewer components are subject to sliding friction. Consequently, variations in hammer velocity resulting from friction acting on bolt components is eliminated. Thus, the impact force of the hammer on the valve is more repeatable, and the amount of gas released is more consistent, resulting in more uniform projectile velocity, and hence better projectile accuracy.

Some guns, such as pellet guns (which typically are intended to provide extremely high accuracy), would benefit from a shorter firing interval that is made possible in a closed-bolt gun. In a closed-bolt gun, the hammer spring no longer must provide energy for closing the loading port and chambering the projectile, since such tasks are completed during the recocking process. Consequently "lock-time", i.e., the time elapsed between the time of pulling the trigger and the time when the valve releases compressed gas, can be made shorter. Since there is less time for the gun to move off target between the pulling of the trigger and the exiting of the pellet from the barrel, the gun accuracy is improved. Also, as such a gun is fired, there is less moving mass within the gun that might disturb the shooter's aim.

Paintball guns would also benefit from the way the paintball is chambered in a closed-bolt gun. It has been observed that a paintball may start rolling as it is being pushed forward by the bolt from the breech to the firing chamber. If the propulsion gas is released to push against the paintball before the paintball has completely come to a stop, as will be more likely in an open-bolt than in a closed-bolt gun, the rolling motion can increase the chance of imparting a spin to the paintball that can upset its trajectory during flight.

Unfortunately, the mechanisms heretofore available to provide closed bolt pneumatic gun operation are generally more complex (and hence more expensive and troublesome to maintain), than typical open-bolt gun mechanisms. Hence, a significant and as yet unmet need exists for a semiautomatic pneumatic gun that is comparable in simplicity to open bolt gun designs, but that provides better gun performance by firing with a closed bolt.

BRIEF DESCRIPTION OF THE DRAWING

In order to enable the reader to attain a more complete appreciation of the invention, and of the novel features and the advantages thereof, attention is directed to the following detailed description when considered in connection with the accompanying drawing, wherein.

Figure 12:
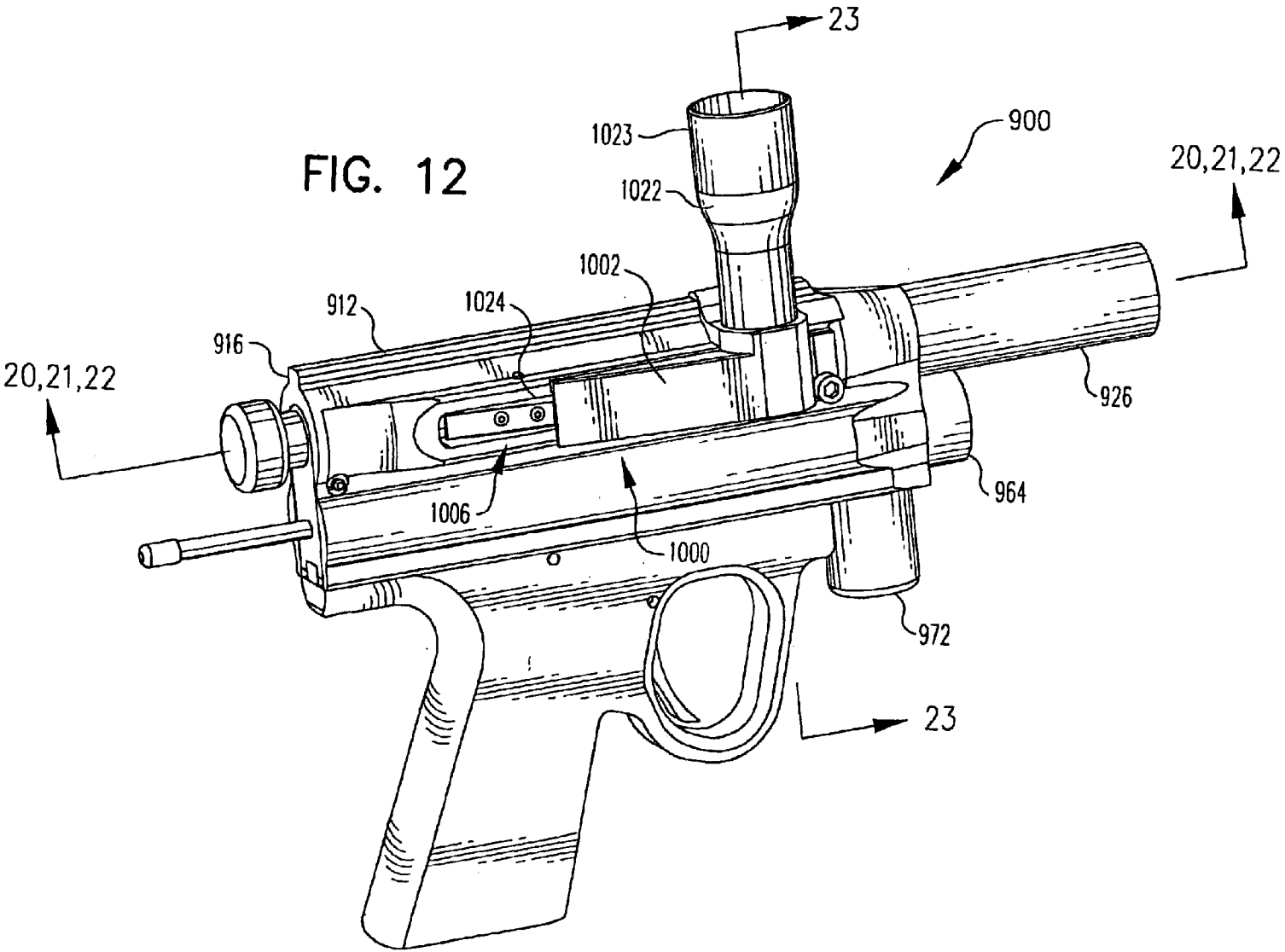
FIGS. 12 through 22 provide various views of a pneumatic gun which incorporates the novel use of separate impacter and recock piston in paintball gun.

First, in FIG. 12, an external perspective view of a gun is illustrated, showing the frame, paintball loader affixed thereto, manual rods with knobs for opening the bolt and for recocking the impacter, and the handle with trigger.

Figure 13:
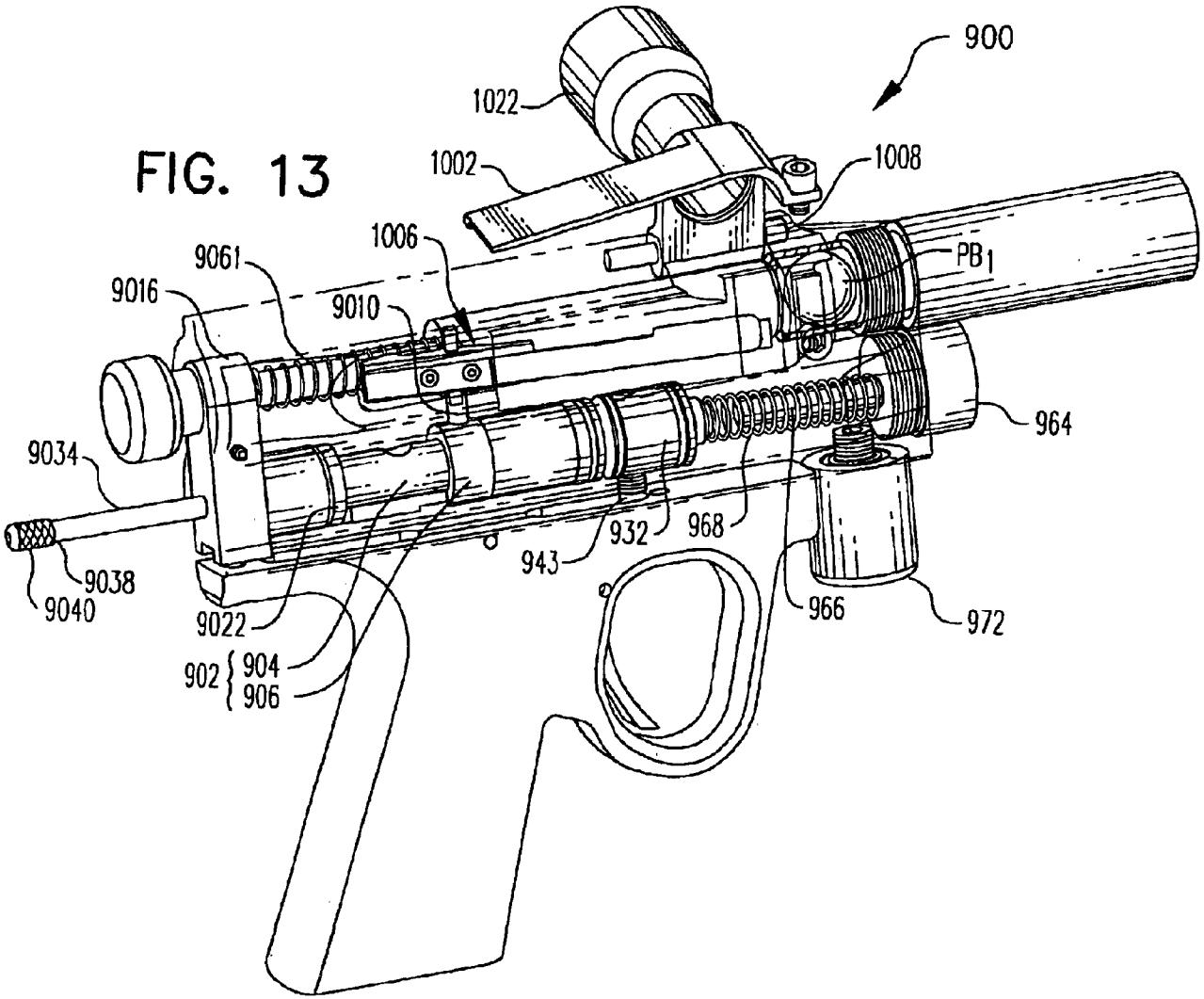

FIG. 13 shows, in partially broken away perspective view, the gun just illustrated in FIG. 12, now showing the gas valve, recock piston, impacter, paintball loader, and bolt.

Figure 14:
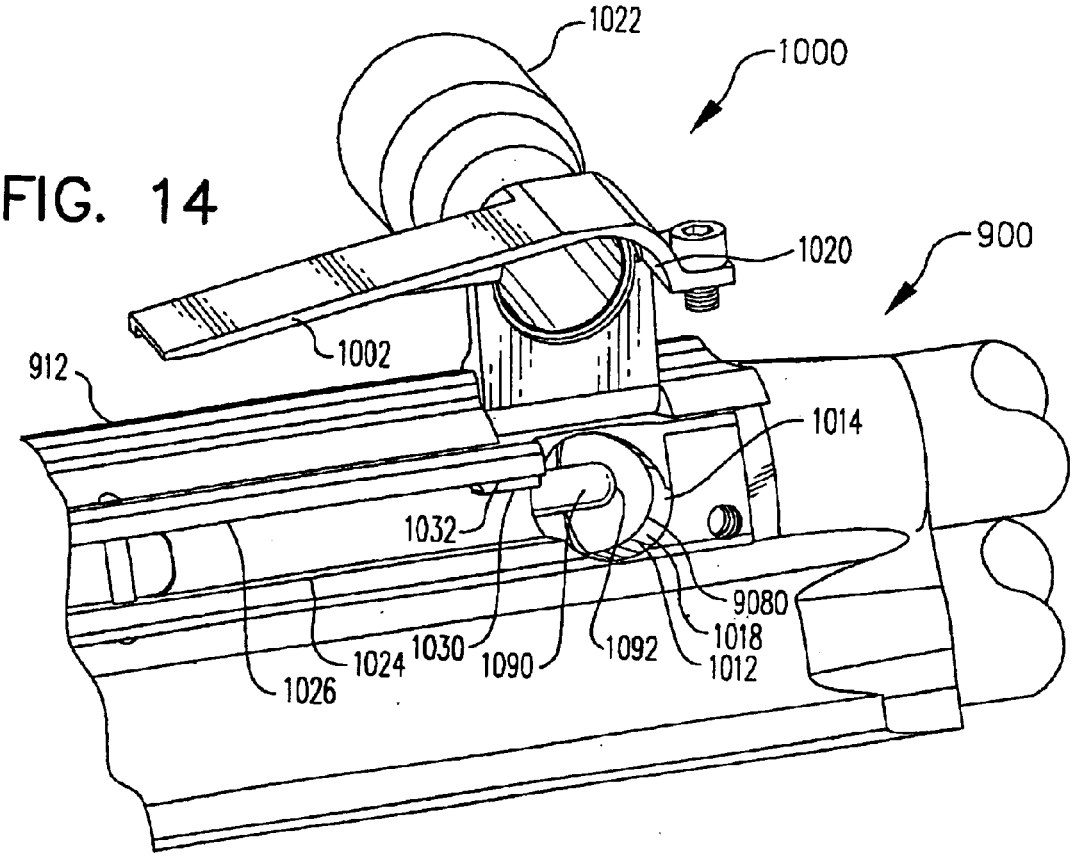

FIG. 14 illustrates a portion of the gun just illustrated in FIGS. 12 and 13, now showing the paintball loader tube in a pivoted outward, open position, to reveal the loading port.

Figure 15:
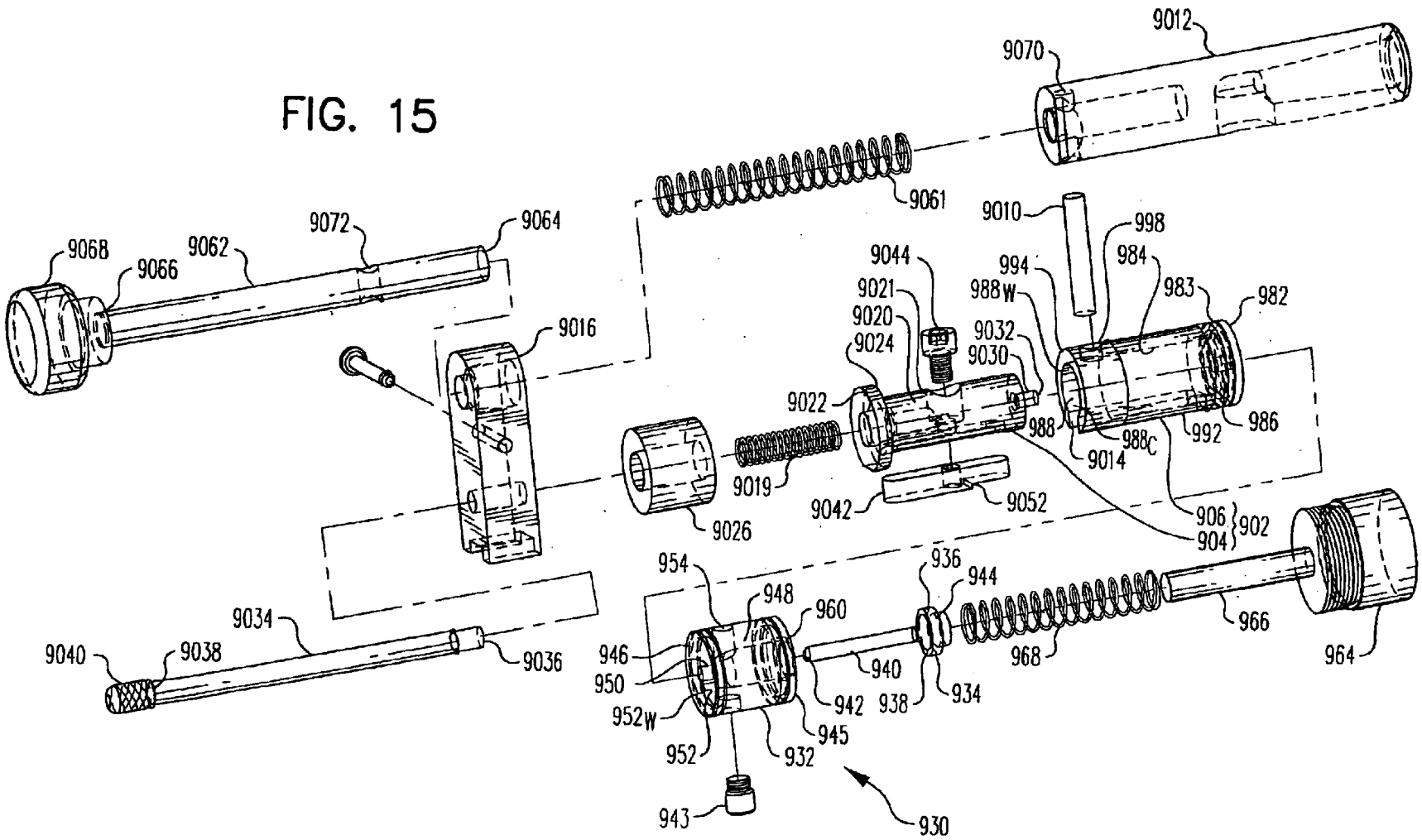

FIG. 15 is an exploded perspective view of various components of the internal firing mechanism, including gas valve with valve stem and spring, the recock piston (here with boss receiving slot), the impacter (here with anti-rotation boss), a rubber compression buffer, the impacter rod with knurled manual knob, the bolt (with connecting rod to recock piston), a bolt spring, and a bolt rod with knurled manual knob.

Figure 16:
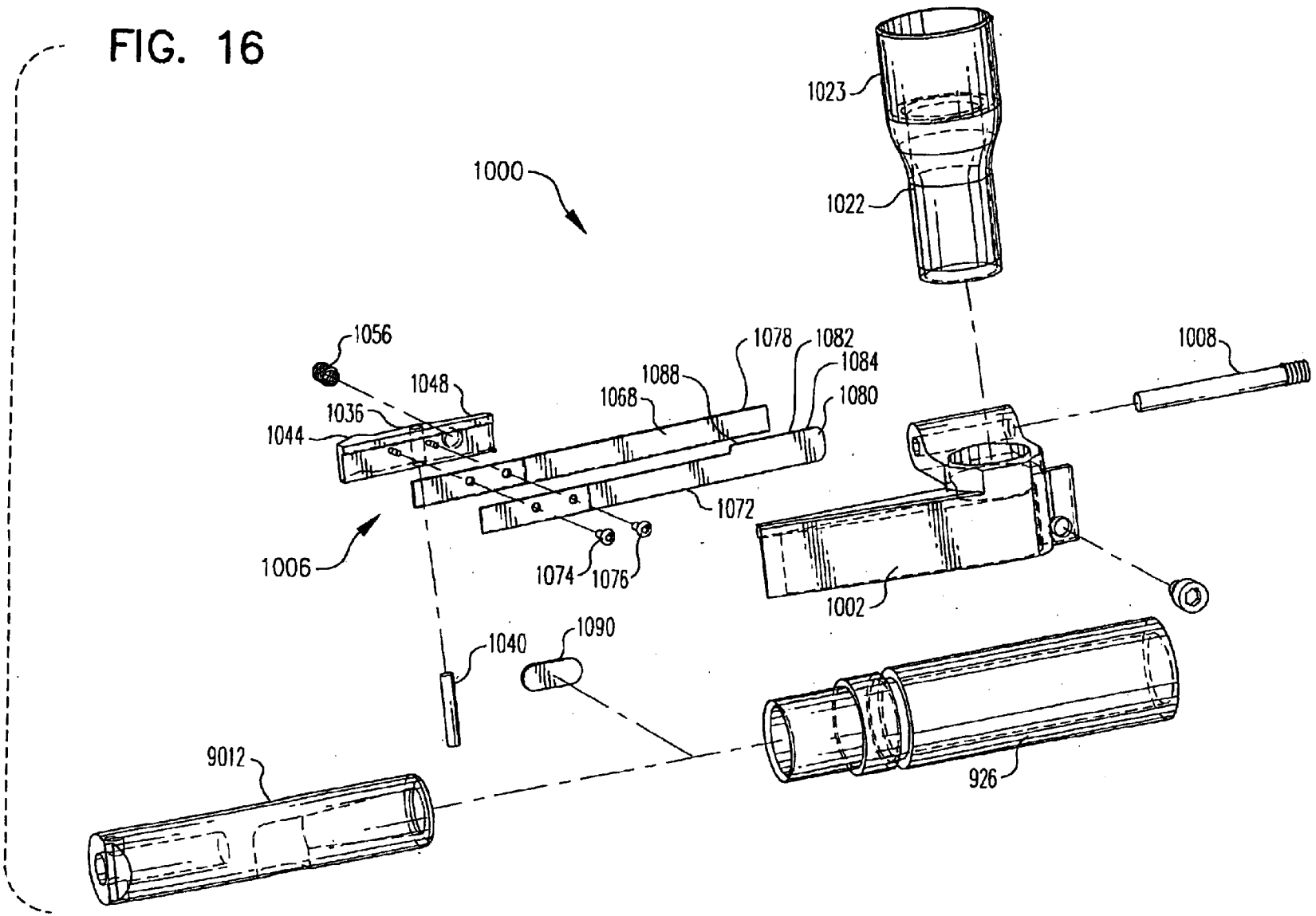

FIG. 16 is an exploded perspective of the loader provided on the gun illustrated in FIGS. 12 and 13 above, showing the feed tube, the hinged loader cover with hinge pin, the gun barrel, the bolt, the pivot pin, cam pivot member including cam follower, a push arm lever, and a stop arm.

Figure 17:
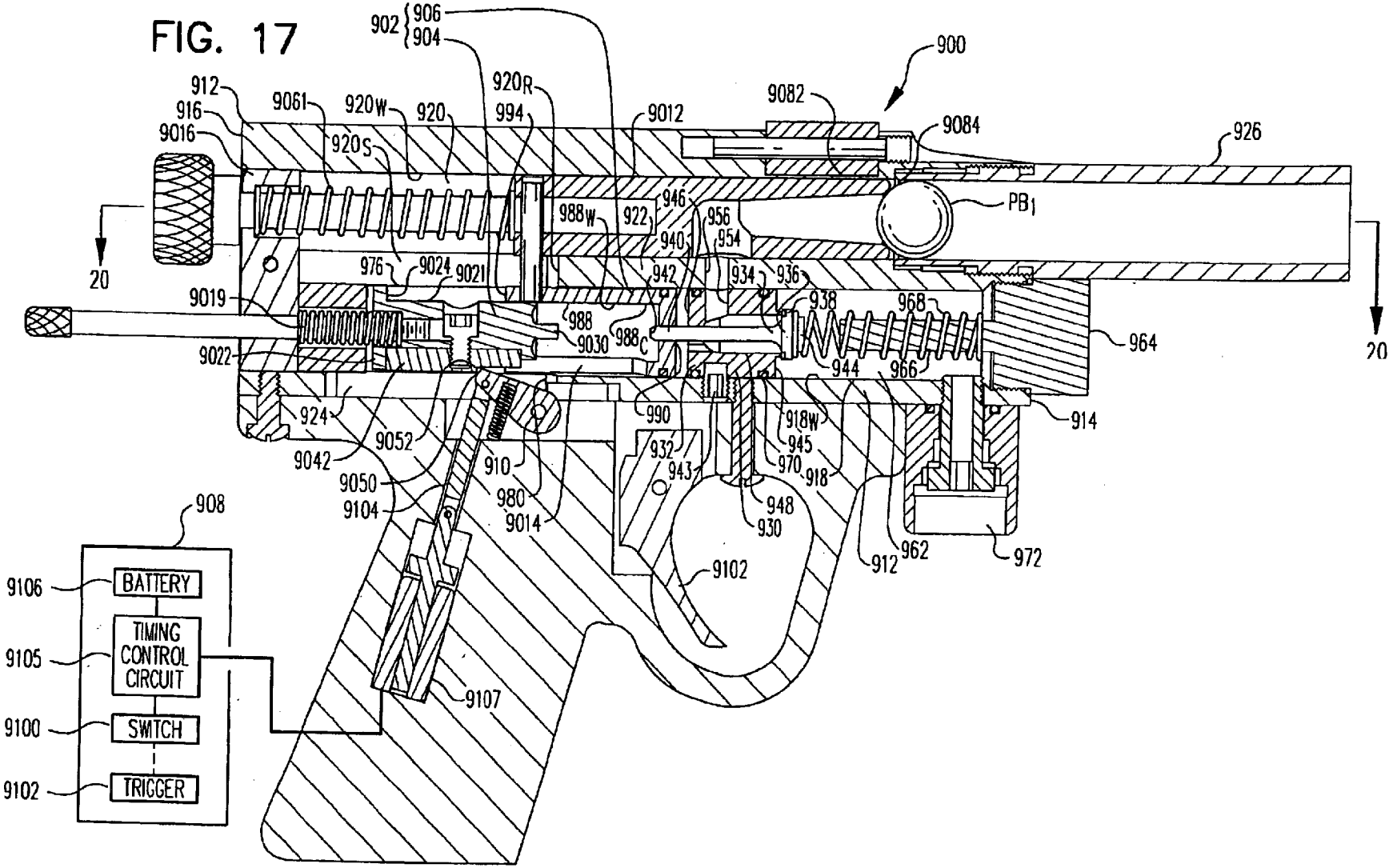

FIG. 17 is a cross-sectional view of the gun illustrated in FIGS. 12 and 13 above, shown in the cocked position, with the impacter latched by a trigger sear in a rearward cocked position, and with bolt closed, and a paintball in the firing chamber, ready for firing.

Figure 18:
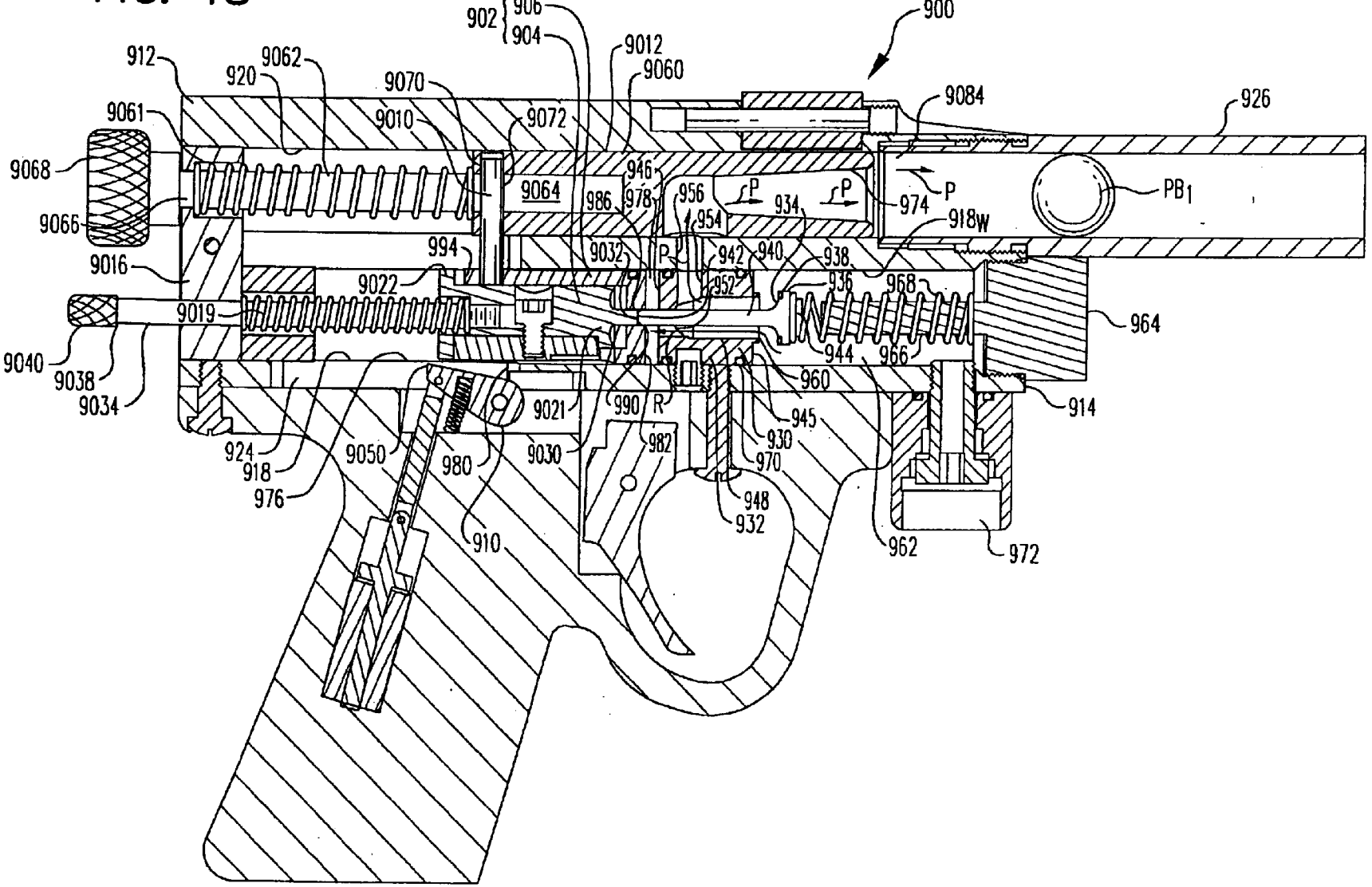

FIG. 18 is a cross-sectional view of the gun illustrated in FIGS. 12, 13, and 17 above, now showing the gun being fired, with the nose portion of the impacter impacting the impact receiving face of the valve stem to open the gas valve so that propulsion gas is traveling through the bolt to the rear of the paintball, and is traveling through the valve body to begin moving the recock piston rearward.

Figure 19:
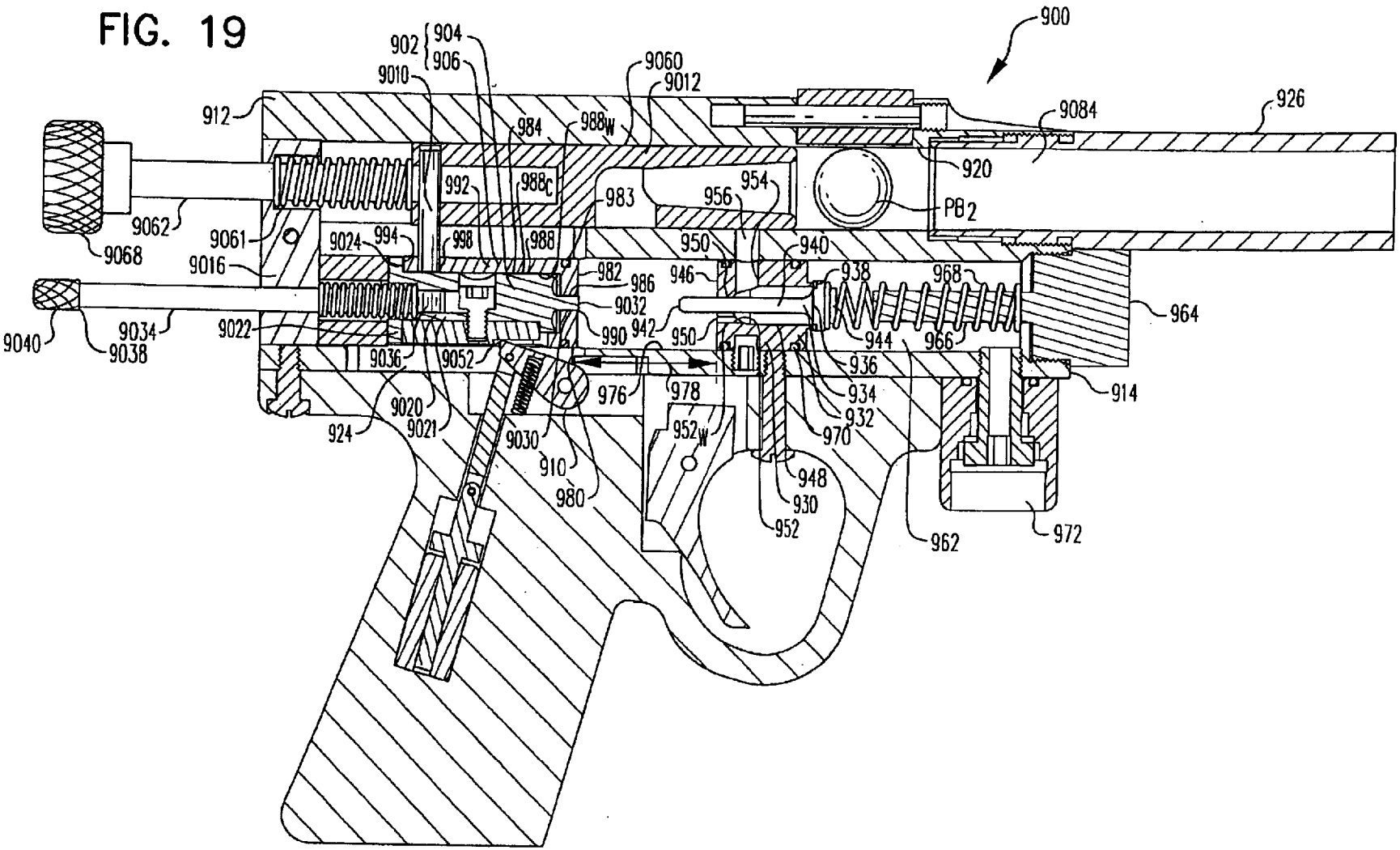

FIG. 19 is a cross-sectional view of the gun illustrated in FIGS. 12, 13, 17, and 18, now showing the gun in an open bolt position, where the recock piston (via connecting rod) has moved the bolt to an open position for loading of a new paintball, and wherein the impacter has been latched in a rearward, cocked position.

Figure 20:
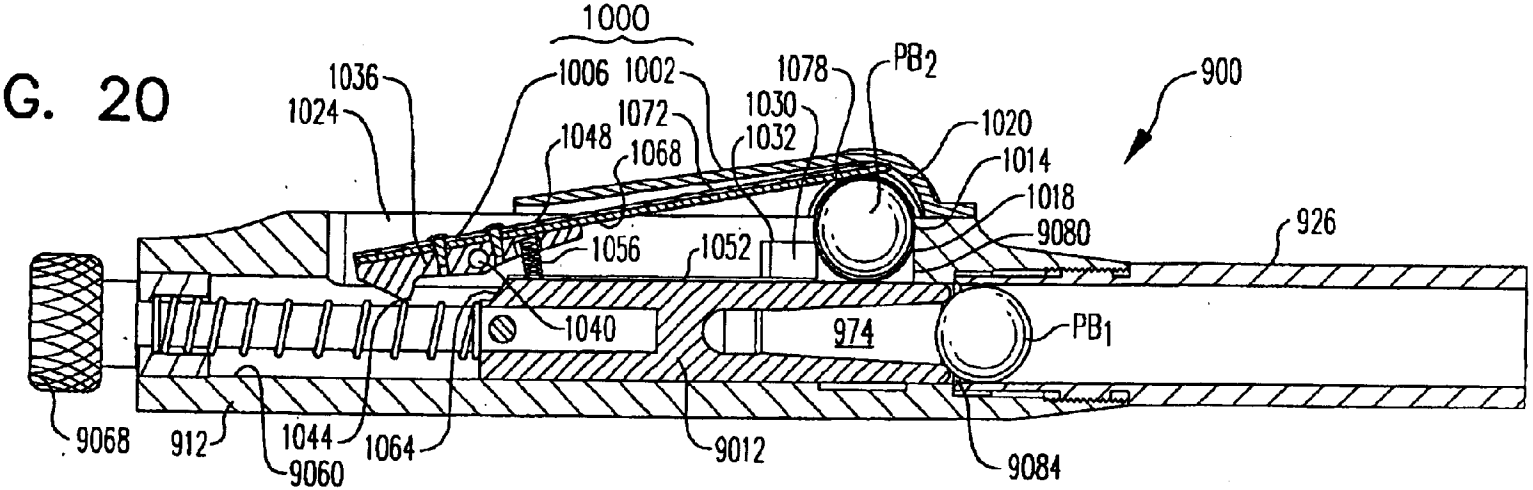

FIG. 20 is horizontal cross-sectional view taken looking up across line 20—20 of FIG. 17, showing the bolt closed and a paintball in the firing chamber and ready to be fired, with another paintball in the loader, ready for loading when the bolt is again opened.

Figure 21:
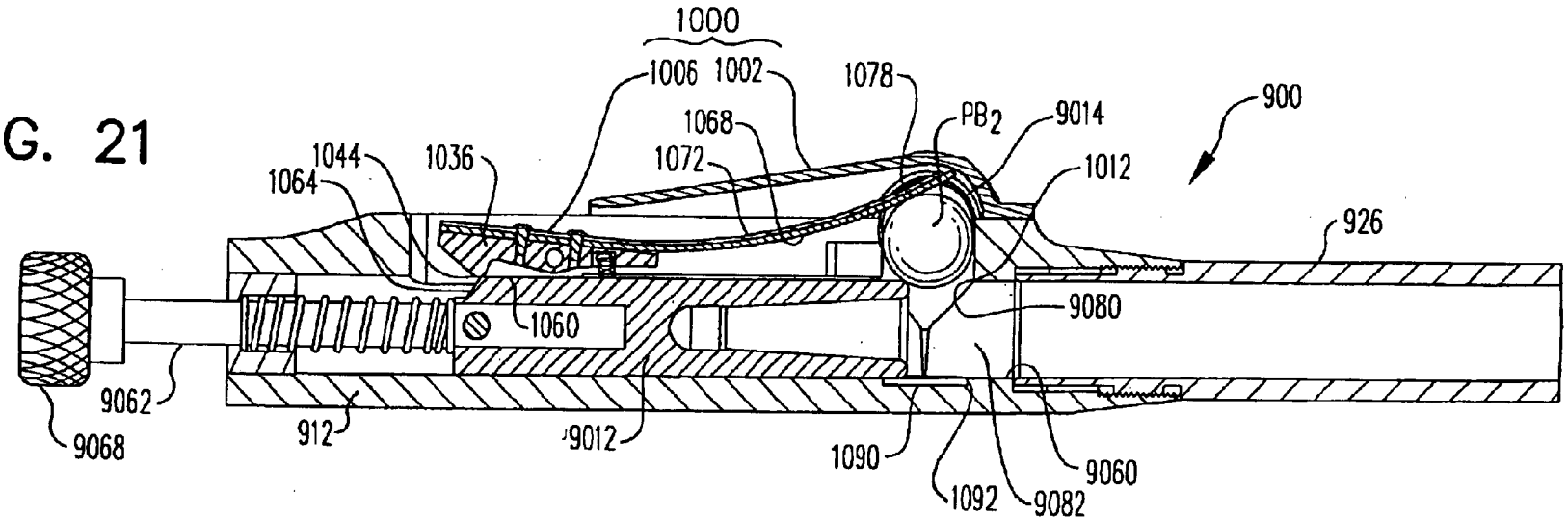

FIG. 21 is a horizontal cross-sectional view, similar to the view just provided in FIG. 20, but now showing the bolt moving to the rear of the gun, and the next paintball being urged through the loading port.

Figure 22:
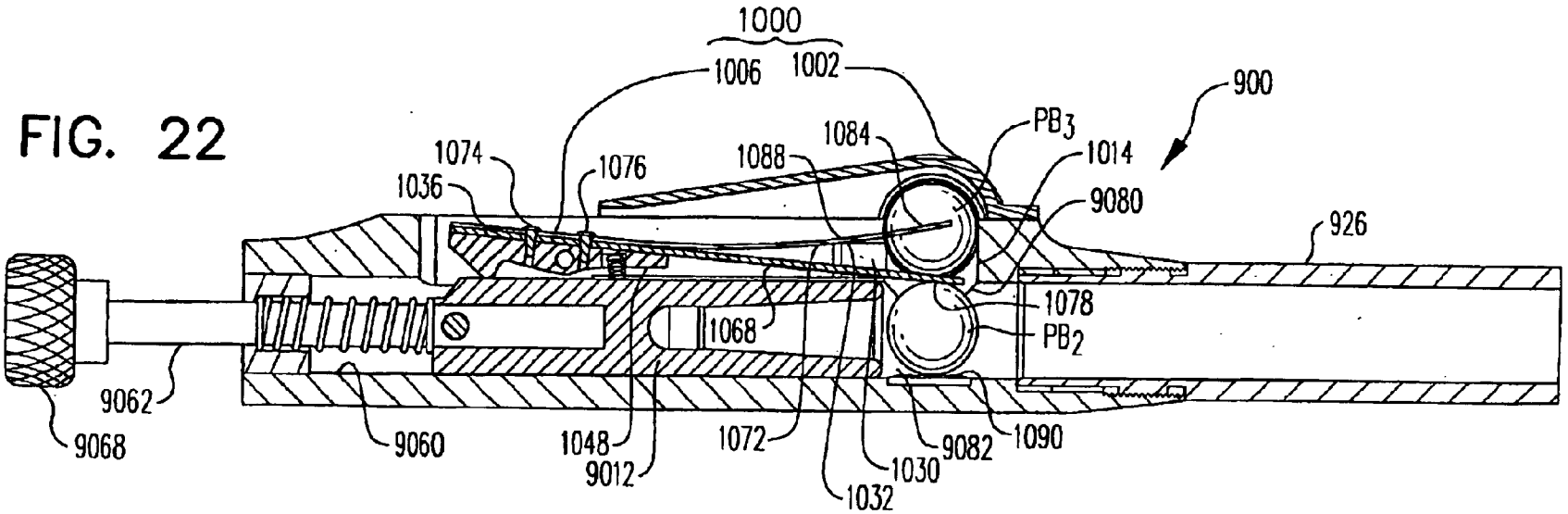

FIG. 22 is a horizontal cross-sectional view, similar to the view just provided in FIG. 20, now showing bolt completely in the open position, with a paintball in front of the bolt, ready to be chambered by closing of the bolt.

Figure 23:
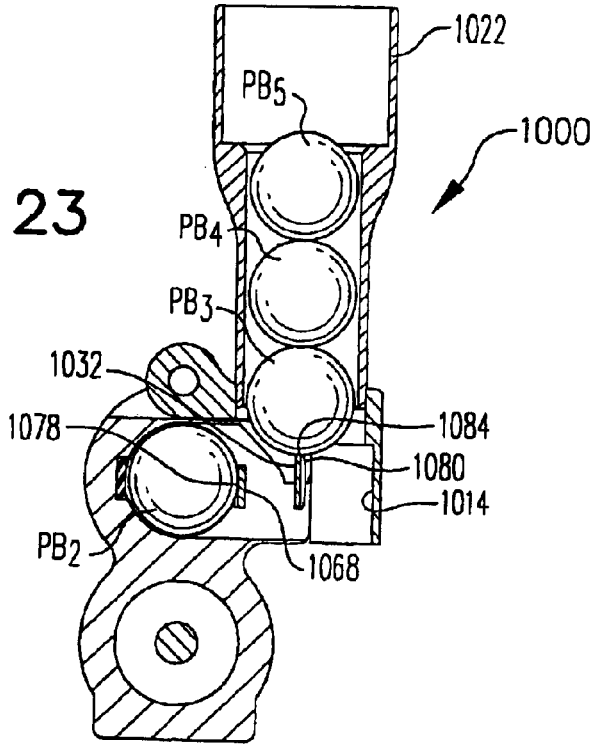

FIG. 23 is a rear cross-sectional view through the loading chamber of the gun just illustrated in FIG. 22 above, and in the same operating state as in FIG. 22, showing a new paintball stopped from fully descending from the loader feed tube into the loading chamber by the stop arm.

The foregoing figures, being merely exemplary, contain various elements that may be present or omitted from actual implementations depending upon the circumstances. An attempt has been made to draw the figures in a way that illustrates at least those elements that are significant for an understanding of the various embodiments and aspects of the invention. However, variations in the elements of the novel design which separates the typical prior art hammer into two new components, namely (1) an impacter, and (2) a recock piston, including different structural and functional variations ancillary components, especially as applied for different variations of valves, recock gas passageway members, and structures for transferring momentum from the impacter to open the valve, may be utilized in various embodiments in order to provide a robust pneumatic gun, suitable for a variety of pneumatic gun designs and applications.

PRIOR ART

It may be helpful to provide by way of background some detail regarding a typical prior art pneumatic gun. Typical prior art guns have a hammer that performs two distinct functions while utilizing a single device, namely: (1) providing the impact required to open a normally-closed valve and thereby release compressed gas, and (2) recocking the gun in response to the urging from a portion of the compressed gas released.

Figure 1:
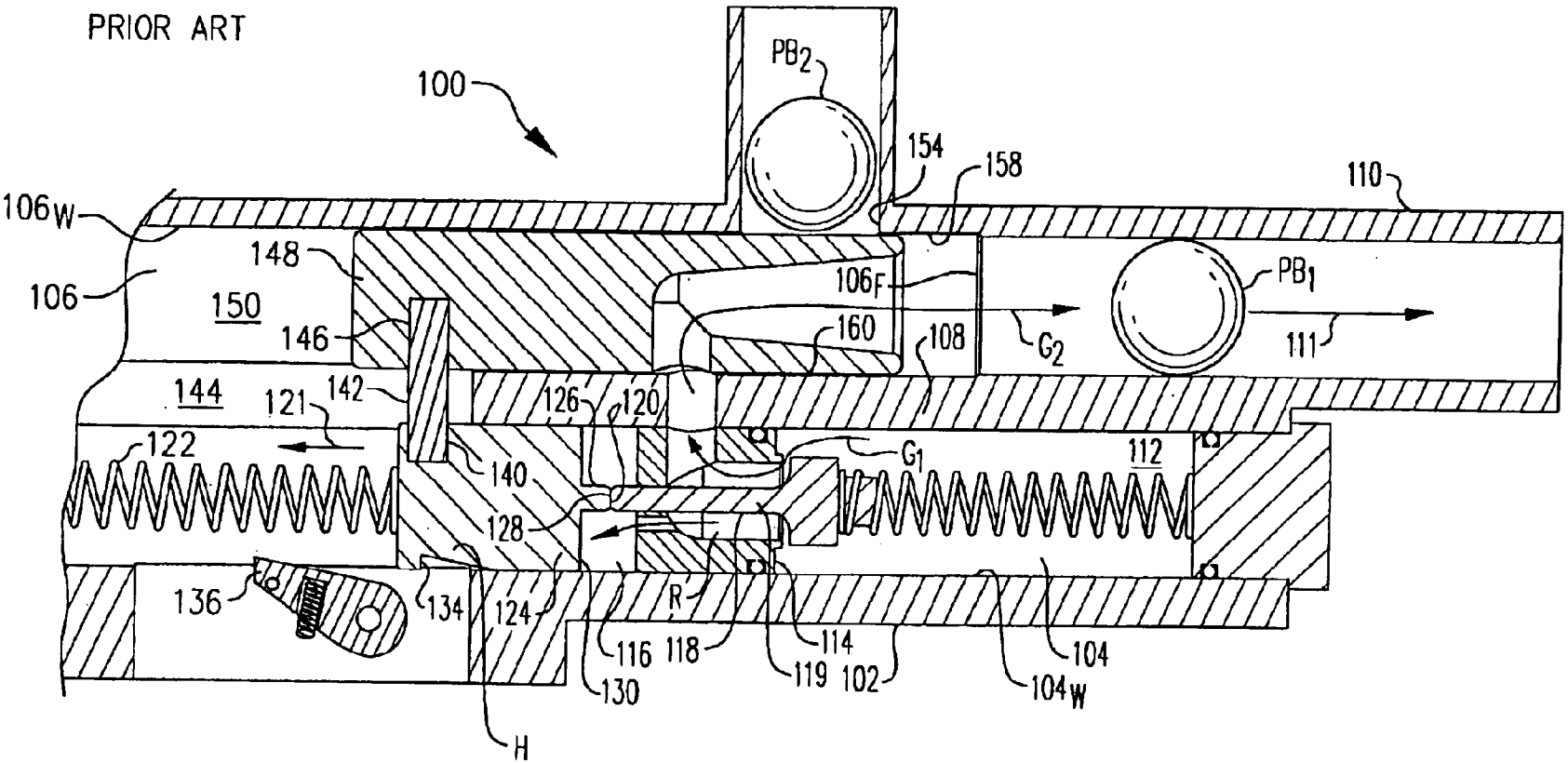
FIG. 1 PRIOR ART
FIG. 1 is a cross section of a typical prior art pneumatic gun, illustrating the use of dual function hammer which functions both as a hammer and as a recock piston.

In FIG. 1, a prior-art gun 100 adapted for the firing of paintballs $PB_1$, $PB_2$, etc., is illustrated. Gun 100 has a frame 102 containing a longitudinally extending lower cavity 104 defined by interior sidewall $\mathbf{104}_W$ and upper cavity 106 defined by interior sidewall $\mathbf{106}_W$, which cavities are separated by an intercavity web 108. Extending forward from the forward end $\mathbf{106}_F$ of upper cavity 106 is a barrel 110. Shown moving forward within barrel 110 in the direction of reference arrow 111 as a result of gun 100 just having been fired is a paintball $PB_1$.

Compressed gas received from an external source (not shown) is provided to gas reservoir portion 112 of lower cavity 104. Also within lower cavity 104, and separated from gas reservoir 112 by normally-closed impact-openable valve 114, is a recock chamber portion 116 of lower cavity 104. Valve 114 controls the release of compressed gas from gas reservoir 112 to recock chamber 116. Valve 114 includes a valve stem 118. On valve pin portion 119 of valve stem 118 is an impact-receiving face 120 adapted to receive an impact from hammer H as gun 100 is fired. Such impact momentarily opens valve 114 to release compressed gas from gas reservoir 112. One portion of the released gas is provided to propel projectile $PB_1$ from gun 100, and another portion is provided to recock chamber 116 for the purpose of recocking gun 100. This is effected by moving the hammer H rearward within recock chamber 116 in the direction indicated by reference numeral 121. Note that this prior art hammer H is slidably translatable within recock chamber 116 and functions like a piston therein. Hammer H is forwardly biased by a hammer power spring 122, thus is translatable between a rearward cocked position, and a forward impacting, valve opening position. Hammer H includes body 124 and a forward nose section 126. The hammer nose section 126 ends in a forwardly-directed impact-imparting face 128, engageable on valve pin 119 impact-receiving face 120. The forwardly-directed front surface 130 of hammer H provides a pressure-receiving piston face for receiving compressed gas provided to recock chamber 116, which compressed gas urges hammer H rearwardly to recock gun 100.

On hammer H is a forwardly-directed sear shoulder 134, engageable on a trigger-controlled sear 136 that serves to restrain hammer H rearward in the cocked position when gun 100 is ready to fire. On hammer H is a connecting rod recess 140. Extending upward from recess 140 is a bolt connecting rod 142. Connecting rod 142 extends through a slot 144 in intercavity web 108 and into a recess 146 in bolt 148. Bolt 148 is slidably translatable within a bolt chamber portion 150 of upper cavity 106. Bolt connecting rod 142 constrains bolt 148 to translate in concert with hammer H. Hence when hammer H moves rearward to the cocked position, bolt 148 also moves rearward, to open a loading port 154 for the introduction of a new projectile $PB_2$ into the gun breech 160. When hammer H moves forward to the impacting position, bolt 148 also moves forward, serving thereby to close loading port 154 and to move the new projectile $PB_2$ forward into a gun firing chamber 158.

FIG. 1 illustrates gun 100 shortly after firing. Sear 136 has disengaged from sear shoulder 134, allowing hammer H and bolt 148 to move forward. The nose section 126 impacts the impact receiving face 120 and opens valve 114, releasing compressed gas from gas reservoir 112. The portion of the gas provided for propelling paintball $PB_1$ from gun 100 flows generally along the path illustrated by the arrows $G_1$ and $G_2$, with the result that paintball $PB_1$ is accelerated forward within barrel 110. A portion of the compressed gas provided for recocking is flows into recock chamber 116 as illustrated by the arrow R, with the result that hammer H starts moving rearward in response to the force exerted by this gas on hammer front surface 130. Movement of hammer H also carries bolt 148 rearward. As can be seen from the foregoing description, hammer H in this prior-art gun is thus performing both the impacting and recocking functions. For various reasons, including those discussed hereinabove, it would be advantageous to provide a gun wherein the functions of impacting and recocking were separated, so that performance of each function is provided by different structural components.

DETAILED DESCRIPTION

Figure 2:
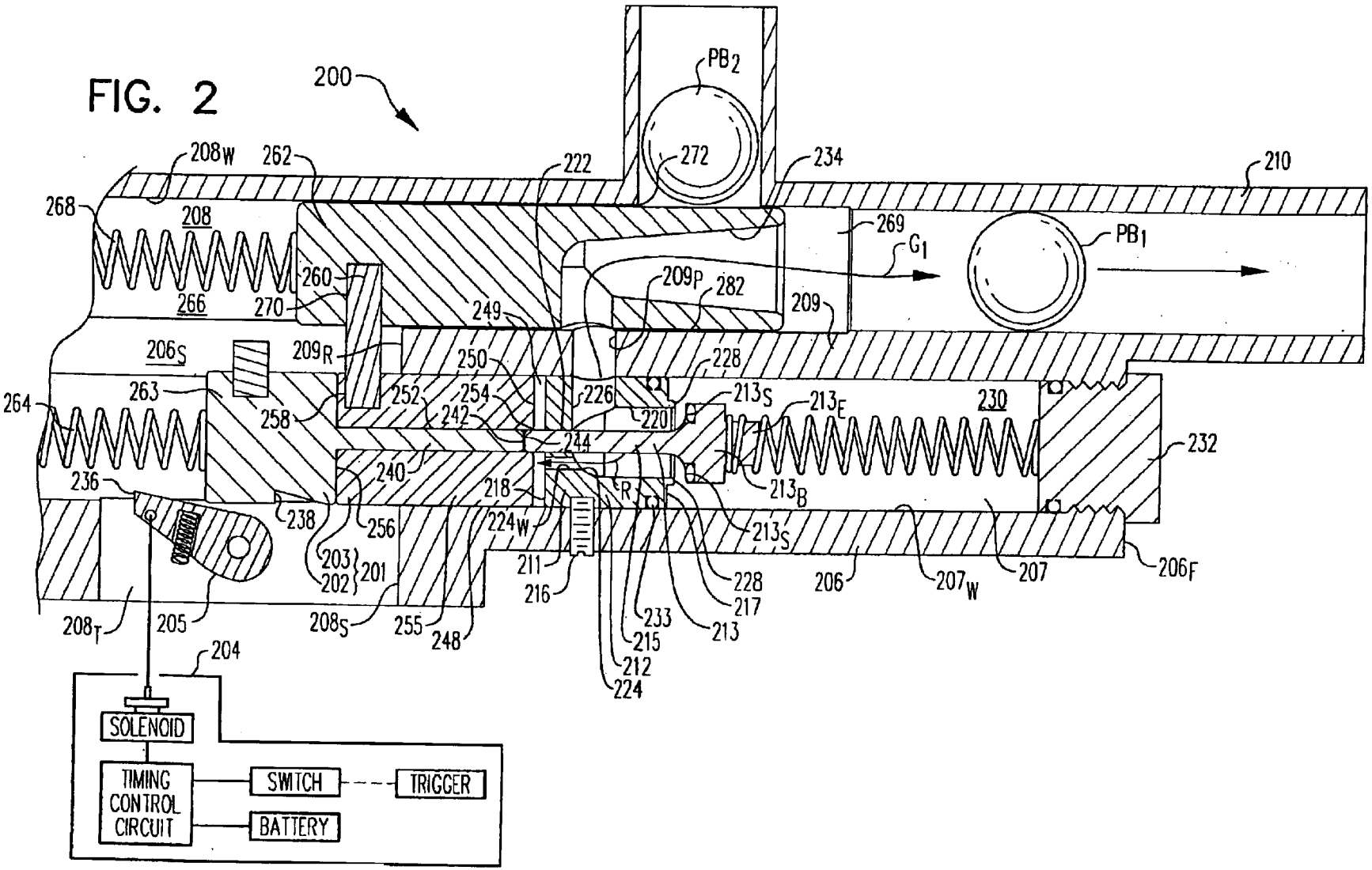
FIG. 2 is one embodiment of a novel pneumatic gun, illustrating (1) the use of separate structures for an impacter and for a recock piston, where the impacter directly engages the recock piston, and where the recock piston drives the bolt which is affixed to the recock piston by a connector, and (2) the use of an extended nose on the impacter to impact the valve stem to open the valve, as well as (3) the use of a dedicated recock gas passageway through the valve body.

Referring to FIG. 2, one embodiment of a semiautomatic pneumatic gun 200 adapted for firing projectiles by use of compressed gas as a propellant and configured with a novel firing mechanism for firing paintballs is illustrated. Incorporated into gun 200 is a hammer assembly 201, which hammer assembly 201 includes separable components, namely an impacter 202 and a recock piston 203. An electronic trigger assembly 204 including an impacter sear 205 are provided. Gun 200 has a frame 206 having a forward end $\mathbf{206}_F$. Frame 206 has a longitudinally extending lower cavity 207 defined by interior sidewall $\mathbf{207}_W$ and longitudinally extending upper cavity 208 defined by interior sidewall $\mathbf{208}_W$. Lower cavity 207 and upper cavity 208 are joined yet separated by an intercavity web 209. Intercavity web 209 is penetrated by an intercavity gas passageway $\mathbf{209}_P$ that provides fluid communication between lower cavity 207 and upper cavity 208. An intercavity web slot $\mathbf{206}_S$ is provided rearwardly of rear end $\mathbf{209}_R$ of intercavity web 209. Extending downward from lower cavity 207 is a sear slot $\mathbf{208}_T$ which is sized and shaped to accommodate selected sears. Extending forward from upper cavity 208 is a barrel 210. In this FIG. 2, a paintball $PB_1$ is shown moving forward within barrel 210 as a result of gun 200 just having been fired.

Located within lower cavity 207 is a normally-closed impact-openable valve 211. Valve 211 has a valve body 212 and a valve stem 213. Valve stem 213 includes a seal body $\mathbf{213}_B$ having a rearwardly-directed resilient valve seal $\mathbf{213}_S$ and a rearwardly extending valve pin portion 215. Extending forward on valve seal body $\mathbf{213}_B$, is an optional valve spring boss $\mathbf{213}_E$. In this embodiment, valve pin 215 is of smaller diameter than valve seal $\mathbf{213}_S$.

Valve body 212 is fixed (by means such as set screw 216) within lower cavity 207. Valve body 212 has a front face 217 and a rearwardly directed face 218. Valve body 212 is partially penetrated from the front face 217 by an intermediate bore 220. Valve body 212 is completely penetrated longitudinally by a rear bore 222, which in this embodiment is coaxial with intermediate bore 220. Valve pin 215 fits slidingly within and, in this embodiment, substantially seals rear bore 222 in valve body 212.

In this embodiment, valve body 212 is penetrated from rear face 218 by a second rear bore passageway 224 (i.e., the recock gas passageway defined by interior sidewalls $\mathbf{224}_W$) in communication with intermediate bore 220. An upper passageway 226 extends upward from intermediate bore 220 to communicate with intercavity gas passageway $\mathbf{209}_P$. Thus, upper passageway 226 and intercavity gas passageway $\mathbf{209}_P$ provide fluid communication between intermediate bore 220 and upper cavity 208, for the supply of propulsion gas to accelerate the projectile being fired.

On the front face 217 of valve body 212 is a valve seat 228, annular in shape in this embodiment. The seat 228 is sealingly engageable by valve seal $\mathbf{213}_S$ of valve stem 213; these element cooperate to control the release of compressed gas from a gas reservoir 230 in lower cavity 207 formed between valve 212 and reservoir plug 232. For sealing purposes, an exterior o-ring 233 is provided to seal valve body 212 against lower cavity 207 walls $\mathbf{207}_W$. The gas reservoir 230 is configured to receive compressed gas from an external source (not shown) in a conventional manner known to those of ordinary skill in the art and to whom this specification is addressed.

In this embodiment, recock gas porting providing fluid communications from valve 211 to recock chamber 248 includes intermediate gas bore 220 and rear bore 224. In this embodiment, propulsion gas porting includes intermediate bore 220, upper passageway 226, intercavity gas passageway $\mathbf{209}_P$, and bolt gas passageway 234.

Recock chamber 248 portion of lower cavity 207 extends rearwardly from rear face 218 of valve body 212. The sealable portion 249 of recock chamber 248 extends rearward from rear face 218 of valve body 212 to a seal break $\mathbf{208}_S$ at sear slot $\mathbf{208}_T$ in frame 206. At the slot $\mathbf{208}_T$, the compressed gas that was originally provided to recock chamber 248 (through rear bore passageway 224 defined by walls $\mathbf{224}_W$) is able to escape through the frame 206, thus relieving pressure in the sealable portion 249 of the recock chamber 248.

Impacter 202 is retained in a cocked position when sear edge 236 of sear 205 engages forwardly directed sear shoulder 238 in impacter 202. When impacter 202 is released from a cocked position, it travels forward until impact is made, directly or indirectly, with valve stem 213. As depicted in FIG. 2, an elongated nose portion 240 of impacter 202 has an impact imparting face 242 that is axially aligned with, and sized and shaped to impact the impact receiving face 244 of valve pin portion 215 of valve stem 213. The forward momentum of impacter 202 is thereby transferred, causing seal $\mathbf{213}_S$ to move forward, out of sealing engagement with valve seat 228, thus opening valve 211 and releasing compressed gas. One portion of the compressed gas released flows through recock gas porting (described above) into sealable portion 249 of recock chamber 248 as is illustrated by the reference arrow R in FIG. 2. The remaining portion of the compressed gas released travels through propulsion gas porting (described above) to the projectile $PB_1$ as illustrated by the arrows labeled $G_1$ in FIG. 2.

Valve 211, recock gas porting and propulsion gas porting described can alternately be provided in various configurations as known to those of ordinary skill in the art and to whom this specification is addressed. Hence, the specific valve, valve body, recock gas porting, and propulsion gas porting structures shown in this or other embodiments illustrated are for purposes of illustration, and should not be interpreted as limiting the present invention to any specific embodiment, whether herein illustrated or otherwise.

Recock piston 203 is slidably translatable within recock chamber 248 between a forward ready-to-fire position and a rearward impacter cocking position (neither position is shown in FIG. 2). Recock piston 203 has a forwardly directed piston face 250 slidable within sealable portion 249 of the recock chamber 248 for receiving the compressed gas provided to recock chamber 248, and recock piston 203 is sufficiently responsive to force exerted by gas released by valve 211 and provided to sealable portion 249 of recock chamber 248 to recock gun 200.

Recock piston 203 is, in the embodiment shown in FIG. 2, fully penetrated by an axially centered longitudinal passageway 252 having a cross-section complementary in size and shape, and only slightly larger than, valve pin portion 215. The location of the transition between the forwardly directed piston face 250 and longitudinal passageway 252 defines a momentum transfer portal 254. The recock piston body 255 terminates rearwardly with at least a rear face 256 portion. In the upper reaches of recock piston 203 is a connecting rod recess 258 for receiving connecting rod 260 to connect the recock piston 203 to bolt 262.

Impacter 202 is slidably translatable within recock chamber 248. Impacter 202 is forwardly biased by an impacter power spring 264. Impacter 202 translates between a rearward cocked position (not shown in FIG. 2), and a forward valve-opening position, which is illustrated in FIG. 2. In this embodiment, impacter 202 has a body portion 263 which is situated rearward of transfer portal 254 and which is larger in cross section than transfer portal 254. Thus, the recock piston 203 captures the impacter 202, as the impacter 202 is dimensioned so that it travels rearward with recock piston 203 when the recock piston 203 is energized to move rearward during recocking. Also, as shown in this embodiment, impacter 202 has an elongated nose portion 240 that is smaller in cross-section than transfer portal 254. As recock piston 203 moves rearward from the ready-to-fire position, impacter nose portion 240 effectively prevents the escape through recock piston transfer portal 254 of gas provided for recocking sufficintly to ensure that recock piston 203 travels to the impacter cocking position.

Slidably translatable within a bolt chamber portion 266 of upper cavity 208 is a bolt 262, forwardly biased by a bolt spring 268. A connecting rod 260 fits within connecting rod recess 270 in bolt 262, thereby constraining bolt 262 to translate in concert with recock piston 203. Bolt 262 is moveable rearwardly to an "open" position where loading port 272 is opened for the introduction of a new projectile $PB_2$ into a gun breech 282. Bolt 262 is then moveable forwardly to close loading port 272 and return the bolt 262 to a "closed" or "ready-to-fire" position, where the new projectile has been moved into the firing chamber 269. In the closed bolt position, the gun is substantially sealed against the loss of the compressed gas outward through the loading port 272 during firing of the projectile. Note that gas for propelling the projectile may be provided through bolt 262 via bolt gas passageway 234 which fluidly connects intercavity gas passageway $\mathbf{209}_P$ with firing chamber 269 when bolt 262 is forward in the ready-to-fire position.

FIG. 2 illustrates gun 200 shortly after firing. After impacter 202 was released from the cocked position it traveled forward, gaining momentum due to the forward urging of impacter power spring 264 until nose portion 240 contacted valve pin portion 215, thereby transferring the momentum provided by forwardly moving impacter 202 through recock piston transfer portal 254 to briefly open valve 211 and release compressed gas. That portion of compressed gas provided for recocking then flows into the sealed portion 249 of the recock chamber 248. Recock piston 203 moves rearward in response to force exerted by the pressurized gas against the recock piston face 250. Impacter 202 is located rearward of the recock piston 203, and is configured to push the impacter 202.

Since bolt 262 moves in concert with piston 203, loading port 272 will open for the entrance of the next paintball $PB_2$ in sequence to load and enter gun breech 282. As the rearward momentum of recock piston 203 and bolt 262 dissipates, they will be returned forward to their respective ready-to-fire positions in response to the forward urging of bolt spring 268 acting on bolt 262.

As can be seen from the above description, the present invention provides a hammer assembly 201 that separately provides the recock function and the valve opening function for the gun. Included in hammer assembly 201 is an impacter 202 that moves unencumbered in performing the valve-impacting function as the gun 200 is fired. A separate recock piston 203 implements the recock function. Further, since the bolt 262 is positioned forward in the port-closed position when gun 200 is ready to fire, the gun fires with a closed bolt and with a projectile already in the firing chamber. Although one specific structure is shown for these two elements of hammer assembly 201 (namely, impacter 202 and recock piston 203), it should be understood that a variety of structures capable of separably providing the impacting and recocking functions are feasible in accord with the teachings herein. Likewise, as mentioned above and as will be further illustrated below, this novel hammer assembly design can be utilized with numerous valve, bolt and frame configurations.

Although the embodiment illustrated in FIG. 2 shows bolt 262 and recock piston 203 constrained to move in concert as they translate in either direction, as will be further explained herein below in conjunction with the explanation of other figures, it should be understood that the method of the invention taught herein contemplates use of any suitable structure wherein rearward motion of recock piston 203 results in rearward motion of bolt 262, and wherein forward motion of forwardly-biased bolt 262 results in forward motion of recock piston 203. More generally, movement of recock piston 203 rearward toward the impacter cocking position results in movement of bolt 262 toward the corresponding port-open position, and movement of bolt 262 forward toward the port-closed position results in movement of recock piston 203 toward the corresponding ready-to-fire position.

Figures 3, 3A:
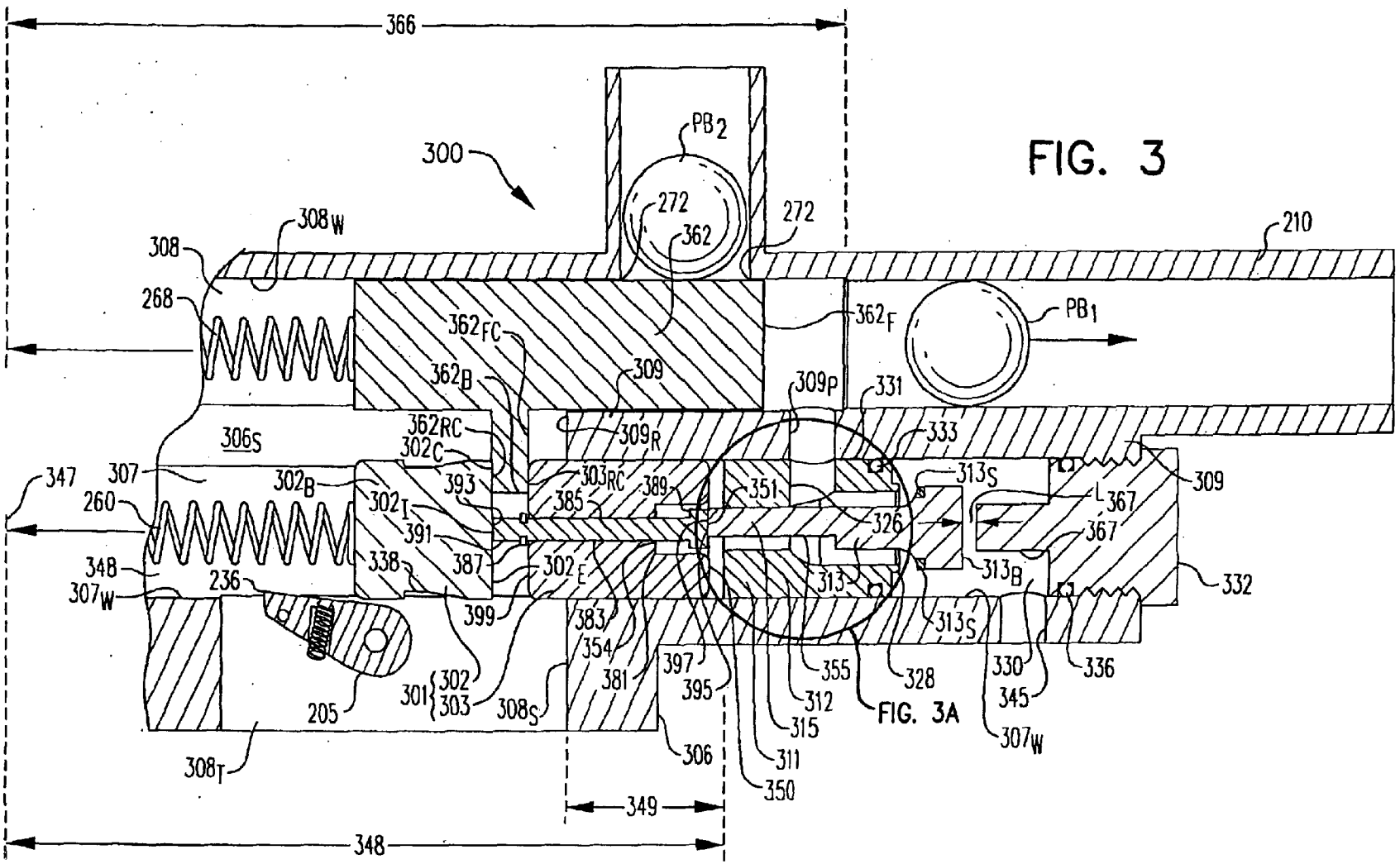
FIG. 3 is second embodiment of a novel pneumatic gun, illustrating (1) the use of an impacter which is indirectly engaged by the recock piston but which is directly engaged by a bolt connection bar (that is directly engaged by the recock piston), which connection bar drives the bolt to an open position as well as drives the impacter to its cocked position, and (2) the use of a transfer pin which at time of firing of the gun, indirectly transfers work from the impacter to the valve stem, as well as (3) the use of a passageway in and along the valve stem for passage of recock gas through the valve body toward the recock piston.
FIG. 3A is a detail of the area marked "FIG. 3A" in FIG. 3, now illustrating in enlarged detail the use of a passageway in and along the valve stem for passage of recock gas through the valve body toward the recock piston.
Figure 3A:
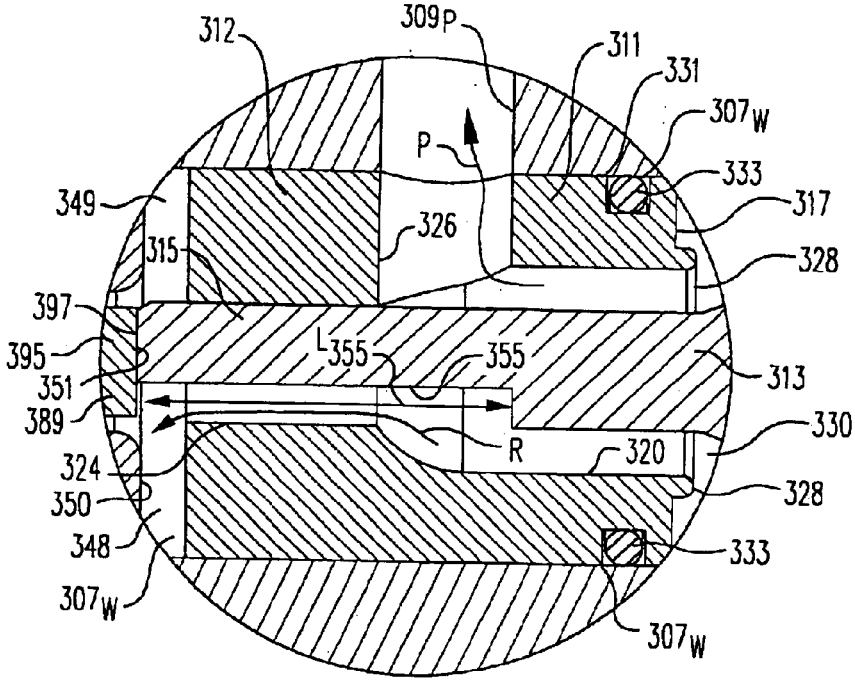

Referring now to FIG. 3, one embodiment of a semi-automatic pneumatic gun 300 configured for firing paintballs is shown. Incorporated into gun 300 is a hammer assembly 301 including (1) an impacter 302 and (2) a recock piston 303. Gun 300 also is normally provided with an electronic trigger assembly 204 as explained in FIG. 2, and including an impacter sear 205. Gun 300 has a frame 306 containing a longitudinally extending lower cavity 307 defined by interior sidewall $\mathbf{307}_W$ and a longitudinally extending upper cavity 308 defined by interior sidewall $\mathbf{308}_W$. Lower cavity 307 and upper cavity 308 are joined yet separated by an intercavity web 309. Web 309 is penetrated by an intercavity gas passageway $\mathbf{309}_P$. An intercavity web slot $\mathbf{306}_S$ is provided rearwardly of rear end $\mathbf{309}_R$ of intercavity web 309. Extending downward from lower cavity 307 is a sear slot $\mathbf{308}_T$ which is sized and shaped to accommodate one or more selected sears.

Referring both to FIG. 3 and to enlarged FIG. 3A, it can be seen that fixed within lower cavity 307 is a normally-closed impact-openable valve 311. Valve 311 has a valve body 312 and a valve stem 313. Valve stem 313 includes a seal body $313_B$ having a rearwardly directed resilient valve seal $313_S$ and a valve pin portion 315, which pin portion 315 is of smaller diameter than the valve seal $313_S$. On the front 317 of valve body 312 is a valve seat 328, annular in shape in this embodiment. The seat 328 is sealingly engageable by valve seal $313_S$ of valve stem 313. These just mentioned elements cooperate to control the release of compressed gas from a gas reservoir 330 in lower cavity 307 formed between valve 312 and reservoir plug 332. For sealing purposes, reservoir plug 332 has an external o-ring 336, and an exterior o-ring 333 is provided to seal valve body 312 against lower cavity 307 walls $307_W$. The gas reservoir 330 is configured to receive compressed gas from an external source (not shown) in a conventional manner via gas inlet 345.

Extending rearwardly from valve body 312 to rear end 347 of lower cavity 307 (similar to the configuration shown in FIG. 17 also) is a recock chamber portion 348 of lower cavity 307. A sealable portion 349 of recock chamber 348 extends rearward from valve body 312 to a seal break $308_S$, where recock gas provided to recock chamber 348 is able to escape through frame 306.

Valve pin 315 ends in a rearwardly-directed impact-receiving face 351 adapted to receive an impact as gun 300 is fired. On firing, valve 311 is momentarily opened to release compressed propulsion gas. On valve pin 315 there is a recock gas passage flat 355 that continues forward a predetermined distance $L_{355}$ from impact-receiving face 351, to form a recock gas passageway in and along the valve pin 315.

In this embodiment, valve body 312 is generally cylindrical, and is coaxially penetrated partially from the front 317 by an intermediate bore 320 and completely by a rear bore 324 of smaller diameter than the intermediate bore 320.

An upper passageway 326 extends upward from intermediate bore 320 to communicate with intercavity gas passageway $309_P$. Thus upper passageway 326 and intercavity gas passageway $309_P$ provide fluid communication between intermediate bore 320 and upper cavity 308. Forward of upper passageway 326 on the exterior 331 of valve body 312 is a resilient front o-ring 333 for sealing between valve 312 and lower cavity walls $307_W$ to prevent escape of pressurized gas.

Extending rearwardly from reservoir plug 332 is a valve stem retention boss 367. Valve stem retention boss 367 on reservoir plug 332 limits the forward motion of valve stem 313 to a predetermined distance $L_{367}$ sufficient to ensuring that valve pin 315 does not tip sideways and bind within rear bore 324.

Valve pin 315 fits slidingly within valve body 312 rear bore 324. Recock gas passage flat 355 provides a recock gas passageway within rear bore 324. When valve 311 is open, gas flows into intermediate bore 320. One portion of the compressed gas flows thru recock gas passageway within rear boar 324 via passageway flat 355, and into sealable portion 349 of the recock chamber 348, as is illustrated by the arrow R in FIG. 3A. Intermediate bore 320, upper passageway 326, and intercavity gas passageway $309_P$ provide passage for the remaining portion of the compressed gas released to flow upwards into upper cavity 308 as illustrated by the arrows labeled P in FIG. 3A.

Impacter 302 is slidably translatable within recock chamber 348 and is forwardly biased therein by an impacter power spring 260. Impacter 302 is slidable from a cocked position to a forward valve opening position. Impacter 302 has a body $302_B$, with an impacter forward end $302_E$. On impacter forward end $302_E$ in this embodiment are an impact-imparting face $302_I$ for transferring momentum of a moving impacter 302 to valve 311, directly or indirectly. An impacter contact face $302_C$ is provided for contacting the recock piston 303, either directly, or as shown in this embodiment, indirectly via way of bolt contact bar $362_B$. On impacter body $302_B$ is a forwardly-directed sear shoulder 338, engageable on edge 236 of trigger-controlled sear 205 that serves to restrain impacter 302 rearward in the cocked position (not shown in FIG. 3) when gun 300 is ready to fire.

Recock piston 303 is slidably translatable within recock chamber 348 between a forward ready-to-fire position and a rearward impacter cocking position (neither position shown in FIG. 3). Recock piston 303 has a forwardly directed pressure receiving face 350 slidable within sealable portion 349 of recock chamber 348. Recock piston 303 is sufficiently responsive to force exerted by gas released by valve 311 and provided to sealable portion 349 of recock chamber 348 to recock gun 300. Centrally located on pressure receiving face 350 is a U-shaped impact transfer pin head recess 381. Recock piston 303 is penetrated by a longitudinal impact-transfer passageway 383 providing a transfer portal 354 through face 350, for accommodating in close fitting engagement therewith, an impact transfer structure, here shown as transfer pin 385, but alternately may be provided as an enlongated nose portion on an impacter (see FIG. 5 and accompanying explanation) or an elongated valve pin (see FIG. 4 and accompanying explanation). Slidable within the longitudinal impact-transfer passageway 383 and transfer portal 354 is impact transfer pin 385, captive therein by virtue of an exterior snap ring 387 at or near rear end 391 and an enlarged head portion 389 that fits slidably within transfer pin head recess 381 at the other end. Transfer pin 385 terminates at the rear end 391 in a transfer pin impact-receiving face 393 engageable by impacter impact-imparting face $302_I$. At the front end 395, in a transfer pin impact-imparting face 397 engageable on valve pin impact-receiving face 351. Recock piston 303 has a rear face 399, which in this embodiment provides a piston contact face $303_{RC}$ for contact with bolt 362.

Slidably translatable within a bolt chamber portion 366 of upper cavity 308 is a bolt 362, forwardly biased by a bolt spring 268. Bolt 362 is moveable rearwardly to an "open" position where loading port 272 is opened for the introduction of a new projectile $PB_2$ into gun 300. Bolt 362 is then moveable forwardly to close loading port 272, to return the gun to a "closed" or "ready to fire" position, where the new projectile $PB_2$ has been moved into the firing chamber, i.e., immediately in front of the forward end $362_F$ of bolt 362 when the bolt is moved to the closed position. In the closed position, the gun 300 is substantially sealed against the loss of compressed gas outward through the loading port 272 during firing of the projectile.

Extending from bolt 362 downward through intercavity web slot $309_S$ and into lower cavity 308 is a bolt connection bar $362_B$ having a bolt forward contact face $362_{FC}$ and a bolt rearward contact face $362_{RC}$. When recock piston 303 moves rearward, the recock piston rearward contact face $303_{RC}$ and bolt forward contact face $362_{FC}$ engage to move bolt 362 rearward. Bolt rearward contact face $362_{RC}$ and impacter contact face $302_C$ engage to move impacter 302 rearward. When bolt 362 moves forward in response to the urging of bolt spring 268, bolt forward contact face $362_{FC}$ engages recock piston rearward contact face $303_{RC}$ to move recock piston 303 forward. Thus, bolt 362 is responsive to rearward motion of recock piston 303, recock piston 303 is responsive to forward motion of bolt 362, and impacter 302 is responsive to rearward movement of recock piston 303.

In summary, the embodiment of a novel pneumatic gun 300 shown in FIGS. 3 and 3A illustrates the use of an impacter 302 which is indirectly engaged by the recock piston 303, but which is directly engaged by a bolt connection bar $\mathbf{362}_B$. The bolt connection bar $\mathbf{362}_B$ is directly engaged by the recock piston 303. The connection bar $\mathbf{362}_B$ drives the bolt 362 to an open position, and drives the impacter 302 to its cocked position. The use of a transfer pin 385 is also illustrated, which at time of firing of the gun, indirectly transfers momentum from the impacter 302 to the valve stem 313. Finally, the use of a passageway flat 355 in and along the valve pin 315 for passage of recock gas through the valve body 312 toward the recock piston 303 is shown. The detail shown in FIG. 3A illustrates in enlarged detail the use of such a passageway flat 355 in and along the valve pin 315 portion of the valve stem 313, for passage of recock gas through the valve body 312 toward the recock piston 303.

Figure 4A:
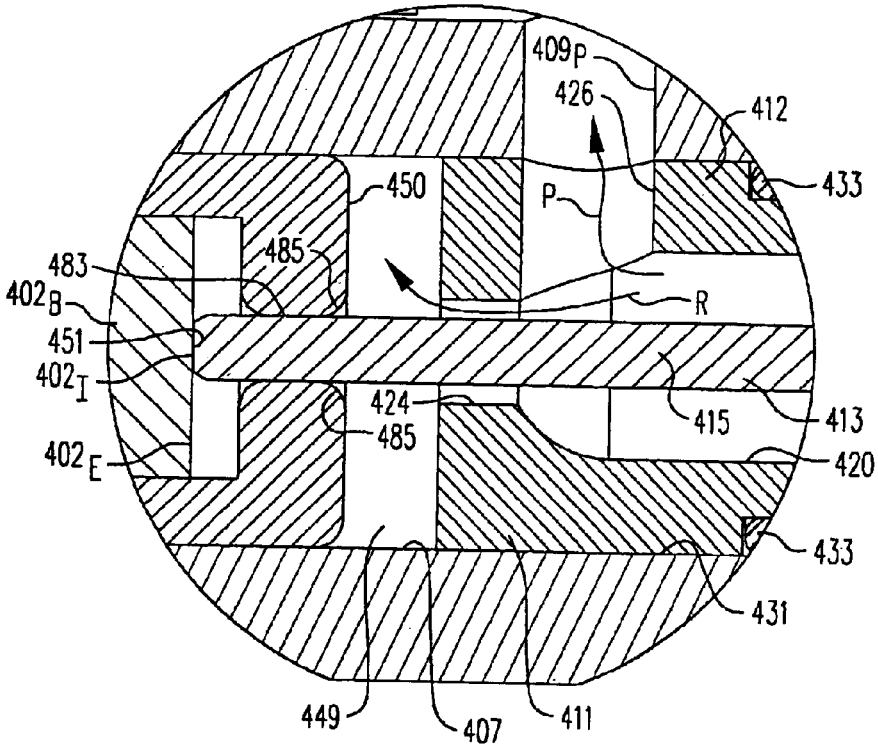
FIG. 4A is a detail of the area marked "FIG. 4A" in FIG. 4, now illustrating in enlarged detail the use of a passageway alongside of the valve stem but through the valve body for passage of recock gas through the valve body toward the recock piston.
Figure 4:
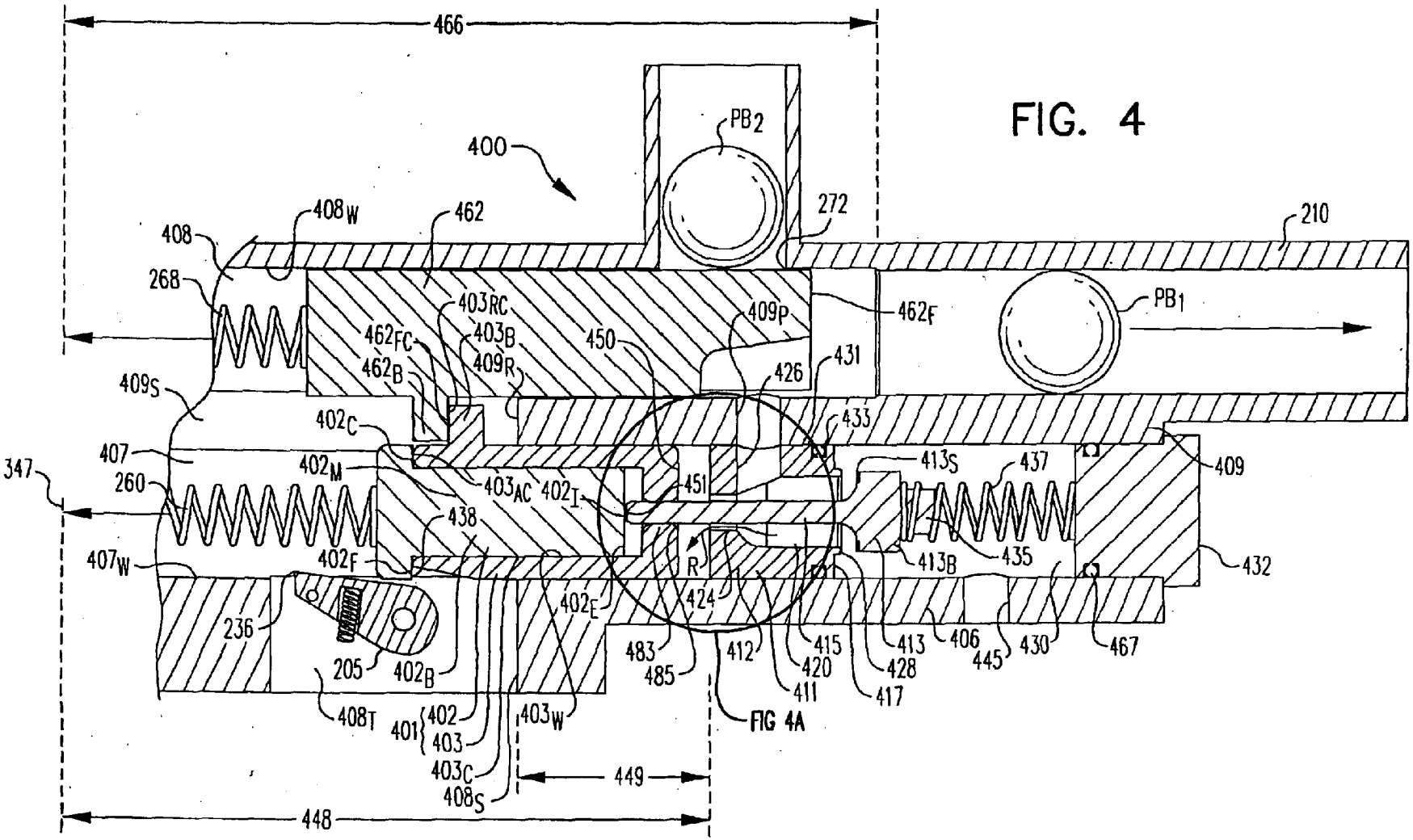
FIG. 4 is a third embodiment of a novel pneumatic gun, illustrating (1) the use of an impacter having an outer flanged portion which directly engages the recock piston, wherein the impacter does not engage a the bolt or its bolt connection bar, since the bolt is driven by a contact bar portion of the recock piston which interfaces with the bolt connection bar, and (2) the use of a bolt with a gas passage along lower frontal portion thereof, and (3) the use of a passageway alongside of the valve stem but through the valve body for passage of recock gas through the valve body toward the recock piston.

Turning now to FIG. 4, another embodiment of a pneumatic gun is illustrated as gun 400. Incorporated into gun 400 is a hammer assembly 401 including (1) an impacter 402 and (2) a recock piston 403. Gun 400 also is normally provided with an electronic trigger 204 as explained in FIG. 2, including an impacter sear 205. Gun 400 has a frame 406 containing a longitudinally extending lower cavity 407 defined by interior sidewall $\mathbf{407}_W$ and a longitudinally extending upper cavity 408 defined by interior sidewall $\mathbf{408}_W$. Lower cavity 407 and upper cavity 408 are joined yet separated by an intercavity web 409. Web 409 is penetrated by an intercavity gas passageway $\mathbf{409}_P$. An intercavity web slot $\mathbf{409}_S$ is provided rearwardly of rear end $\mathbf{409}_R$ of intercavity web 409. Extending downward from lower cavity 407 is a sear slot $\mathbf{408}_S$ which is sized and shaped to accommodate one or more selected sears.

Referring both to FIG. 4 and to enlarged FIG. 4A, it can be seen that fixed within lower cavity 407 is a normally-closed impact-openable valve 411. Valve 411 has a valve body 412 and a valve stem 413. Valve stem 413 includes a seal body $\mathbf{413}_B$ having a rearwardly directed resilient valve seal $\mathbf{413}_S$ and an elongated valve pin portion 415. Pin portion 415 is of smaller diameter than the valve seal $\mathbf{413}_S$. On the front 417 of valve body 412 is a valve seat 428, annular in shape in this embodiment. The seat 428 is sealingly engageable by valve seal $\mathbf{413}_S$ of valve stem 413. These just mentioned elements cooperate to control the release of compressed gas from a gas reservoir 430 in lower cavity 407 formed between valve 412 and reservoir plug 432. For sealing purposes, reservoir plug 432 has an exterior o-ring 467, and an exterior o-ring 433 is provided to seal valve body 412 against lower cavity 407 walls $\mathbf{407}_W$. The gas reservoir 430 is configured to receive compressed gas from an external source (not shown) in a conventional manner via gas inlet 445.

Extending rearwardly from valve body 412 to rear end 347 of lower cavity 407 (similar to the configuration shown in FIG. 17 also) is a recock chamber portion 448 of lower cavity 407. A sealable portion 449 of recock chamber 448 extends rearward from valve body 412 to a seal break $\mathbf{408}_S$, where recock gas provided to recock chamber 448 is able to escape through frame 406.

Valve pin 415 ends in a rearwardly-directed impact-receiving face 451 adapted to receive an impact as gun 400 is fired. On firing, valve 411 is momentarily opened to release compressed propulsion gas. In this embodiment, valve body 412 is generally cylindrical, and is coaxially penetrated partially from the front 417 by an intermediate bore 420 and completely by a rear bore 424 of smaller diameter than the intermediate bore 420.

An upper passageway 426 extends upward from intermediate bore 420 to communicate with intercavity gas passageway $\mathbf{409}_P$. Thus upper passageway 426 and intercavity gas passageway $\mathbf{409}_P$ provide fluid communication between intermediate bore 420 and upper cavity 408. Forward of upper passageway 426 on the exterior 431 of valve body 412 is a resilient front o-ring 433 for sealing between valve 412 and lower cavity walls $\mathbf{407}_W$ to prevent escape of pressurized gas.

Extending rearwardly from reservoir plug 432 is a valve spring 437 for urging valve stem 413 toward a valve closed position. To stabilize the location of spring 437, a spring retention boss 435 is provided on the forward reaches of valve stem 413.

Valve pin 415 fits slidingly within valve body 412 rear bore 424. Recock gas passage is provided through oversizing of rear bore 424. When valve 411 is open, gas flows into intermediate bore 420. One portion of the compressed gas flows thru recock gas passageway via oversized rear borer 424, and into sealable portion 449 of the recock chamber 448, as is illustrated by the arrow R in FIG. 4A. Intermediate bore 420, upper passageway 426, and intercavity gas passageway $\mathbf{409}_P$ provide passage for the remaining portion of the compressed gas released to flow upwards into upper cavity 408 as illustrated by the arrow labeled P in FIG. 4A.

Impacter 402 is slidably translatable within recock chamber 448 and is forwardly biased therein by an impacter power spring 260. Impacter 402 is slidable from a cocked position to a forward valve opening position. Impacter 402 has a body $\mathbf{402}_B$, with a middle portion $\mathbf{402}_M$ and an impacter forward end $\mathbf{402}_E$. On impacter forward end $\mathbf{402}_E$ in this embodiment are an impact-imparting face $\mathbf{402}_I$ for transferring momentum of a moving impacter 402 to valve 411, directly or indirectly. An impacter contact face $\mathbf{402}_C$ is provided for contacting the recock piston 403, either directly as shown in this FIG. 4, or indirectly. Thus impacter 402 is directly responsive to rearward travel of recock piston 403. On impacter body $\mathbf{402}_B$ is a forwardly-directed flange $\mathbf{402}_F$ which functions as a sear shoulder 438, engageable on edge 236 of trigger-controlled sear 205 that serves to restrain impacter 402 rearward in the cocked position (not shown in FIG. 4) when gun 400 is ready to fire.

Recock piston 403 is slidably translatable within recock chamber 448 between a forward ready-to-fire position and a rearward impacter cocking position (neither position shown in FIG. 4). Recock piston 403 has a forwardly directed pressure receiving face 450 slidable within sealable portion 449 of recock chamber 448. Recock piston 403 is sufficiently responsive to force exerted by gas released by valve 411 and provided to sealable portion 449 of recock chamber 448 to recock gun 400. Recock piston 403 is penetrated by a longitudinal impact-transfer passageway 483, for accommodating an impact transfer structure, here shown as valve pin 415. Recock piston 403 comprises an impacter receiving portion which comprises, rearward of piston face 450, an interior sidewall $\mathbf{403}_W$ defining a cavity $\mathbf{403}_C$ sized and shaped to receive, in interfitting sliding engagement, middle portion $\mathbf{402}_M$ of impacter 402. The point of penetration of pressure receiving face 450 by the longitudinal impact transfer passageway 483 is considered to define a momentum transfer portal 485, since the required momentum may be alternately provided through use of an enlongated nose portion on an impacter (see FIG. 5 and accompanying explanation) or a transfer pin (see FIG. 3 and accompanying explanation).

Slidably translatable within a bolt chamber portion 466 of upper cavity 408 is a bolt 462, forwardly biased by a bolt spring 268. Bolt 462 is moveable rearwardly to an "open" position where loading port 272 is opened for the introduction of a new projectile $PB_2$ into gun 400. Bolt 462 is then moveable forwardly to close loading port 272, to return the gun to a "closed" or "ready to fire" position, where the new projectile $PB_2$ has been moved into the firing chamber, i.e., immediately in front of the forward end $\mathbf{462}_F$ of bolt 462 when the bolt is moved to the closed position. In the closed position, the gun 400 is substantially sealed against the loss of compressed gas outward through the loading port 272 during firing of the projectile.

Recock piston 403 has a rear contact bar $\mathbf{403}_B$, which in this embodiment provides a recock piston contact face $\mathbf{403}_{RC}$ for contact with a forward contact face $\mathbf{462}_{FC}$ of a downwardly extending bolt connector bar $\mathbf{462}_B$. When recock piston 403 moves rearward, the recock piston rearward contact face $\mathbf{403}_{RC}$ and bolt forward contact face $\mathbf{462}_{FC}$ engage to move bolt 462 rearward. Thus, bolt 462 is responsive to rearward motion of recock piston 403. Recock piston annular contact face $\mathbf{403}_{AC}$ and impacter contact flanged contact face $\mathbf{402}_C$ engage to move impacter 402 rearward. When bolt 462 moves forward in response to the urging of bolt spring 268, bolt forward contact face $\mathbf{462}_{FC}$ engages recock piston rearward contact face $\mathbf{403}_{RC}$ to move recock piston 403 forward. Thus recock piston 403 is responsive to forward motion of bolt 462, and impacter 402 is responsive to rearward movement of recock piston 403.

The embodiment shown in FIG. 4 can be summarized in that it illustrates: (1) the use of an impacter 402 having an outer flanged portion which directly engages the recock piston 403, wherein the impacter 402 does not engage the bolt or its bolt connection bar. The bolt is driven by a contact bar portion of the recock piston 403 which interfaces with the bolt connection bar; (2) the use of a bolt with a gas passage along lower frontal portion thereof, and (3) the use of a passageway alongside of the valve stem but through the valve body for passage of recock gas through the valve body toward the recock piston. FIG. 4A shows in enlarged detail the use of a passageway alongside of the valve pin 415 but through the valve body 412 for passage of recock gas through the valve body 412 toward the recock piston 403.

Figures 5, 5A:
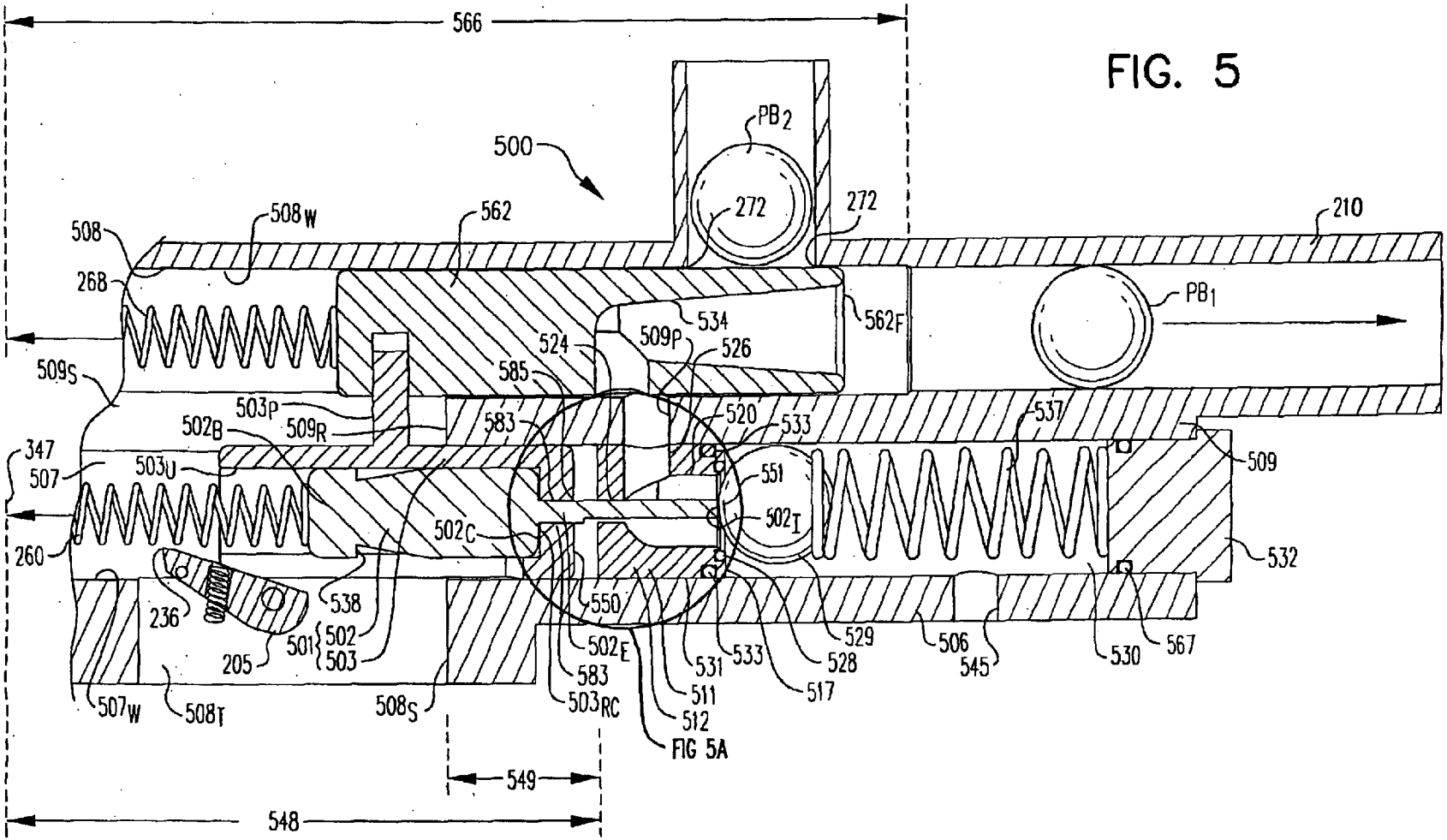
FIG. 5 is a fourth embodiment of a novel pneumatic gun, illustrating (1) the use of an impacter which translates within a bore in a recock piston, where the impacter has a front face that directly engages the recock piston, wherein the impacter does not engage the bolt or its bolt connection bar, since the bolt is driven by a connection rod provided with the recock piston, and (2) the use of a bolt with a gas passage upward from the bottom to discharge along its centerline at the frontal portion thereof, and (3) the use of a passageway in and along a nose portion of the impacter for passage of recock gas through the valve body toward the recock piston, and (4) the use of a valve having a ball and matching seat, rather than an elongated stem and matching seat as illustrated in FIGS. 2 and 3 above.
FIG. 5A illustrates in detail of the area marked "FIG. 5A" in FIG. 5, now illustrating in enlarged detail the use of a passageway in and alongside of nose portion of an impacter for passage of recock gas through the valve body toward the recock piston.
Figure 5A:
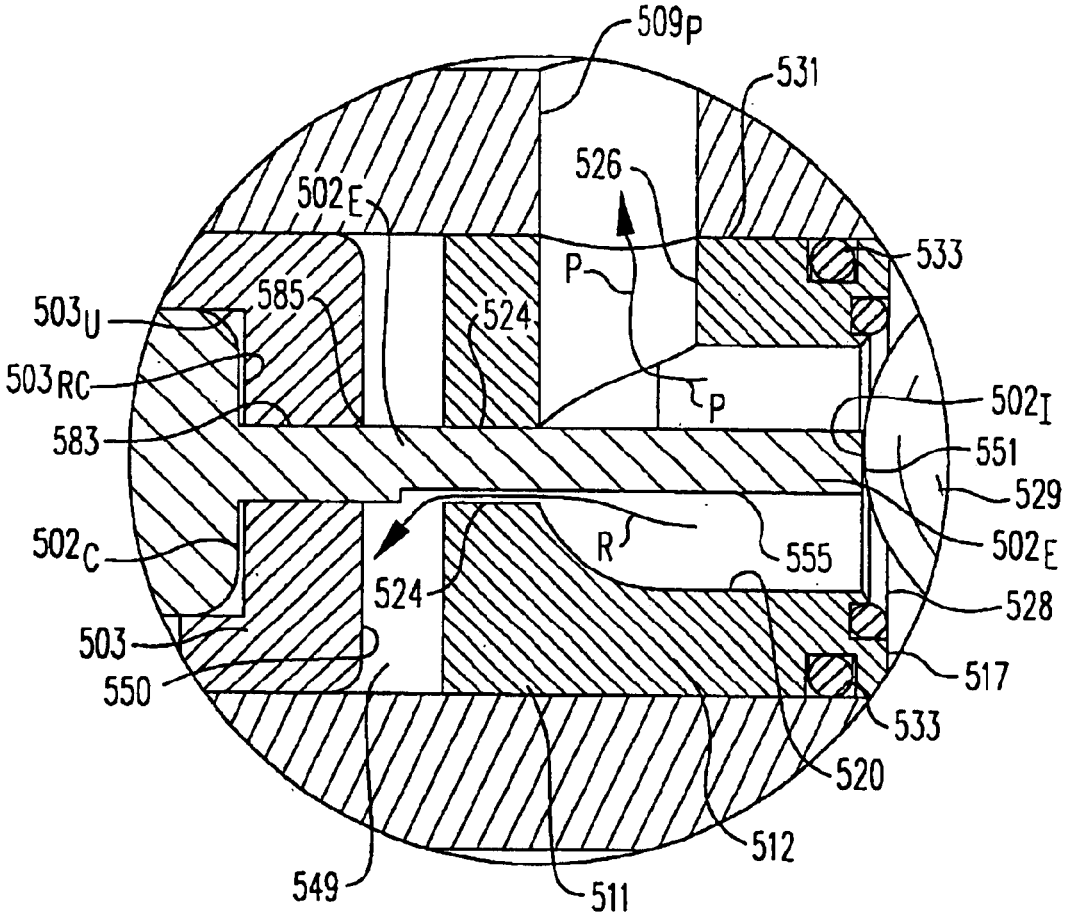

Attention is now is directed to FIG. 5, where a fourth embodiment of a novel pneumatic gun is provided. In short, FIG. 5 depicts (1) the use of an impacter 502 which translates within a bore $\mathbf{503}_U$ in a recock piston 503, where the impacter 502 has a front contact face $\mathbf{502}_C$ that directly engages the recock piston 503, wherein the impacter does not engage a the bolt or its bolt connection bar, since the bolt is driven by a bolt connection bar provided with the recock piston, and (2) the use of a bolt with a gas passage upward from the bottom to discharge along its centerline at the frontal portion thereof, and (3) the use of a passageway in and along a nose portion of the impacter for passage of recock gas through the valve body toward the recock piston, and (4) the use of a valve having a ball and matching seat, rather than an elongated stem and matching seat as illustrated in FIGS. 2 and 3 above. FIG. 5A illustrates in enlarged detail the use of a passageway in and alongside of nose portion of an impacter for passage of recock gas through the valve body toward the recock piston.

Referring to FIG. 5, incorporated into gun 500 is a hammer assembly 501 including (1) an impacter 502 and (2) a recock piston 503. Gun 500 also is normally provided with an electronic trigger assembly 204 as explained in FIG. 2, including an impacter sear 205. Gun 500 has a frame 506 containing a longitudinally extending lower cavity 507 defined by interior sidewall $\mathbf{507}_W$ and a longitudinally extending upper cavity 508 defined by interior sidewall $\mathbf{508}_W$. Lower cavity 507 and upper cavity 508 are joined yet separated by an intercavity web 509. Web 509 is penetrated by an intercavity gas passageway $\mathbf{509}_P$. An intercavity web slot $\mathbf{509}_S$ is provided rearwardly of rear end $\mathbf{509}_R$ of intercavity web 509. Extending downward from lower cavity 507 is a sear slot $\mathbf{508}_T$ which is sized and shaped to accommodate one or more selected sears.

Referring both to FIG. 5 and to enlarged FIG. 5A, it can be seen that fixed within lower cavity 507 is a normally-closed impact-openable valve 511. Valve 511 has a valve body 512. On the front 517 of valve body 512 is a valve seat 528, annular in shape in this embodiment. The seat 528 is sealingly engageable by valve ball 529. These just mentioned elements cooperate to control the release of compressed gas from a gas reservoir 530 in lower cavity 507 formed between valve 512 and reservoir plug 532. For sealing purposes, reservoir plug 532 has an external o-ring 567, and an exterior o-ring 533 is provided to seal valve body 512 against lower cavity 507 walls $\mathbf{507}_W$. The gas reservoir 530 is configured to receive compressed gas from an external source (not shown) in a conventional manner via gas inlet 545.

Extending rearwardly from valve body 512 to rear end 347 (similar to the configuration shown in FIG. 17 also) of lower cavity 507 is a recock chamber portion 548 of lower cavity 507. A sealable portion 549 of recock chamber 548 extends rearward from valve body 512 to a seal break $\mathbf{508}_S$, where recock gas provided to recock chamber 548 is able to escape through frame 506.

Valve ball 529 ends in a rearwardly-directed impact-receiving face 551 (actually, any surface of ball 529 that happens to be rearwardly directed at time of firing) adapted to receive an impact as gun 500 is fired. On firing, valve 511 is momentarily opened to release compressed gas. In this embodiment, valve body 512 is generally cylindrical, and is coaxially penetrated partially from the front 517 by an intermediate bore 520 and completely by a rear bore 524 of smaller diameter than the intermediate bore 520.

An upper passageway 526 extends upward from intermediate bore 520 to communicate with intercavity gas passageway 509p. Thus upper passageway 526 and intercavity gas passageway 509p provide fluid communication between intermediate bore 520 and upper cavity 508. Forward of upper passageway 526 on the exterior 531 of valve body 512 is a resilient front o-ring 533 for sealing between valve body 512 and lower cavity walls 507w to prevent escape of pressurized gas.

Extending rearwardly from reservoir plug 532 is a valve spring 537 for urging valve ball 529 toward a valve closed position.

Impacter 502 is slidably translatable within recock chamber 548 and is forwardly biased therein by an impacter power spring 260. Impacter 502 is slidable from a cocked position to a forward valve opening position. Impacter 502 has a body $\mathbf{502}_B$, and an elongated nose portion $\mathbf{502}_E$. On elongated nose portion $\mathbf{502}_E$ is an impact-imparting face $\mathbf{502}_I$ for transferring momentum of a moving impacter to valve ball 529. An impacter contact face 502*C* is provided for contacting the recock piston 503 directly as shown in this FIG. 5A. On impacter body $\mathbf{502}_B$ is a forwardly-directed sear shoulder 538, engageable on edge 236 of trigger-controlled sear 205 that serves to restrain impacter 502 rearward in the cocked position (not shown in FIG. 5) when gun 500 is ready to fire.

Recock piston 503 is slidably translatable within recock chamber 548 between a forward ready-to-fire position and a rearward impacter cocking position (neither position shown in FIG. 5). Recock piston 503 has a forwardly directed pressure receiving face 550 slidable within sealable portion 549 of recock chamber 548. Recock piston 503 is sufficiently responsive to force exerted by gas released by valve 511 and provided to sealable portion 549 of recock chamber 548 to recock gun 500. Recock piston 503 is penetrated by a longitudinal impact-transfer passageway 583, for accommodating an impact transfer structure, here shown as elongated nose portion $\mathbf{502}_E$ of impacter 502. Recock piston 503 comprises a generally horizontal U-shaped structure having a recock piston interior sidewall. Impacter body 502*B* is sized and shaped in an elongated structure having outer dimensions complementary in size and shape to recock piston interior sidewall, so that impacter body 502*B* is slidingly engageable therewithin. The point of penetration of pressure receiving face 550 by the longitudinal impact transfer passageway 583 is considered to define a momentum transfer portal 585, since the required momentum may be alternately provided through use of an elongated nose portion $\mathbf{502}_E$ on an impacter as just illustrated, or by a valve pin (see FIG. 4 and accompanying explanation) or a transfer pin (see in FIG. 3 and accompanying explanation). Note that the elongated nose portion $\mathbf{502}_E$ can be provided in a generally cylindrical shape, as envisioned in FIGS. 5 and 5A. Importantly, as shown in FIG. 5A, a flat 555 on a portion of the nose portion 502E can be provided for provision of a recock gas passageway in and along the elongated nose portion $\mathbf{502}_E$. When valve 511 is open, gas flows into intermediate bore 520. One portion of the compressed gas flows thru recock gas passageway within rear bore 524, and into sealable portion 549 of the recock chamber 548, as is illustrated by the arrow R in FIG. 5A. Intermediate bore 520, upper passageway 526, and intercavity gas passageway 509*P* provide passage for the remaining portion of the compressed gas released to flow upwards into upper cavity 508 as illustrated by the arrow labeled P in FIG. 5A.

Slidably translatable within a bolt chamber portion 566 of upper cavity 508 is a bolt 562, forwardly biased by a bolt spring 268. Bolt 562 is moveable rearwardly to an "open" position where loading port 272 is opened for the introduction of a new projectile $PB_2$ into gun 500. Bolt 562 is then moveable forwardly to close loading port 272, to return the bolt 562 to a "closed" or "ready to fire" position, where the new projectile $PB_2$ has been moved into the firing chamber, i.e., immediately in front of the forward end $\mathbf{562}_F$ of bolt 562 when the bolt 562 is moved to the closed position. In the closed position, the gun 500 is substantially sealed against the loss of compressed gas outward through the loading port 272 during firing of the projectile.

Recock piston 503 has a rear contact bar which in this embodiment provides a recock piston connecting rod 503*P* for connection with bolt 562. Connecting rod 503*P* extends upward into and through intercavity web slot 509*S*. With connecting rod 503*P* in place, the bolt 562 and the recock piston 503 are to constrained to move together. Thus, when recock piston 503 moves rearward, the connecting rod 503*P* urges bolt 562 rearward. When bolt 562 moves forward in response to the urging of bolt spring 268, bolt 562 urges the recock piston 503 forward.

In this embodiment, the recock piston 503 is provided having a rear contact face $\mathbf{503}_{RC}$ (see in FIG. 5A) that provides a contact face for direct engagement with the impacter 502 contact face 502*C*. The impacter body section 502*B* fits slidably within recock piston bore $\mathbf{503}_U$. When recock piston 503 moves rearward, piston rear contact face $\mathbf{503}_{RC}$ engages and moves impacter 502 rearward. Thus impacter 502 is responsive to rearward movement of recock piston 503.

Figure 6:
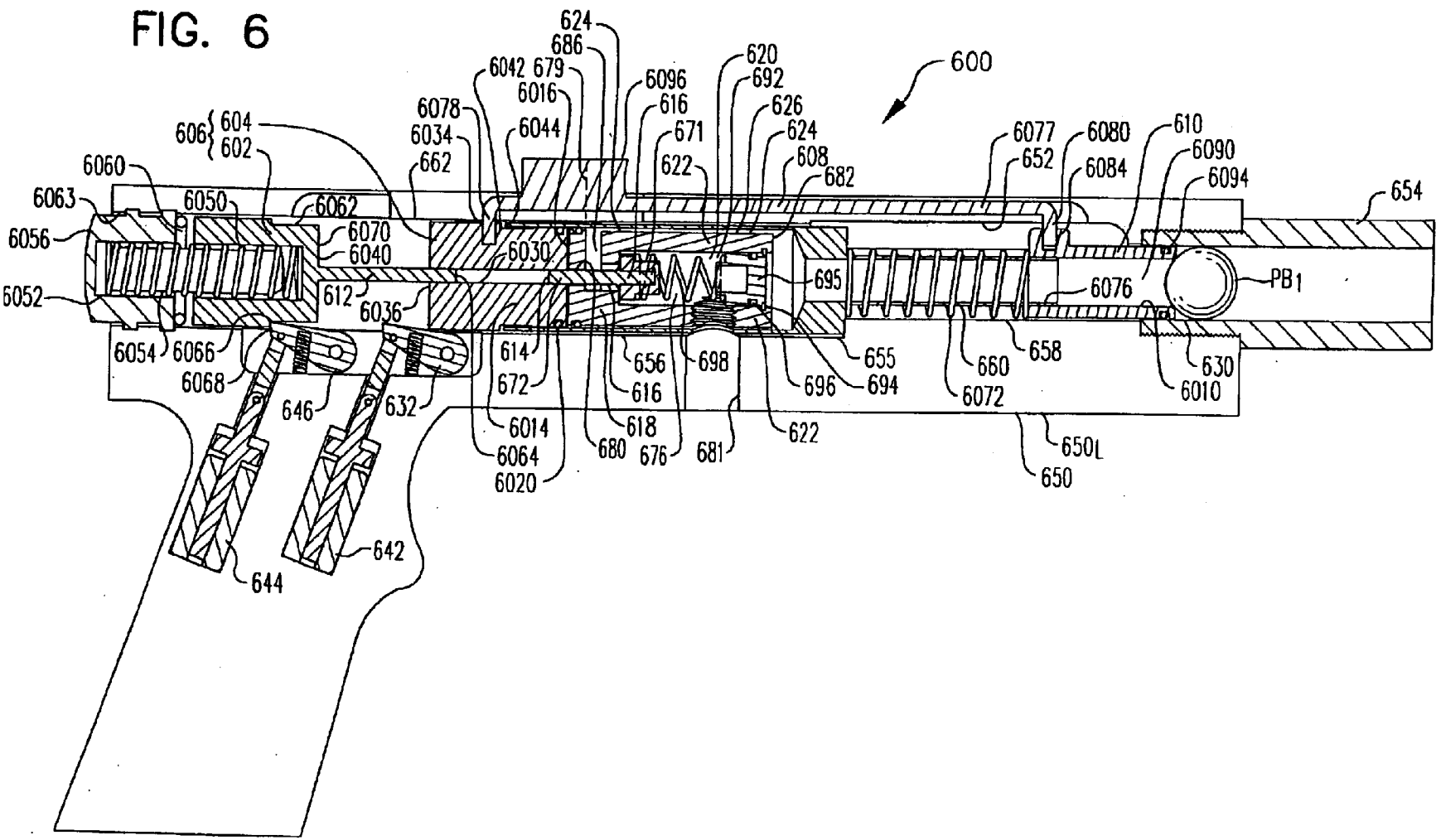
FIG. 6 illustrates in cross-sectional view the novel use of separate impacter and recock piston in a single cavity pneumatic gun, showing (1) the use of an impacter that is directly engaged by the recock piston during recocking, and (2) the use of a mechanical link between the recock piston and a bolt, (3) the use of a nose portion on the impacter to impact an impact receiving face on a valve stem, to open the gas valve, and (4) the use of a gas reservoir in the valve body for accumulation of gas prior before passage through the valve body toward the recock piston, as well as a passageway along a forward portion of the valve body toward the bolt for passage of gas toward the projectile to be fired.
Figure 7:
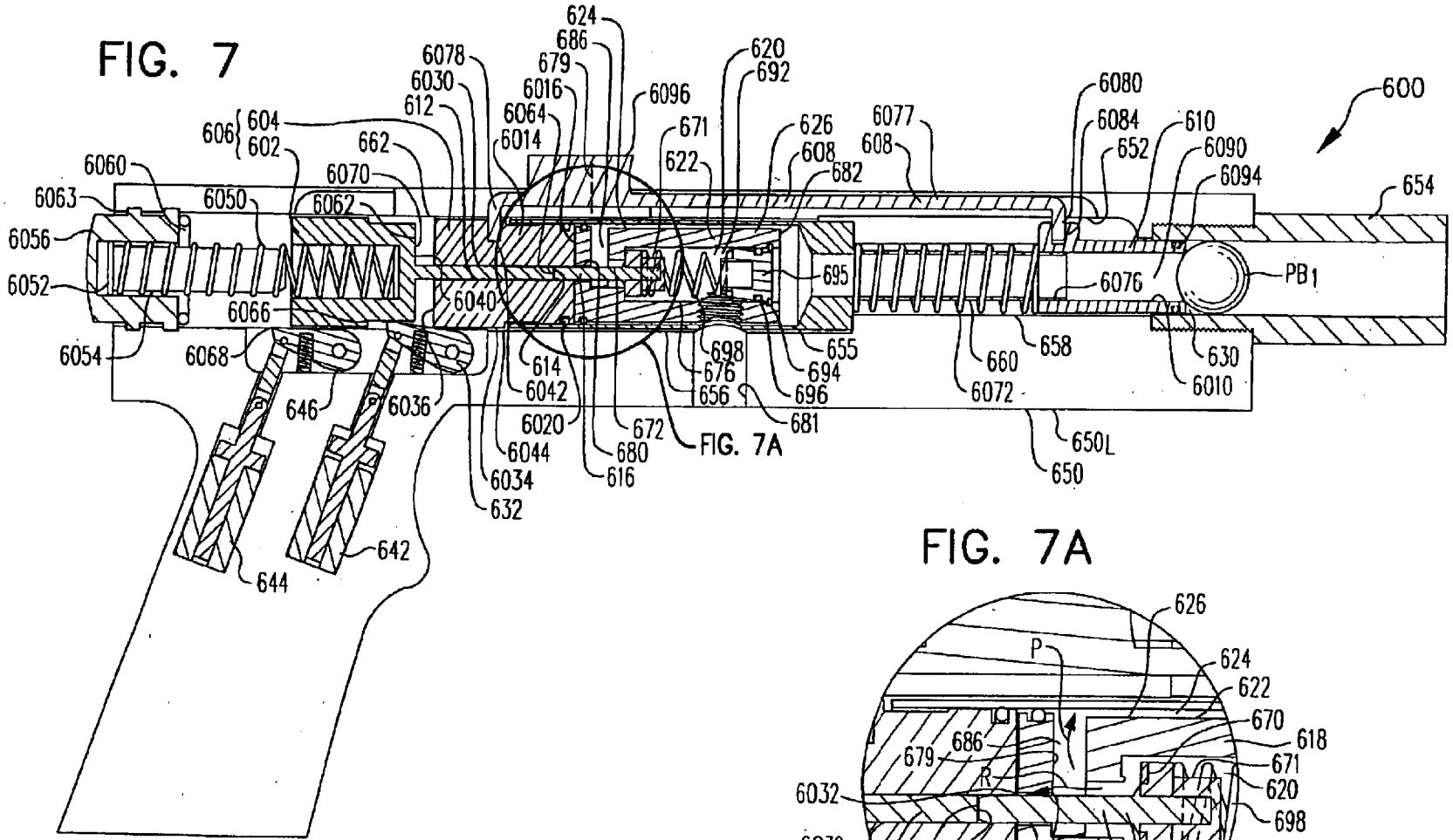
FIG. 7 illustrates in cross-sectional view the novel use of separate impacter and recock piston in a single cavity pneumatic gun, illustrating the beginning of the firing sequence, where the impacter has been released by the impacter sear, and the impacter nose has just opened the gas valve to release compressed gas but the released gas has not yet caused the projectile or the recock piston to move.
Figure 8:
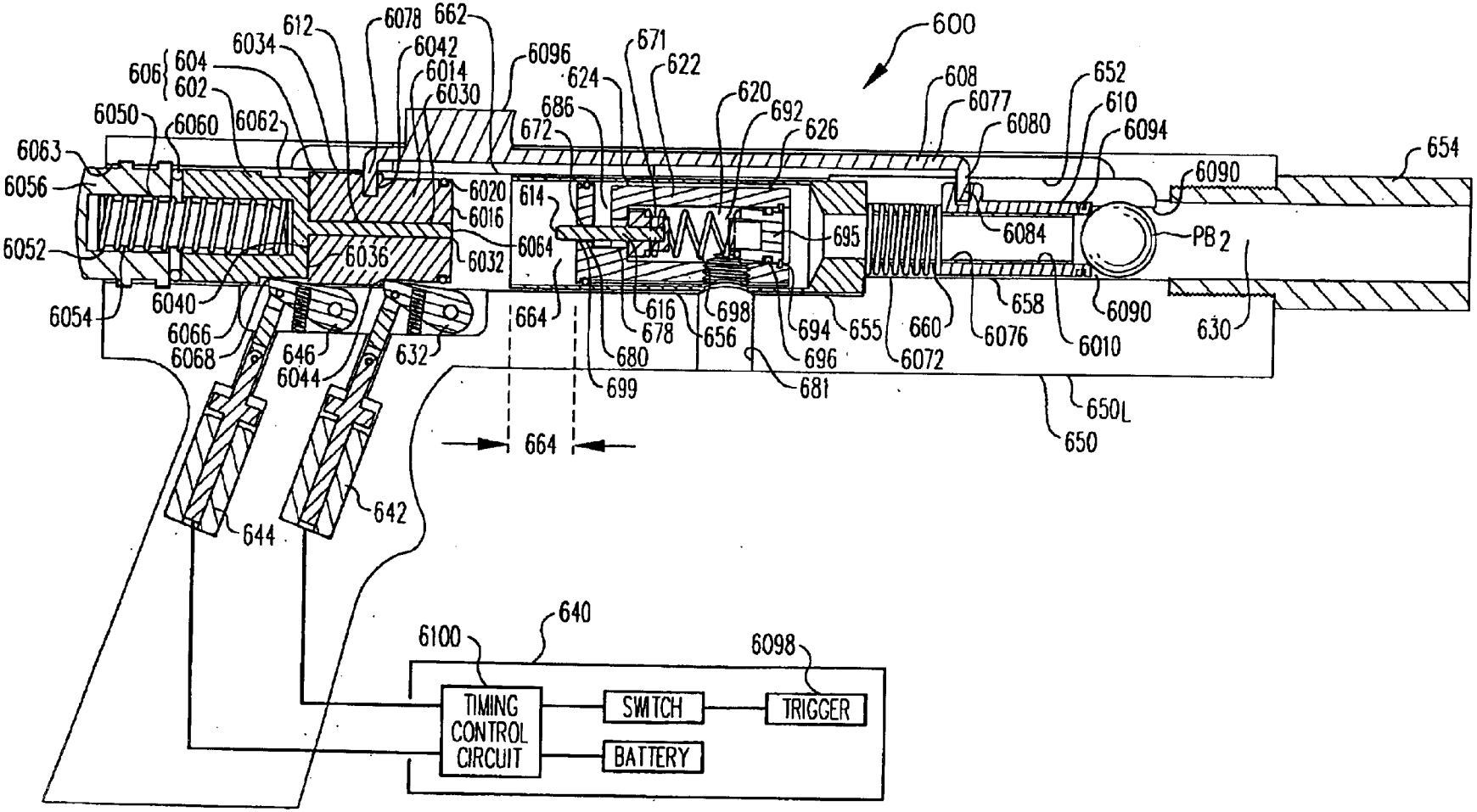
FIG. 8 illustrates in cross-sectional view the novel use of separate impacter and recock piston in a single cavity pneumatic gun, illustrating the recock piston held in the rearward position by the recock piston sear so that the mechanical link to the bolt holds the bolt open for loading of a new paintball.

Attention is now directed to FIGS. 6, 7 and 8, where one embodiment of a semiautomatic pneumatic gun 600 configured for firing paintballs is shown. FIG. 6 shows in cross-sectional view a gun 600 cocked and ready to fire, illustrating the novel use of separate impacter 602 and recock piston 604 in a single cavity pneumatic gun 600. More particularly, this embodiment shows the possible use of many advantageous features, including (1) the use of an impacter 602 that is directly engaged by the recock piston 604 during recocking, (2) the use of a connecting rod 608 as a direct mechanical link between the recock piston 604 and a bolt 610, (3) the use of an elongated nose portion 612 on the impactor 602 to impact an impact receiving face 614 on a valve stem assembly 616, to open the gas valve 618, (4) the use of a gas reservoir 620 within the valve body 622, and (5) a passageway 624 along an exterior forward portion 626 of the valve body 622 directed toward the bolt 610 for passage of a portion of the gas released by the valve 616 to travel toward the projectile $PB_1$ to be fired.

FIG. 7 illustrates in cross-sectional view the novel use of separate impacter 602 and recock piston 604 in a single cavity pneumatic gun 600. This figure shows the gun 600 partially through the firing process, with the impacter 602 forward in the valve opening position, the valve 618 open and starting to release compressed gas, a paintball $PB_1$ still in the firing chamber 630 and about to be propelled forward in response to portion of the released gas, and the recock piston 604 and bolt 610 not yet moved from their respective ready to fire positions.

FIG. 8 further illustrates in cross-sectional view the novel use of separate irnpacter 602 and recock piston 604 in a single cavity pneumatic gun 600. This figure shows recock piston 604 held (briefly) in the rearward bolt-open position by the recock piston sear 632, so that the connecting rod 608 operating as a mechanical link between the recock piston 604 and the bolt 610 also holds the bolt 610 in an open projectile loading position.

Generally, I have discovered that a novel, improved gun 600 can be developed utilizing the teachings herein to modify the design of prior art guns sold by Tippmann Pneumatics, Inc. of 3518 Adams Center Road, Fort Wayne, Ind. 46806 (http://www.tippmann.com), under the trademarks Model 98 and 98 Custom. In such a new, modified gun 600, a hammer assembly 606 is provided that includes an impacter 602 and a recock piston 604. An electronic trigger assembly 640 is separately provided, including a first recock piston solenoid 642 to control recock piston sear 632, and a second impacter solenoid 644 to control impacter sear 646. Physical control for the firing mechanism in this embodiment is provided by the impacter sear 646 and the recock piston sear 632.

Gun 600 has a clamshell type frame 650 having a left-hand half shell $\mathbf{650}_L$ and a right-hand half shell. As shown In FIGS. 6, 7 and 8, a right-hand half has been removed, and hence only the left hand half shell 650 is shown. Within frame 650 is a longitudinally extending cavity 652. Extending forward from cavity 652 is a barrel 654. Shown within barrel 654 in FIGS. 6 and 7 is a paintball $PB_1$.

Figure 7A:
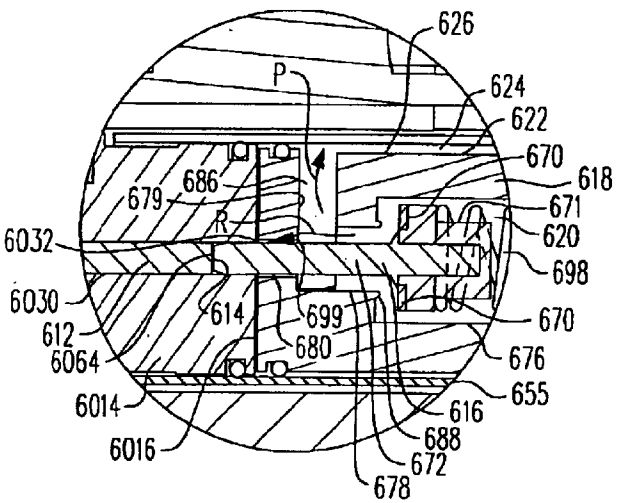
FIG. 7A illustrates in detail of the area marked "FIG. 7A" in FIG. 7, now illustrating in enlarged detail the use of a gas reservoir in the valve body for accumulation of gas before passage through the valve body toward the recock piston, as well as a passageway along a forward portion of the valve body toward the bolt for passage of gas toward the projectile to be fired.

Referring to FIG. 7, and to enlarged FIG. 7A, fixed within cavity 652 is a power tube 655 comprising (a) rearwardly, a valve housing portion 656, and (b) forwardly, a bolt guide portion 660 penetrated by a bolt guide bore 6076. Fixed within valve housing portion 656 is a normally-closed, impact openable valve 618 having a valve body 622 and a valve stem assembly 616. Extending rearward from valve body 622 is a recock chamber portion 662 of gun cavity 652. A sealable portion 664 (see FIG. 8) of recock chamber 662 is provided, rearward of which gas may escape.

Valve stem assembly 616 comprises a rearwardly-directed resilient valve seal 670. Forward of valve seal 670 is a valve spring boss 671. Rearward of valve seal 670 is a valve pin portion 672 of valve stem assembly 616, ending in a rearwardly-directed impact-receiving face 614 adapted to receive an impact as gun 600 is fired. Upon firing, valve 618 momentarily opens to release compressed gas. Valve body 622 is generally cylindrical, and is rearwardly penetrated coaxially by a front bore 676, an intermediate bore 678, and a rear bore 680 of successively smaller diameter. Rear bore 680 passes completely through valve body 622. The transition between rear bore 680 and intermediate bore 678 defines a bore transition plane 679. Extending forward from bore transition plane 679 to the front end 682 of valve body 622 is a propulsion gas passageway 624 on exterior 626 of valve body 622. A transverse passageway 686 extends inward from passageway 624 to connect with intermediate bore 678. Thus transverse passageway 686 and passageway 624 provide fluid communication between valve intermediate bore 678 and bolt guide bore 6076.

The transition from front bore 676 to intermediate bore 678 provides a valve seat 688 of annular form sealingly engageable by valve seal 670. Front bore 676 provides a gas reservoir 620 configured to receive compressed gas from an external source (not shown) via a gas inlet 681. Captured within and sealing the front end 692 of gas reservoir 620 by an internal snap ring 694 is a reservoir plug 695 with an external o-ring 696.

A valve spring 698 between valve spring boss 671 and reservoir plug 695 serves to urge valve seal 670 rearward to engage valve seat 688. Valve seal 670 and valve seat 688 cooperate to control the release of compressed gas from gas reservoir 620.

Valve pin portion 672 of valve stem assembly 616 fits slidingly within and is of appreciably smaller diameter than valve body rear bore 680, thereby providing a gap to function as a recock gas passageway 699 through and within a portion of rear bore 680. When valve 618 is open, gas flows into intermediate bore 678. One portion of the compressed gas flows through a portion of rear to bore 680, i.e. through the recock gas passageway 699, and into the sealable portion 664 of the recock chamber 662, as is illustrated by the reference arrow R in FIG. 7A. Transverse passageway 686 and gas passageway 624 provide passage for the remaining portion of the compressed gas released to flow forward Into bolt guide bore 6076 as is illustrated by the reference arrow labeled P in FIG. 7A. Thus, recock gas porting includes intermediate bore 678 and that portion of rear bore 680 that functions as recock gas passageway 699. Propulsion gas porting comprises intermediate bore 678, transverse passageway 686, passageway 624, bolt guide bore 6076, and a bolt bore 6010.

Recock piston 604 is slidably translatable within recock chamber 662. Recock piston 604 has a body section 6014 with a forwardly directed face 6016 slidable within sealable portion 664 of recock chamber 662. Recock piston 604 is sufficiently responsive to force exerted by gas released by valve 618 and provided to sealable portion 664 of recock chamber 662 to recock gun 600. In this embodiment recock piston body 6014 has an exterior o-ring 6020. In this embodiment, recock piston 604 is fully penetrated by a longitudinal passageway 6030. The transition between the forwardly directed face 6016 and longitudinal passageway 6030 defines a momentum transfer portal 6032.

Rearward of recock piston body section 6014 is a rear section 6034 of larger diameter than body section 6014. Rear section 6034 of recock piston 604 terminates rearwardly in a rear section face 6036 which in this embodiment provides a piston contact face impingeable on impacter contact face 6040 for the purpose of imparting rearward. motion of recock piston 604 to impacter 602. Thus impacter 602 is responsive to rearward movement of recock piston 604. Penetrating rear section 6034 is a connecting rod recess 6042. Rear section 6034 terminates forwardly in a rear section shoulder 6044. As shown, rear section shoulder 6044 provides a piston sear engagement shoulder.

Recock piston 604 is translatable between a forward ready-to-fire position (shown in FIGS. 6 and 7) and a rearward bolt-open, impacter cocking, piston-sear engaged position (shown in FIG. 8). In the recock piston sear engaged position, impacter 602 is held just rearward of the impacter cocked position.

Impacter 602 is slidably translatable within recock chamber 662 and is forwardly biased therein by an impacter power spring 6050 captive between impacter 602 and a forwardly facing shoulder 6052 of a spring guide 6054. Spring guide 6054 rests against a rear plug 6056 captive at the rear 6063 of cavity 652. Impacter 602 is slidable from a cocked position to a forward valve opening position. Forward of rear plug 6056 is a resilient impacter buffer 6060 serving to absorb any excess force as impacter 602 moves rearward.

Impacter 602 has a body section 6062 of transverse cross-section larger than the transverse size and shape of momentum transfer portal 6032. In this embodiment, impacter 602. nose portion 612 fits slidably within longitudinal passageway 6030 in recock piston 604. Impacter 602 nose portion 612 terminates forwardly in an impact imparting face 6064.

On impacter body section 6062 is a forwardly-directed impacter sear shoulder 6066, engageable on sear edge 6068 of trigger-controlled impacter sear 646 that serves to restrain impacter 602 rearward in the cocked position (shown in FIG. 6) when gun 600 is ready to fire. Body section 6062 terminates forwardly in a body shoulder 6070 that in this embodiment provides an impacter contact face 6040.

Slidably translatable within bolt chamber portion 658 of gun cavity 652 is a bolt 610. Bolt 610 is slidable within bolt chamber 658 between a forward bolt closed, ready-to-fire position and an open bolt position which allows the introduction of a projectile. Bolt 610 is forwardly biased by a bolt spring 6072. Penetrating bolt 610 longitudinally is a bolt bore 6010. Bolt bore 6010 slidably surrounds and is substantially sealed by bolt guide portion 660 of power tube 655. Slidable within gun frame 650 is a longitudinally extending connecting rod 608 which has an elongated generally U-shaped link-like member having an extended body portion 6077 and a relatively short (a) first end member 6078 and (b) second end member 6080. Connecting rod first end member 6078 fits within connecting rod recess 6042 in recock piston 604. Second end member 6080 fits within a bolt connecting rod recess 6084 in bolt 610, thereby constraining bolt 610 to translate in concert with recock piston 604. Hence, when recock piston 604 moves rearward to the bolt open position, bolt 610 also moves rearward, serving thereby to open a loading port for the introduction of a new projectile $PB_2$ (shown in FIG. 8) into a gun breech 6090 in bolt chamber 658. (Loading port is of conventional construction and can be readily provided by those skilled in the art and to whom this specification is addressed. However, since loading port is on the right-hand side of gun 600, it is not visible in FIGS. 6, 7, or 8.)

When bolt 610 moves forward in response to the urging of bolt spring 6072, recock piston 604 also moves forward to the ready-to-fire position as is shown in FIG. 6. Also, the forward motion of bolt 610 closes loading port and moves a new projectile $PB_2$ from breech 6090 forward into a gun firing chamber 630. in this embodiment firing chamber 630 is further sealed by an exterior o-ring 6094 on bolt 610.

Fixed on connecting rod 608 and extending outward through gun frame 650 is a cocking handle 6096 graspable by a gun user for the purpose of moving recock piston 604, bolt 610, and impacter 602 rearward when cocking the gun manually.

When trigger 6098 is actuated by a gun user, impacter solenoid 644 is activated briefly, moving impacter sear 646 down briefly and releasing impacter 602 to move from the impacter-cocked position shown in FIG. 6.to the impacting, valve opening position shown in FIG. 7.

During recocking, the recock piston 604 moves impacter 602 rearward until the recock piston 604 reaches the open bolt position illustrated in FIG. 8, with the result that the impacter 602 is now slightly rearward of the impacter-cocked position. With the recock piston 604. now in this rearward position, the bolt 610 is also rearward in the bolt open position, allowing the next paintball $PB_2$ in sequence to load to pass through the open gun loading port and into the gun breech 6090 shown in FIG. 8.

At an interval of time after the impacter solenoid 644 was energized predetermined to provide sufficient time for paintball $PB_2$ to have loaded into breech 6090, the timing control circuit 6100 briefly activates recock piston solenoid 642, moving recock piston sear 632 down briefly and releasing recock piston 604 to return forward with bolt 610 to the ready-to-fire position. Recock piston sear 632 and associated elements are thus seen to provide additional time for paintballs to be loaded into gun 600.

Figures 9, 9A:
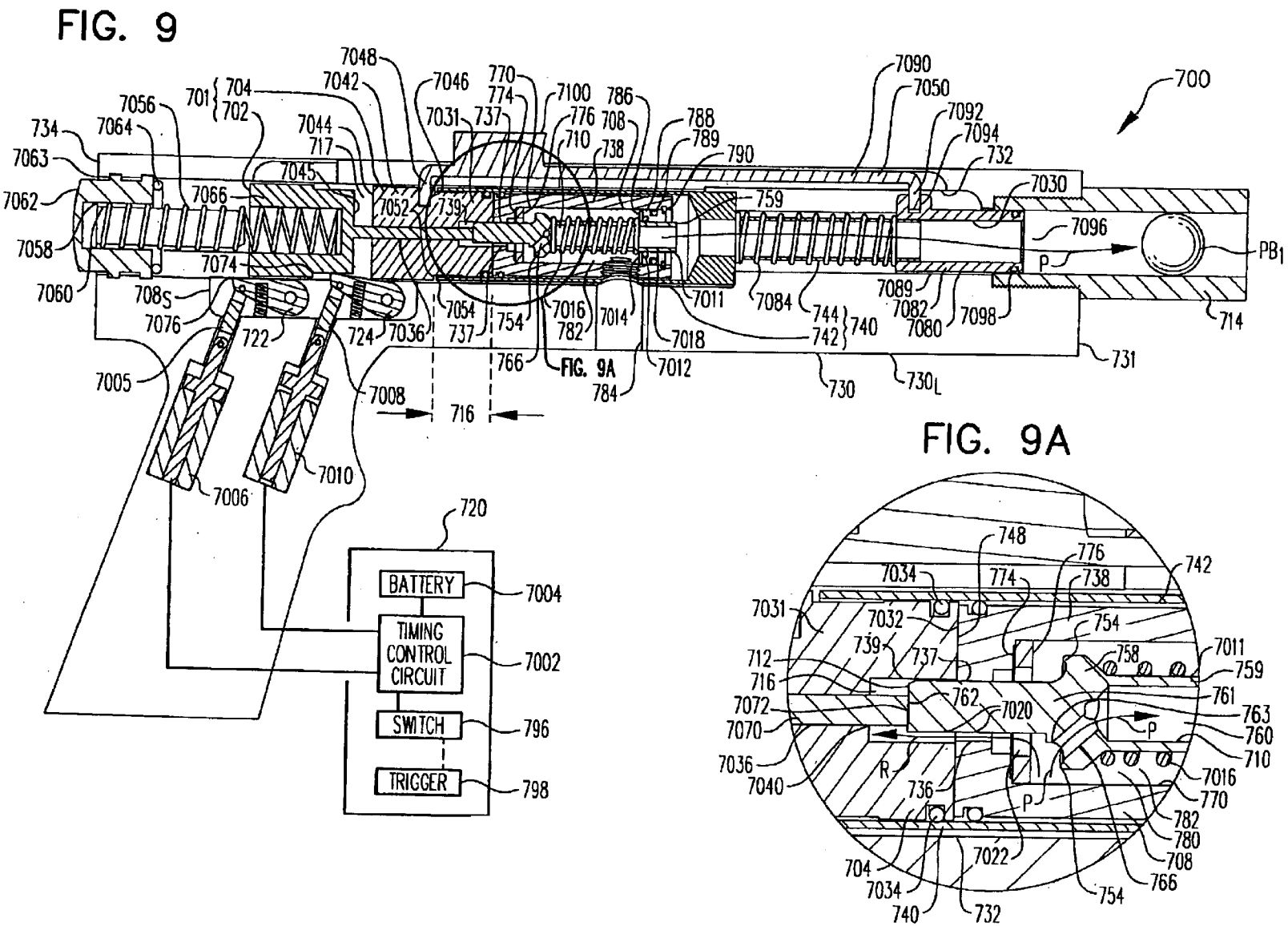
FIG. 9 illustrates in cross-sectional view the novel use of a separate impacter and recock piston in a single chamber pneumatic gun, similar to the guns just illustrated in FIGS. 6, 7, and 8 above, but now showing a valve having a passageway in and along the valve stem for passage of gas for recocking; here, the gun is shown at the initiation of firing, where the valve has opened to discharge compressed gas to start the projectile out of the barrel, but wherein the recock piston has not yet started rearward toward the recocking position.
FIG. 9A illustrates in detail the area marked "FIG. 9A" in FIG. 9, no illustrating in enlarged detail the use of a passageway in and alongside of valve stem for passage of recock gas through the valve body toward the recock piston.

Another embodiment of a novel semiautomatic pneumatic gun 700 is depicted in FIGS. 9 and 9A, configured for firing paintballs. Gun 700 is derived by applying the teachings herein to a prior art gun design sold by Brass Eagle, Inc. P. O. Box 1956, Rogers, Arizona, 72757 under the trademark Stingray and Stingray II, some portions of which are described in U.S. Pat. No. 5,634,456 issued to Perrone on Jun. 3, 1997. FIG. 9 illustrates in cross-sectional view the novel use of a separate impacter 702 and recock piston 704 in a single cavity pneumatic gun 700, similar to the gun 600 just illustrated in FIGS. 6, 7, and 8 above, but now showing use of a valve 708 having a passageway 710 within the valve stem 712 for passage of gas for propulsion. Here, the gun 700 is shown at the initiation of firing, where the valve 708 has opened to release gas to start the projectile $PB_1$ out of the barrel 714, and to introduce gas into the sealable portion 716 of the recock chamber 717, but wherein the recock piston 704 has not yet started moving rearward, i.e., from the ready to fire position toward the recocking position.

Incorporated into gun 700 is a hammer assembly 701 provided according to the present invention comprising, separately, an impacter 702 and a recock piston 704. An electronic trigger assembly 720 is provided, including for actuation by the electronic trigger assembly components an impacter sear 722 and a recock piston sear 724.

Gun 700 has a clamshell type frame 730 having a front end 731 and a rear end 734. Frame 730 has a left-hand half $730_L$ and a right-hand half. In FIG. 9 right-hand half has been removed and hence is not shown. Within frame 730 is a longitudinally extending cavity 732. Extending forward from cavity 732 is a barrel 714. Shown moving forward within barrel 714 as a result of gun 700 just having been fired is a paintball $PB_1$.

FIG. 9A illustrates in detail the area marked "FIG. 9A" in FIG. 9, now illustrating in enlarged detail the use of a passageway 736 within rear bore 737 alongside of the valve stem 712 for passage of recock gas through the rear bore 737 in valve body 738, as the recock gas moves toward the forward recess 739 in recock piston 704. Also, a passageway 710 within valve stem 712 provides for the passage of propulsion as as indicated by arrow P in FIG. 9A.

Referring to FIG. 9, and to enlarged FIG. 9A, fixed within cavity 732 is a power tube 740 comprising (a) rearwardly, a valve housing portion 742, and (b), forwardly, a bolt guide portion 744. Fixed within valve housing portion 742 is body 738 of valve 708. Valve body 738 has a rearwardly directed face 748. Extending rearward from rearwardly directed face 748 of valve body 738 is a recock chamber portion 717 of gun cavity 732.

The valve stem 712 includes a rearwardly-directed valve sealing engagement annulus 754 providing a rearwardly directed seal on valve sealing body 758. Extending forward from valve sealing body 758 is a valve tube 759 containing a valve tube passageway 710 defined by interior sidewalls 760. Extending rearward from valve sealing body 758 is a solid valve pin 761 that terminates rearwardly in an impact receiving face 762. Spaced radially inward of the sealing engagement annulus 754, and spaced radially outward of valve pin 761 are inlets 763 for a plurality of propulsion gas passageways 766 penetrating valve sealing body 758 forwardly to fluidly connect with valve tube passageway 710. Commonly three or four propulsion gas passageways 766 are provided through valve sealing body 758.

Valve body 738 is generally cylindrical. Valve body 738 has a rearwardly directed face 748. Valve body 738 is penetrated coaxially by a front bore 770 and by a rear bore 737. Front bore 770 is of larger diameter than rear bore 737, and thereby provides a forwardly-directed shoulder 774 that supports a resilient valve seat 776 of annular form sealingly engageable by valve seat engagement annulus 754.

The interior sidewalls 780 of front bore 770 define sidewalls of a gas reservoir 782 configured to receive compressed gas from an external source (not shown) via a gas inlet 784. Captured within and sealing the forward end 786 of gas reservoir 782 is a reservoir plug 788, sealed at wall 780 via o-ring 789. An internal snap ring 790 retains reservoir plug 788 in place within valve body 738.

In this embodiment, an electronic trigger assembly 720 is provided on gun 700. The trigger assembly 720 includes a firing switch 796, a user-actuable trigger 798, an electronic timing control circuit 7002 powered by a battery 7004, an impacter sear 722 connected by an impacter sear link 7005 to an impacter sear solenoid 7006, and a piston sear 724 connected by a piston sear link 7008 to a piston sear solenoid 7010. Firing switch 796 is positioned to be actuated by trigger 798. Sears 722 and 724 penetrate through sear slot 708S and are constantly spring biased upward. Impacter solenoid 7006, when energized by a timing control circuit 7002, moves impacter sear 722 downward, out of a position of engagement with impacter sear shoulder 7074. Recock piston solenoid 7010, when energized by timing control circuit 7002. moves recock piston sear 724 downward, out of a position of engagement with recock piston sear shoulder 7054. When trigger 798 is actuated by the gun user, timing control circuit 7002 energizes impacter sear solenoid 7006 and recock piston solenoid 7010 in a predetermined firing sequence.

The outer surface 7011 of the tube 759 defining valve tube passageway portion 710 of valve stem 712 fits slidingly within reservoir plug bore 7018, and is sealed therein by a tube o-ring 7012. Surrounding tube surface 7011, rearward of o-ring 7012. is a tube washer 7014. A valve spring 7016 between valve sealing body 758 and tube washer 7014 serves to urge washer 7014 and o-ring 7012 forward against reservoir plug 788, thereby sealing reservoir plug bore 7018. Valve spring 7016 also urges sealing engagement annulus 754 rearward to engage resilient valve seat 776. Valve seal engagement annulus 754 and resilient valve seat 776 cooperate to control the release of compressed gas from gas reservoir 782.

Solid valve pin 761 fits slidingly within rear bore 737. On valve pin 761 in this embodiment is a recock gas passage flat 7020, which provides space for a recock gas passageway 736 within rear bore 737. Thus, recock gas porting includes, in succession, (a) valve seat 776 passageway 7022, and (b) the recock gas passageway 736 along flat 7020 and within rear bore 737; this recock gas porting provides for passage into recock chamber 717 for one portion of the compressed gas released when valve 708 is opened, as is illustrated by the arrow R in FIG. 9A.

The propulsion gas porting includes, in succession propulsion gas passageways 766, valve tube bore 710, bolt guide portion 744, and bolt gas passageway 7030 (discussed below). The propulsion gas porting provides for fluid passage of the compressed gas released from gas reservoir 782 to propel a projectile $PB_1$, as is illustrated by the arrow labeled P in FIG. 9A.

Recock piston 704 is slidably translatable within recock chamber 717. Recock piston 704 has a recock piston body 7031 with a forwardly directed front face 7032 slidable within recock chamber sealable portion 716. Recock piston 704 is sufficiently responsive to force exerted by gas released by valve 708 and provided to sealable portion 716 of recock chamber 717 to recock gun 700. Forwardly directed face 7032 includes a centrally located clearance recess 739. In this embodiment recock piston body 7031 has an exterior o-ring 7034. Also, recock piston 704 is fully penetrated by a longitudinal passageway 7036. The transition between the forwardly directed front face 7032 and longitudinal passageway 7036 defines a momentum transfer portal 7040.

Rearward of the recock piston body 7031 is a rear section 7042 of the recock piston 704; the rear section 7042 has a larger diameter than the body portion 7031, and terminates rearwardly in a rear face 7044; in this embodiment rear face 7044 provides a recock piston contact face that is impingeable on impacter contact face 7045 for the purpose of transferring the rearward motion of recock piston 704 to impacter 702. Thus impacter 702 is responsive to rearward movement of recock piston 704. In the upper reaches of recock piston 704, a recess 7046 is provided to accept a first end 7048 of connecting rod 7050. Rear section 7042 of recock piston 704 terminates forwardly in a rear section shoulder 7052 that provides a piston sear engagement shoulder 7054. The recock piston 704 is translatable between a forward ready-to-fire position and a rearward bolt-open, impacter cocking, recock piston sear 724 engaged position (not shown in FIG. 9). In the piston-sear engaged position, impacter 702 is held just rearward of the impacter cocked position.

Impacter 702 is slidably translatable within recock chamber 717 and is forwardly biased therein by an impacter power spring 7056 captive between impacter 702 and a forwardly facing shoulder 7058 of a spring guide 7060. Spring guide 7060 rests against a rear plug 7062 captive at the rear 7063 of cavity 732. Impacter 702 is slidable from a cocked position to a forward valve opening position. Forward of rear plug 7062 is a resilient impacter buffer 7064 serving to absorb any excess force as impacter 702 moves rearward. The impacter 702 has a main body section 7066 that is larger in transverse cross section than the transverse cross section of the momentum transfer portal 7040. As shown in the embodiment provided in FIG. 9, an elongated nose portion 7070 is provided on impacter 702. The nose portion 7070 fits slidably within longitudinal passageway 7036. Impacter elongated nose portion 7070 terminates forwardly in an impact imparting face 7072.

On impacter main body section 7066 is a forwardly-directed impacter sear shoulder 7074, engageable on sear edge 7076 of trigger-controlled impacter sear 722 that serves to restrain impacter 702 rearward in the cocked position (not shown in FIG. 9) when gun 700 is ready to fire.

Slidably translatable within a bolt chamber 7080 in gun cavity 732 is a bolt 7082. Bolt 7082 is slidable within bolt chamber 7080 between a forward bolt closed, ready-to-fire position and an open bolt position which allows the introduction of a projectile. Bolt 7082 is forwardly biased by a bolt spring 7084. Penetrating bolt 7082 longitudinally is a bolt bore 7030. Bolt bore 7030 slidably surrounds and is substantially sealed by bolt guide portion 744.

Slidable within gun frame 730 is a longitudinally extending connecting rod 7050 comprising an elongated generally U-shaped link-like member having an extended body portion 7090 and a relatively short first end member 7048 and short second end member 7092. Connecting rod first end member 7048 fits within connecting rod recess 7046 in recock piston 704. Second end member 7092 fits within a bolt connecting rod recess 7094 in bolt 7082, thereby to constraining bolt 7082 to translate in concert with recock piston 704. Hence, when recock piston 704 moves rearward to the recock piston sear engaged position, bolt 7082 also moves rearward, serving thereby to open a loading port for the introduction of a new projectile into gun breech 7089 in bolt chamber 7080. (Loading port is on the right-hand side of gun 700, and hence is not visible in FIG. 9.) When bolt 7082 moves forward in response to the urging of bolt spring 7084, recock piston 704 also moves forward to the ready-to-fire position as shown in FIG. 9. Also, the forward motion of bolt 7082 closes the loading port and moves the new projectile in the breech 7089 forward into a gun firing chamber 7096. In this embodiment firing chamber 7096 is further sealed by an exterior o-ring 7098 on bolt 7082.

Fixed on connecting rod 7050 and extending outward through gun frame 730 is a cocking handle 7100 graspable by a gun user for the purpose of moving recock piston 704, bolt 7082, and impacter 702 rearward when cocking the gun 700 manually.

In general, with the exception of the routing of the propulsion gas through the propulsion gas porting as just described above in connection with gun 700, the operation of gun 700 is analogous to the operation of gun 600 in FIGS. 6, 7 and 8, and should be considered in light thereof.

Figure 10:
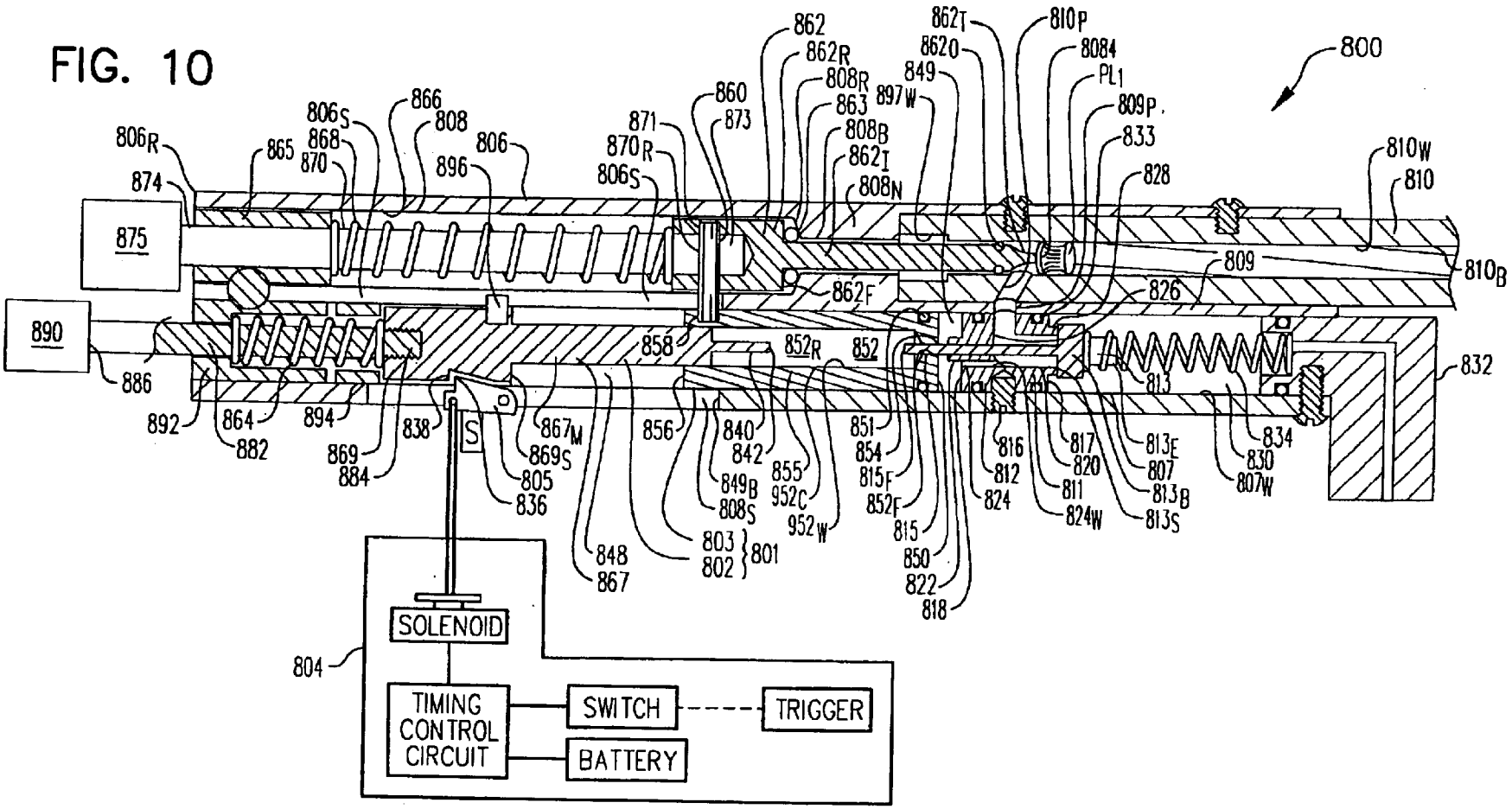
FIG. 10 illustrates the novel use of a separate impacter and recock piston in a pellet gun, here showing an impacter having a long nose portion that impacts a face on the valve stem to open the gas valve, and a recock piston that is attached to the bolt via a connector.

Referring to FIGS. 10 and It, one embodiment of a semiautomatic pneumatic gun 800 adapted for firing of projectiles by use of compressed gas as a propellant and configured for firing metallic pellets is shown. Incorporated into gun 800 is a hammer assembly 801 comprising an impacter 802 and a recock piston 803. Gun 800 also comprises an electronic trigger assembly 804 including an impacter sear 805.

Gun 800 has a frame 806 containing a longitudinally extending lower cavity 807 and upper cavity 808, separated by an intercavity web 809. Web 809 is penetrated by an intercavity gas passageway 809*P*. Extending forward from rear end $\mathbf{806}_R$ of gun frame 806 is an intercavity web slot 806*S*. Extending downward though frame 806 from lower cavity 807 is a sear slot 808*S*. Within upper cavity 808 in this embodiment is an internal cavity intrusion $\mathbf{808}_N$ having an internal cavity intrusion bore $\mathbf{808}_B$ and providing a rearwardly directed cavity intrusion shoulder $\mathbf{808}_R$.

Extending forward from upper cavity 808 is a barrel 810 having an internal barrel bore $\mathbf{810}_B$ coaxial with cavity intrusion bore $\mathbf{808}_B$ and sized to accommodate metallic pellets of the caliber for which the gun is adapted. A barrel gas passageway 810*P* penetrates barrel 810 in this embodiment to provide fluid communication from intercavity gas passageway 809*P* to a barrel bore $\mathbf{810}_B$ defined by internal bore wall 810*W*. A firing chamber 8084 is provided in this embodiment within barrel bore $\mathbf{810}_B$. The firing chamber 8084 is forward of barrel gas passageway 810*P*, and contains in FIG. 10 a pellet $PL_1$ in position to be propelled from gun 800.

Referring further to FIG. 10, located within lower cavity 807 is a normally-closed impact-openable valve 811. Valve 811 has a valve body 812 and a valve stem 813. Valve stem 813 includes a seal body $\mathbf{813}_B$ having a rearwardly-directed resilient valve seal 813*S* and a rearwardly extending valve pin portion 815 ending rearwardly in an impact receiving face $\mathbf{815}_F$. Extending forward on valve seal body $\mathbf{813}_B$, is an optional valve spring boss $\mathbf{813}_E$. In this embodiment, valve pin 815 is of smaller diameter than valve seal 813*S*. Valve body 812 is fixed (by means such as set screw 816) within lower cavity 807. Valve body 812 has a front face 817 and a rearwardly directed face 818. Valve body 812 is partially penetrated from the front face 817 by an intermediate bore 820. Valve body 812 is completely penetrated longitudinally by a rear bore 822, which in this embodiment is coaxial with intermediate bore 820. Valve pin 815 fits slidingly within and, in this embodiment, substantially seals rear bore 822 in valve body 812.

In this embodiment, valve body 812 is penetrated from rearwardly directed face 818 by a second rear bore passageway 824 (i.e., the recock gas passageway defined by interior sidewalls 824*W*) in communication with intermediate bore 820. An upper passageway 826 extends upward from intermediate bore 820 to communicate with intercavity gas passageway 809*P*. Thus, upper passageway 826 and intercavity gas passageway 809*P* provide fluid communication between intermediate bore 820 and upper cavity 808, for the supply of propulsion gas to accelerate the pellet being fired.

On the front face 817 of valve body 812 is a valve seat 828, annular in shape in this embodiment. The seat 828 is sealingly engageable by valve seal $\mathbf{813}_S$ of valve stem 813; these elements cooperate to control the release of compressed gas from a gas reservoir 830 in lower cavity 807 formed between valve body 812 and a reservoir plug 832. Between valve seal body 813*B* and reservoir plug 832 is a valve spring 834 which serves to urge valve seal 813*S* against valve seat 828.

For sealing purposes, an exterior o-ring 833 is provided to seal valve body 812 against lower cavity 807 walls 807*W*. The gas reservoir 830 is configured to receive compressed gas from an external source. Recock gas porting providing fluid communication from valve 811 to recock chamber 848 includes intermediate gas bore 820 and second rear bore 824. Propulsion gas porting includes intermediate bore 820, upper passageway 826, intercavity gas passageway 809*P*, and barrel gas passageway 810*P*.

A recock chamber 848 portion of lower cavity 807 extends rearwardly from rearwardly directed face 818 of valve body 812. A sealable portion 849 of recock chamber 848 extends rearward from rearwardly directed face 818 of valve body 812 to a seal break $\mathbf{849}_B$ at sear slot 808*S* in frame 806. At the slot 808*S*, the compressed gas that was originally provided to recock chamber 848 (through second rear bore passageway 824 defined by walls 824*W*) is able to escape through the frame 806, thus relieving pressure in the sealable portion 849 of the recock chamber 848. Valve 811, recock gas porting and propulsion gas porting described herein can alternately be provided in various structural equivalents and equivalent structural configurations as known or as may feasibly be developed by those of ordinary skill in the art and to whom this specification is addressed. Hence, the specific valve, valve body, recock gas porting, and propulsion gas porting structures shown in this or other embodiments illustrated are for purposes of illustration, and should not be interpreted as limiting the present invention to any specific embodiment, whether herein illustrated or otherwise, Recock piston 803 is slidably translatable within recock chamber 848 between a forward ready-to-fire position (shown in FIG. 10) and a rearward impacter cocking position (not shown for this embodiment), and is forwardly biased therein by bolt 862. Referring further to FIG. 10, recock piston 803 has a forwardly directed piston front face 850 slidable within sealable portion 849 of the recock chamber 848 for receiving the urging of the compressed gas provided to recock chamber 848. Recock piston 803 is sufficiently responsive to force exerted by gas released by valve 811 and provided to sealable portion 849 of recock chamber 848 to recock gun 800,and in this embodiment recock piston 803 has a resilient o-ring seal 851 external and slightly rearward of piston front face 850.

Recock piston 803 is, in the present embodiment, fully penetrated by an axially centered longitudinal passageway 852 comprising a front portion $\mathbf{852}_F$ and a rear impacter receiving portion $\mathbf{852}_R$. Impactor receiving portion $\mathbf{852}_R$ comprises, rearward of piston front face 850, an interior sidewall 852*W* defining a cavity 852*C* sized and shaped to receive, in interfitting sliding engagement, middle portion $\mathbf{867}_M$ of impacter 802. Front portion $\mathbf{852}_F$ has a cross-section complementary in size and shape, and only slightly larger than, valve pin 815. The location of the transition between the forwardly directed piston face 850 and longitudinal passageway 852 defines a momentum transfer portal 854. The recock piston body 855 terminates rearwardly with at least a rear face 856 portion which in this embodiment provides a piston contact face engageable with impacter 802. In the upper reaches of recock piston 803 is a connecting rod recess 858 for receiving connecting rod 860 to connect the recock piston 803 to bolt 862.

Impacter 802 is slidably translatable within recock chamber 848. Impacter 802 is forwardly ,biased by an impacter power spring 864 captive between impacter 802 and a frame rear plug 892 captive at the rear $\mathbf{806}_R$ of gun frame 806. Impacter 802 translates between a rearward cocked position illustrated in FIG. 10, and a forward valve-opening position. In this embodiment, impacter 802 has a main body portion 867 which is situated rearward of transfer portal 854 and which is larger in cross section than transfer portal 854. Impacter 802 has a middle portion $\mathbf{867}_M$. In this embodiment impacter main body portion 867 is partially slidable within recock piston longitudinal passageway rear portion 852*P*. Main body portion 867 also comprises an enlarged rear portion 869 having a forwardly directed shoulder 869*S* which in this embodiment provides an impacter contact face.

Clearly, the recock piston 803 captures the impacter 802, as the impacter 802 is dimensioned so that it travels rearward with recock piston 803 when the recock piston 803 is energized to move rearward during recocking. Thus impacter 802 is responsive to rearward movement of recock piston 803. Also, as shown in this embodiment, impacter 802 has an elongated nose portion 840 terminating forwardly in an impact imparting face 842 that is smaller in cross-section than transfer portal 854.

Extending rearwardly through frame rear plug 892 is an impacter rod 882 having a front end 884 attached to impacter 802, and a rear end 886 attached to a user graspable impacter knob 890 that permits the gun user to move impacter 802 to the cocked position. Also between impacter 802 and rear plug 892 is an optional resilient impacter buffer 894.

The imparter 802 further comprises in this embodiment a registration pin 896 extending upward from the main body rear portion 869. Registration pin 896 is sized and shaped to slide within intercavity web slot 806*S*, thereby preventing impacter 802 from rolling about its longitudinal axis.

Impacter 802 is retained in the cocked position by sear edge 836 of sear 805 engaging a forwardly directed sear shoulder 838 on impacter 802. When impacter 802 is released from the cocked position, it travels forward in response to the urging of impacter power spring 864 until impact is made, directly or indirectly, with valve stem 813. As FIG. 10 illustrates, impact imparting face 842 of impacter nose portion 840 is located, sized and shaped to impact on the impact receiving face $\mathbf{815}_F$ of valve pin portion 815. The forward momentum of impacter 802 is thereby transferred through recock piston transfer portal 854, causing valve seal 813*S* to move forward, out of sealing engagement with valve seat 828, thus opening valve 811 and releasing compressed gas. One portion of the compressed gas released flows through recock gas porting into sealable portion 849 of recock chamber 848. The remaining portion of the compressed gas released travels through propulsion gas porting to the pellet $PL_1$.

Slidably translatable within a bolt chamber portion 866 of upper cavity 808 is a bolt 862, forwardly biased by a bolt spring 868 captive between bolt 862 and frame rear plug 865. Extending rearwardly through frame rear plug 865 is a bolt rod 870 having a front end 873 attached to bolt 862, and a rear end 874 attached to a user graspable bolt knob 875 that permits the gun user to move bolt 862. A connecting rod 860 fits within connecting rod recess 871 in bolt 862, and though a corresponding recess 870R in bolt rod 870, thereby constraining bolt 862, and bolt rod 870, to translate in concert with recock piston 803.

Bolt 862 has a rear section $\mathbf{862}_R$. Extending forward from and of smaller diameter than rear section $\mathbf{862}_R$ is an intermediate section 862, that fits slidably within cavity intrusion bore 808*B* and barrel bore $\mathbf{810}_B$. The transition from bolt rear section $\mathbf{862}_R$ to intermediate section $\mathbf{862}_I$ provides a forwardly directed bolt shoulder $\mathbf{862}_F$. Near the forward end of bolt intermediate section $\mathbf{862}_I$ is an external resilient bolt o-ring 862*O*.

Figure 11:
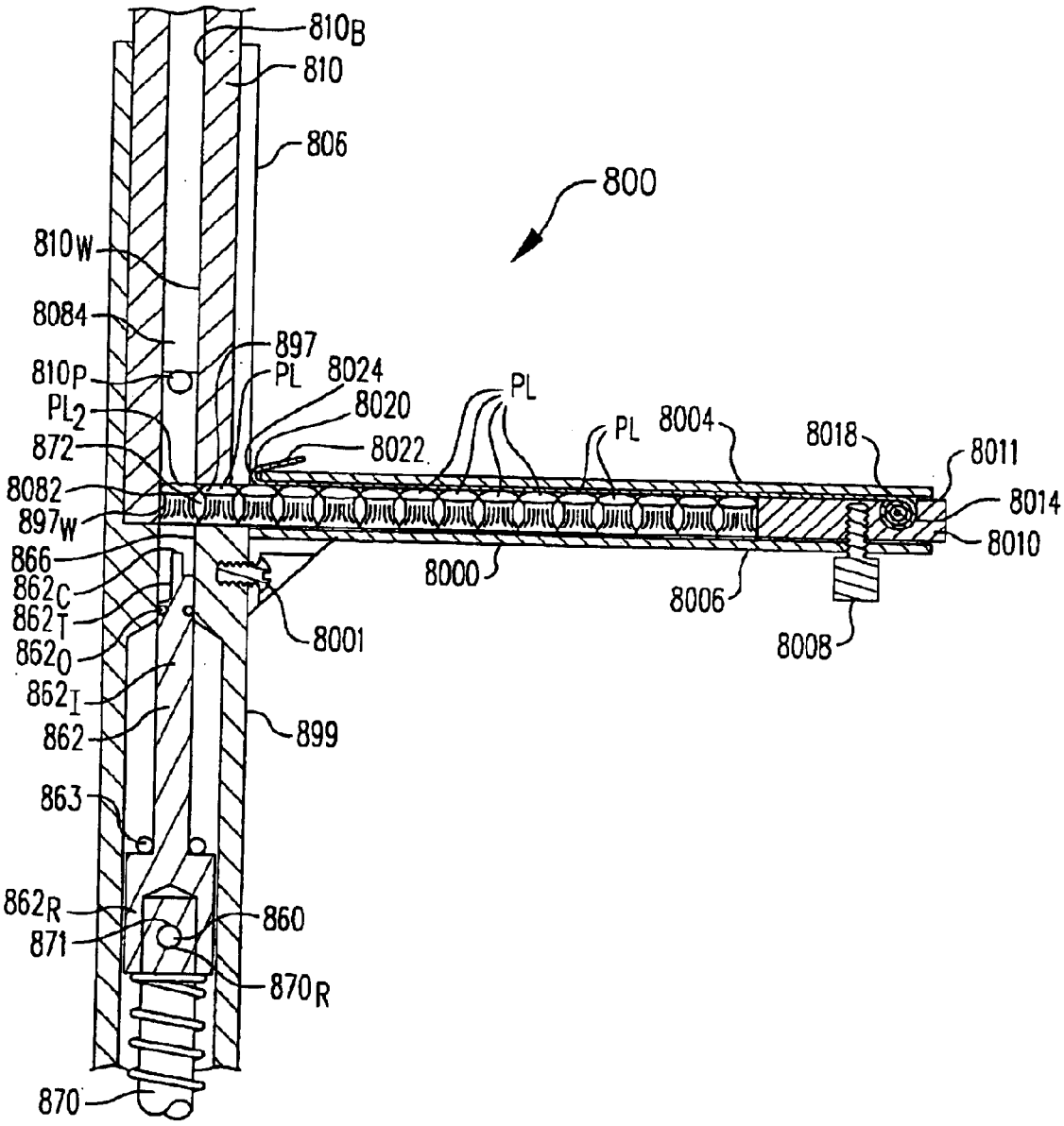
FIG. 11 illustrates the loading of pellets into the pellet gun just shown in FIG. 10 above.

Extending forward from and of smaller cross sectional size than intermediate section $\mathbf{862}_I$ is a bolt transition section $\mathbf{862}_T$ that terminates in a forwardly directed bolt front face 862*C* (visible in FIG. 11). Transition section $\mathbf{862}_T$ and bolt face 862*C* are of size and shape to fit partially within the skirt of the metallic pellets for which the gun is adapted to fire. In addition, bolt transition section $\mathbf{862}_T$ is preferably of a cross section profile that (a) provides adequate mechanical support for bolt front face 862*C*, (b) allows fluid communication for compressed gas flowing from barrel gas passageway 810*P* to the rear of pellet $PL_1$ in firing chamber 8084, and (c) does not damage a pellet as bolt 862 Is withdrawn to the rear and then is returned forward during recocking. An optional bolt-motion buffer 863 conveniently provided in the form of a resilient o-ring of larger diameter than cavity intrusion bore $\mathbf{808}_B$ surrounds bolt intermediate section $\mathbf{862}_I$ and serves to stop forward motion of bolt 862 within upper cavity 808.

Referring to FIG. 11, bolt 862 is moveable rearwardly to an "open" position where a loading port 872 is opened for the introduction of a new pellet $PL_2$ into a gun breech 8082 within bolt chamber 866. Bolt 862 is moveable forwardly to close loading port 872 and return the bolt 862 to a "closed" or "ready-to-fire" position, where the new pellet has been moved forward into a firing chamber 8084 forward of bolt 862 when bolt 862 is in the ready to fire position as shown in FIG. 10. In the bolt closed position, the gun 800 is substantially sealed by bolt 862 against the loss of the compressed gas outward through the loading port 872 during firing of the pellet.

Referring to FIG. 11, in one embodiment, penetrating gun 800 from the right is a pellet loading recess 897 having a cross section and sized to slideably accommodate pellets PL of the type for which gun 800 is adapted, oriented axially parallel with the axis of barrel 810. Loading recess 897 is in registration with interior sidewall 810*W* forming barrel bore $\mathbf{810}_B$. The intersection of the interior recess sidewall 897*W* of loading recess 897 with barrel interior sidewall 810*W* defines a loading port 872 for gun 800. Within barrel bore 8108 defined by barrel interior sidewall 810*W*, and adjacent to loading port 872, is a breech 8082 for receiving pellets introduced into gun 800.

Referring now to FIG. 11, fixed on the right-hand side 899 of gun frame 806 by a magazine screw 8001 is a pellet magazine 8000 sized to hold a row of forwardly disposed pellets PL. Magazine 8000 has a front side 8004, and a rear side 8006. Rear side 8006 is. slotted lengthwise to accommodate translation of a loading knob 8008 inserted into a push block 8010 slideable within magazine 8000. Vertically penetrating and open to the front 8011 of block 8010 is a spring recess 8014. Captured within and free to rotate within recess 8014 is a coiled constant force spring 8018. On the outer end 8020 of spring 8018 is a hook 8022 captured within a slot 8024 in magazine front side 8004 near gun frame 806. Spring 8018 serves thereby to constantly urge push block 8010 to move left toward gun frame 806.

To use magazine 8000, the user grasps loading knob 8008, slides block 8010 to the right, inserts pellets PL, and releases knob 8008, freeing block 8010 to push pellets PL toward loading port 872 under the urging of spring 8018.

Referring now to FIGS. 12 through 23, one embodiment of a semiautomatic pneumatic gun 900 adapted for firing of projectiles by use of compressed gas as a propellant and configured with a novel firing mechanism for firing paintballs is illustrated. FIG. 15 is an exploded perspective view of various components of the internal firing mechanism.

Referring particularly to FIGS. 13, and 17, incorporated into gun 900 is a hammer assembly 902, which hammer assembly 902 includes separable components, namely an impacter 904 and a recock piston 906. Referring mainly to FIG. 17, an electronic trigger assembly 908 including an impacter sear 910 are provided. Gun 900 has a frame 912 having a forward end 914 and a rear end 916. Frame 912 has a longitudinally extending lower cavity 918 defined by interior sidewall 918*W* and longitudinally extending upper cavity 920 defined by interior sidewall 920*W*. Lower cavity 918 and upper cavity 920 are joined yet separated by an intercavity web 922. Intercavity web 922 is penetrated by an intercavity gas passageway 956 that provides fluid communication between lower cavity 918 and upper cavity 920. An intercavity web slot 920*S* provided rearwardly of rear end $\mathbf{920}_R$ of intercavity web 922 extends to the rear end 916 of frame 912. Extending downward from lower cavity 918 is a sear slot 924 which is sized and shaped to accommodate selected sear(s). Extending forward from upper cavity 920 is a barrel 926. In FIG. 18, a paintball $PB_1$ is shown moving forward within barrel 926 as a result of gun 900 just having been fired.

Referring further to FIGS. 15 and 17, located within lower cavity 918 is a normally-closed impact-openable valve 930. Valve 930 has a valve body 932 and a valve stem 934. Valve stem 934 includes a seal body 936 having a rearwardly-directed resilient valve seal 938 and a rearwardly extending valve pin 940 ending rearwardly in an impact receiving face 942. Extending forward on valve seal body 936 is an optional valve spring boss 944. In this embodiment, valve pin 940 is of smaller diameter than valve seal 938. Valve body 932 is fixed (by a suitable structure or method such as set screw 943) within lower cavity 918. Valve body 932 has a front face 945 and a rearwardly directed face 946. Valve body 932 is partially penetrated from the front face 945 by an intermediate bore 948. As seen in FIGS. 15 and 19, valve body 932 is completely penetrated longitudinally by a first rear bore 950, which in this embodiment is coaxial with intermediate bore 948. Valve pin 940 fits slidingly within and, in this embodiment, substantially seals rear bore 950 in valve body 932.

Referring to FIG. 18 in this embodiment, valve body 932 is penetrated from rearwardly directed face 946 by a second rear bore passageway 952. The second rear bore 952 provides a recock gas passageway defined by interior sidewalls 952*W* and is in fluid communication with intermediate bore 948. An upper gas passageway 954 extends upward from intermediate gas bore 948 to communicate with intercavity gas passageway 956. Thus, upper passageway 954 and intercavity gas passageway 956 provide fluid communication between intermediate bore 948 and upper cavity 920, for the supply of propulsion gas to accelerate the projectile $PB_1$ being fired.

On the front face 945 of valve body 932 is a valve seat 960, annular in shape in this embodiment. The valve seat 960 is sealingly engageable by valve seal 938 of valve stem 934; these elements cooperate to control the release of compressed gas from a gas reservoir 962 in lower cavity 918 formed between valve body 932 and a reservoir plug 964. Between valve spring boss 944 and reservoir plug 964 is a valve spring 968 slidably surrounding a valve spring guide 966 extending rearwardly from reservoir plug 964. Valve spring 968 serves to urge valve seal 938 against valve seat 960.

For sealing purposes, an exterior o-ring 970 is provided to seal valve body 932 against lower cavity 918 walls 918*W*. The gas reservoir 962 is configured to receive compressed gas from an external source (not shown) in a conventional manner via suitable structural means such as threaded connection 972.

Referring further to FIG. 18, in this embodiment, recock gas porting providing fluid communication from valve 930 to recock chamber 976 includes intermediate gas bore 948 and second rear bore 952. In this embodiment, propulsion gas porting includes intermediate bore 948, upper gas passageway 954, intercavity gas passageway 956, and bolt gas passageway 974 (described below). A recock chamber 976 portion of lower cavity 918 extends rearwardly from rearwardly directed face 946 of valve body 932. Referring also to FIG. 19, sealable portion 978 of recock chamber 976 extends rearward from rearwardly directed face 946 of valve body 932 to a seal break 980 at sear slot 924 in frame 912. At the slot 924, the compressed gas that was originally provided to the sealable portion 978 of the recock chamber 976 is able to escape through the frame 912, thus relieving pressure in the sealable portion 978 of the recock chamber 976.

Valve 930 and the recock gas porting and propulsion gas porting described herein can alternately be provided in various structural equivalents or equivalent structures, without departing from the novel gun structure disclosed and claimed herein. Hence, the specific valve, valve body, recock gas porting, and propulsion gas porting structures shown in this or other embodiments illustrated are for purposes of illustration, and should not be interpreted as limiting the present invention to any specific embodiment, whether herein illustrated or otherwise.

Recock piston 906 is slidably translatable within recock chamber 976 between a forward ready-to-fire position (shown in FIG. 17) and a rearward impacter cocking position (shown in FIG. 19), and is forwardly biased therein by bolt 9012. Referring further to FIGS. 15 and 19, recock piston 906 has a forwardly directed piston front face 982 slidable within sealable portion 978 of the recock chamber 976 for receiving the urging of the compressed gas provided to recock chamber 976, and recock piston 906 is sufficiently responsive to force exerted by gas released by valve 930 and provided to sealable portion 978 of recock chamber 976 to recock gun 900. In this embodiment recock piston 906 has a resilient o-ring seal 983 external and slightly rearward of piston front face 982.

Recock piston 906 is, in the present embodiment, fully penetrated by an axially centered longitudinal passageway 984 comprising a front portion 986 and a rear impacter receiving portion 988. Impacter receiving portion 988 comprises, rearward of piston front face 982, an interior sidewall 988*W* defining a cavity 988*C* sized and shaped to receive, in interfitting sliding engagement, middle portion 9021 of impacter 904. Front portion 986 has a cross-section complementary in size and shape, and only slightly larger than, valve pin 940. The location of the transition between the forwardly directed piston face 982 and longitudinal passageway 984 defines a momentum transfer portal 990. Valve pin 940 fits in sliding mating engagement within and effectively seals momentum transfer portal 990 during at least a portion of the rearward travel of recock piston 906 during recocking of gun 900. The recock piston body 992 terminates rearwardly with at least a rear face 994 portion which in this embodiment provides a piston contact face engageable with impacter 904. In the upper reaches of recock piston 906 is a connecting rod recess 998 for receiving connecting rod 9010 to connect the recock piston 906 to bolt 9012. Recock piston 906 also has, extending downward from longitudinal passageway 984, a recock piston registration slot 9014 as seen in FIGS. 15 and 17.

Impacter 904 is slidably translatable within recock chamber 976. Impacter 904 is forwardly biased by an impacter power spring 9019 captive between impacter 904 and a frame rear plug 9016 captive at the rear end 916 of gun frame 912. Impacter 904 translates between a rearward cocked position illustrated in FIG. 17, and a forward valve-opening position illustrated in FIG. 18. Referring further to FIGS. 15 and 19, in this embodiment, impacter 904 has a main body portion 9020 which is situated rearward of momentum transfer portal 990, and which is larger in transverse cross section than the momentum transfer portal 990. Impacter 904 has a middle portion 9021. Main body portion 9020 also has an enlarged rear portion 9022 having a forwardly directed shoulder 9024 which in this embodiment provides an impacter contact face. Between enlarged rear portion 9022 and frame rear plug 9016 is a resilient impact absorbing buffer 9026.

It can thus be appreciated that the recock piston 906 captures the impacter 904, as the impacter 904 is dimensioned so that it must travel rearward with recock piston 906 when the recock piston 906 is energized to move rearward during recocking. Thus impacter 904 is responsive to rearward movement of recock piston 906. Also, as shown in this embodiment, impacter 904 has an elongated nose portion 9030 terminating forwardly in an impact imparting face 9032 that is smaller in transverse cross-section than transfer portal 990.

Extending rearwardly through frame rear plug 9016 is an impacter rod 9034 having a front end 9036 attached to impacter 904, and a rear end 9038 attached to a user graspable impacter knob 9040 that permits a gun user to move impacter 904 to the cocked position.

As shown in this embodiment, as is best seen in FIG. 15, impacter 904 further includes a removable registration boss 9042 extending downward from the main body 9020 and fixed to impacter 904 by a boss screw 9044. Registration boss 9042 and recock piston registration slot 9014 are sized and shaped for complementary sliding engagement during longitudinal displacement between impacter 904 and recock piston 906, thereby preventing impacter 904 from rolling about its longitudinal axis.

As seen in FIG. 17, impacter 904 is retained in the cocked position by sear edge 9050 of sear 910 engaging a forwardly directed sear shoulder 9052 on impacter 904 boss 9042. When impacter 904 is released from the cocked position, it travels forward independently of recock piston 906 in response to the urging of impacter power spring 9019 until impact is made, directly or indirectly, with valve stem 934. As FIG. 18 illustrates, impact imparting face 9032 of impacter nose portion 9030 is located, sized and shaped to impact on the impact receiving face 942 of valve pin 940. The forward momentum of impacter 904 is thereby transferred through recock piston transfer portal 990, causing valve seal 938 to move forward from a closed, sealed position to an open, gas release position, out of sealing engagement with valve seat 960, thus opening valve 930 and releasing compressed gas. One portion of the compressed gas released flows through recock gas porting into sealable portion 978 of recock chamber 976 as is illustrated by the reference arrow R in FIG. 18. The remaining portion of the compressed gas released travels through propulsion gas porting to the projectile $PB_1$ as illustrated by the arrows labeled P in FIG. 11.

Referring to FIGS. 15 and 18, slidably translatable within a bolt chamber portion 9060 of upper cavity 920 is a bolt 9012, forwardly. biased by a bolt spring 9061 captive between bolt 9012 and frame rear plug 9016. Extending rearwardly through frame rear plug 9016 is a bolt rod 9062 having a front end 9064 attached to bolt 9012, and a rear end 9066 attached to a user graspable bolt knob 9068 that permits the gun user to move bolt 9012.

A connecting rod 9010 fits within connecting rod recess 9070 in bolt 9012, and though a corresponding recess 9072 in bolt rod 9062, thereby constraining bolt 9012, and bolt rod 9062 to translate in concert with recock piston 906. Solt 9012 is moveable rearwardly to an "open" position where a loading port 9080 is opened (see FIGS. 14 and 21 and 22) for the introduction of a new projectile $PB_2$ (see FIG. 22) into a gun breech 9082 within bolt chamber 9060. Bolt 9012 is moveable forwardly to close loading port 9080 and return the bolt 9012 to a "closed" or "ready-to-fire" position (see FIG. 20), where the new projectile has been moved forward into a firing chamber 9084 forward of bolt 9012 when bolt 9012 is in the ready to fire position. in the closed bolt position, the gun 900 is substantially sealed by bolt 9012 against the loss of the compressed gas outward through the loading port 9080 during firing of the projectile. Note that gas for propelling the projectile may be provided through bolt 9012 via a bolt gas passageway 974 which fluidly connects intercavity gas passageway 956 with firing chamber 9084 when bolt 9012 is forward in the ready-to-fire position, as can also be seen in FIG. 18.

Referring to FIG. 17, in this embodiment, the trigger assembly 908 includes a firing switch 9100, a user-actuable trigger 9102, an electronic timing control circuit 9105, all powered by a battery 9106, as well as a sear 910 with a sear edge 9050, acting on sear shoulder 9052, and linked by sear link 9104 to a sear solenoid 9107. Firing switch 9100 is positioned to be actuated by trigger, 9102. Sear 910 penetrates through sear slot 924 and is constantly spring biased upward. Solenoid 9107, when energized by control circuit 9105 moves sear 910 downward, out of a position of engagement with impacter sear shoulder 9052. Control circuit 9105 is configured to release sear 910 to return upward before impacter 904 has been returned to the cocked position, regardless of how long the user holds the trigger 9102 rearward. It is well under stood in the art that mechanical triggers of common design can provide equivalent functionality, thus the described electronic trigger assembly should not be used to limit the scope of the invention.

Operational details will be further reviewed in view of various figures. First, FIG. 17 shows a side cross sectional view of the gun 900, showing the gun cocked and ready to fire, with the valve 930 in the normally dosed position preventing gas from flowing from reservoir 962 and recock piston 906 and bolt 9012 forward in their respective ready to fire positions. A paintball $PB_1$ is in the firing chamber 9084, and impacter 904 is restrained in the cocked position by the impacter sear 910. Valve pin 940 extends through recock piston transfer portal 990.

FIG. 18 illustrates gun 900 shortly after firing. As impacter 904 has moved forward, impacter impact-imparting face 9032 has impinged on valve pin impact-receiving face 942, transferring the force provided by forwardly moving impacter 904 through recock piston transfer portal 990, thereby briefly opening valve 930 to an open position permitting the flow of compressed gas from a gas reservoir 962. A portion of the gas released is provided for propelling paintball $RB_1$ from gun 900 and flows through propulsion gas porting, with the result that paintball $PB_1$ has started moving forward within barrel 926.

Another portion of the compressed gas released is provided for recocking and flows through recock gas porting into sealable portion 978 of the recock chamber 976. Recock piston 906 is about to begin moving rearward in response to the force exerted by this gas on piston front face 982. Valve pin 940 fits in sliding mating engagement within and effectively seals momentum transfer portal 990 during at least a portion of the rearward travel of recock piston 906. Rearward motion of piston 906 will continue until piston contact face 994 impinges on the impacter contact face,with the result that continued rearward movement of recock piston 906 will result in rearward motion of impacter 904. Impacter nose portion 9030 now effectively seals front longitudinal passageway 986 against the escape of compressed gas.

Recock piston 906 continues rearward to the impacter cocking position as illustrated in FIG. 19, where impacter 904 will once again be restrained in the cocked position by impacter sear 910 engaging sear shoulder 9052. Bolt 9012 has moved with piston 906, so that as can be seen in FIGS. 21 and 22, loading port 9080 has opened for the entrance of the next paintball $PB_2$ in sequence to load to enter gun breech 9082. As can be seen in FIG. 19, recock piston o-ring seal 983 is now rearward of seal break 980 at sear slot 924, allowing gas trapped in recock chamber 976 to escape. As the rearward momentum of piston 906 and bolt 9012 dissipates, they will be returned forward to their respective ready-to-fire positions in response to the forward urging of bolt spring 9061 acting on bolt 9012. As recock piston 906 moves forward, impacter nose 9030 no longer seals front longitudinal passageway 986, allowing residual gas trapped within sealable portion 978 of recock chamber 976 to escape.

As can be seen from the above description, the present invention provides a hammer assembly 902 that beneficially replaces prior art hammer H shown in FIG. 1. Included in hammer assembly 902 is an impacter 904 that moves unencumbered in performing the valve-impacting function as the gun 900 is fired. A recock piston 906 separately implements the recock function. Further, since the bolt 9012 is forward in the port-closed position when the gun 900 is ready to fire, the gun 900 fires with a closed bolt and with a projectile already in the gun firing chamber 9084. Although one exemplary specific structure is shown for these key elements of hammer assembly 902, it should be understood that a variety of structural equivalents, or equivalent structures, are capable of separably providing the impacting and recocking functions and are feasible in accord with the teachings herein.

Finally, gun 900 is shown with a paintball loader 1000 having a push arm assembly 1006. As shown in FIG. 12, the push arm assembly 1006 is partially obscured by a loader cover 1002 shown in the closed position required for gun 900 to operate. In FIG. 13 loader cover 1002 is shown tilted open as might occur as gun 900 is being cleaned, allowing push arm assembly 1006 to be seen more clearly.

In one embodiment of gun 900, paintball loader 1000 illustrated particularly in FIGS. 13, 14, 16, and 20 through 23 is provided to rapidly load paintballs into gun 900 for firing. Loader 1000 includes a loader push arm assembly 1006, and a loader cover 1002 attached pivotally in this embodiment to gun frame 912 by a hinge pin 1008.

Referring to FIGS. 14 and 21, on the side of gun frame 912 is a loading port 9080 defined by edgewalls 1012. Loading port 9080 provides an opening for paintballs to pass into a gun breech 9082 within bolt chamber 9060. in communication with loading port 9080 is a loading chamber 1014 adapted to accommodate the next paintball in succession to load, namely $PB_2$. Referring to FIG. 14, and bottom view FIG. 20, which shows chamber 1014 containing paintball $PB_2$, loading chamber 1014 may be seen to be defined by a gun frame sidewall portion 1018 and a loader cover sidewall portion 1020. Although a particular demarcation between portions 1018 and 1020 is provided in gun 900, it should be understood that a range of other demarcations can be used to provide loading chamber 1014.

Referring to FIGS. 12 and 16, extending upward from loader cover 1002 is an attached paintball feed tube 1022, adapted at an upper end 1023 to accept a common commercially-available bulk paintball magazine (not shown). Feed tube 1022 is in communication with loading chamber 1014 (not shown in these views) and serves to provide additional paintballs thereto. In rear view FIG. 23 can be seen additional paintballs PB3, passing from tube 1022 to chamber 1014, and $PB_4$ and $PB_5$, within tube 1022 and next in succession to enter chamber 1014.

Referring to FIGS. 12, 14 and 20, extending rearwardly from loading chamber 1014 on the exterior of gun frame 912 is a slot 1024 accommodating paintball push arm assembly 1006. Near loading chamber 1014 on upper internal wall 1026 of slot 1024 is a boss 1030 providing at a predetermined location an outwardly-directed contact face 1032.

Referring to FIGS. 16 and 20, loader push arm assembly 1006 includes a cam pivot member 1036 free to rotate on a pivot pin 1040 fixed across slot 1024. Rearward on pivot member 1036 is a cam follower 1044 in this embodiment directed radially inward toward the axis of bolt chamber 9060. Captive between forward end 1048 of pivot member 1036 and an internal wall 1052 of slot 1024 is a push arm spring 1056 serving to urge forward end 1048 of pivot member 1036 away from wall 1052 (here, counterclockwise rotation of pivot member 1036 as viewed from below in FIGS. 20 to 22).

Referring to FIG. 21, cut tangentially into the side 1060 of bolt 9012 is a cam 1064 configured to impinge on and displace cam follower 1044. Although a planar cam surface 1064 is illustrated in the present embodiment, it should be understood that any shape suitable to impinge on and displace cam follower 1044 can be used.

Referring to FIGS. 16 and 22, extending generally forward from forward end 1048 of pivot member 1036 are a push arm lever 1068, and a stop arm 1072, provided in this embodiment in the form of elastic flex members attached to pivot member 1036.by screws 1074 and 1076. A variety of materials such as fiberglass-reinforced plastic, carbon-fiber epoxy, or even metallic springs can be utilized for arms 1068 and 1072, and the two arms need not be of the same material nor of the same stiffness.

Inwardly directed on push arm 1068 is a ball push surface lulls engageable on paintball $PB_2$ within loading chamber 1014 as arm 1068 moves through its range of motion as shown in FIGS. 20, 21 and 22.

Referring to FIGS. 16 and 22, extending a predetermined distance farther in the upward direction than push surface 1078 is an extended portion 1080 of stop arm 1072. On upper surface 1082 of stop arm extended portion 1080 is an upwardly directed ball stop surface 1084. Also on extended portion 1080 is an inwardly directed boss engagement surface 1088 engageable on boss contact face 1032. Boss contact face 1032 serves as shown in FIGS. 22 and 23 to limit inward motion of ball stop surface 1084 to a location predetermined to prevent the downward movement of the next paintball PB3 in order to enter loading chamber 1014 from interfering with the return motion of push arm 1068, as will be described more fully below.

When bolt 9012 is in its forward, port-dosed position, bolt cam 1064 is forward of cam follower 1044 as illustrated in FIG. 20, and push arm assembly 1006 is free to rotate counterclockwise (as viewed from below) to an at-rest position in response to spring 1056 urging. In this position, push surface 1078 does not intrude into loading chamber 1014, and the next paintball $PB_3$ in succession is free to enter loading chamber 1014. As bolt 9012 moves rearward during recocking as shown in FIG. 21, bolt cam 1064 moves rearward past cam follower 1044, causing pivot member 1036 to rotate clockwise. This rotation moves push surface 1078 on push arm 1068 to engage paintball $PB_2$, and to urge it toward gun breech 9082. Initially, this movement of paintball $PB_2$ is stopped by bolt 9012 still blocking loading port 9080, while pivot member 1036 continues to rotate in response to bolt cam 1064 continuing to move past cam follower 1044, resulting in push arm 1068 flexing in the manner illustrated in FIG. 21. Such flexion stores energy in push arm 1068 and also serves to limit the force exerted against paintball $PB_2$. The stored energy helps ensure that paintball $PB_2$ begins to move through the loading port 9080 as soon as bolt 9012 moves sufficiently rearward.

As illustrated in FIG. 21, stop arm 1072 flexes along with push arm 1068. As paintball $PB_2$ then moves into breech 9082 as shown in FIG. 22, stop arm 1072 moves with push arm 1068 until movement of the stop arm 1072 is stopped by boss engagement surface 1088 impinging on boss contact face 1032. Referring to FIGS. 22 and 23, which show gun 900 in the same operating state, the location of contact face 1032, and the extension of extended portion 1080 above ball push surface 1078, are predetermined to ensure that ball stop surface 1084 stops in a location that serves to prevent paintball $PB_3$ from moving so far into loading chamber 1014 that it impedes the subsequent return of push arm 1068 from the paintball-loaded position shown in FIG. 22 to the at-rest position shown in FIG. 20.

Shown in FIGS. 14, 16 and 21, is an optional resilient paintball shock buffer 1090 fixed within a pocket 1092 on the side of breech 9082 opposite loading port 9080. Buffer 1090 serves to absorb the momentum of paintball $PB_2$moving into breech 9082, thereby reducing the risk of paintball breakage within gun 900 and allowing more fragile paintballs to be loaded without breaking.

FIG. 20 shows gun 900 ready to fire. Paintball $BP_1$ is in the firing chamber 9084 forward of bolt 9012. Cam follower 1044 is not engaged on bolt cam 1064, so push arm 1068 and stop arm 1072 are in their rest position outside of loading chamber 1014. Paintball $PB_2$ is in loading chamber 1014.

FIG. 21 shows the gun 900 shortly after firing, with bolt 9012 moving rearward as part of the recocking process so that it has partially opened loading port 9080. (Looking at the figure, the loading port 9080 appears to be slightly more than half open.) The cam 1064 and cam follower 1044 have engaged, forcing the pivot member 1036 to rotate clockwise and the push arm 1068 and the stop arm 1072 to push $PB_2$ toward the gun breech 9082. Bolt 9012 is still partially obstructing the loading port 9080, so that $PB_2$ is not yet able to fully enter, but it has just started. In this embodiment the cam 1064 and cam follower 1044 are configured so that the pivot member 1036 begins to rotate before the loading port 9080 is fully open, flexing the push arm 1068 and stop arm 1072 against the paintball $PB_2$.

FIG. 22 shows the recock process continued to the point where the bolt 9012 is fully retracted, the loading port 9080 is fully open, and $PB_2$ has been pushed fully into breech 9082 by push arm 1068. The momentum of the entering paintball $PB_2$ has been absorbed by optional buffer 1090. Stop arm 1072 motion has been arrested by boss engagement surface 1088, leaving ball stop surface 1084 in a position predetermined to restrain the next paintball $PB_3$ in succession from moving downward to a position that might interfere with the subsequent return of push arm 1068 back to its rest position. This stopping action of stop surface 1084 is also shown in rear view FIG. 23.

Referring again to FIG. 20, bolt 9012 has returned forward to the ready-to-fire position, chambering $PB_2$ into firing chamber 9084 (where $RB_1$ previously resided). Cam 1064 has moved forward out of engagement with cam follower 1044, freeing push arm 1068 and stop arm 1072 to rotate counterclockwise to their rest position, allowing $PB_3$ to move downward into loading chamber 1014 is where $PB_2$ previously resided. Thus by virtue of loader 1000 action being coupled to the motion of bolt 9012, a new paintball is moved through the loading port 9080 during the brief period that the loading port 9080 is open.

It is to be appreciated that the various aspects and embodiments of a pneumatic gun having independent impacter and recock pistons, and the method of operating a pneumatic gun utilizing such a design, are an important improvement in the state of the art. The gun components described herein are simple, robust, reliable, and susceptible to application in various configurations. Although only a few exemplary embodiments have been described in detail, various details are sufficiently set forth in the drawings and in the specification provided herein to enable one of ordinary skill in the art to make and use the invention(s), which need not be further described by additional writing in this detailed description.

Importantly, the aspects and embodiments described and claimed herein may be modified from those shown without materially departing from the novel teachings and advantages provided by this invention, and may be embodied in other specific forms without departing from the spirit or essential characteristics thereof. Therefore, the embodiments presented herein are to be considered in all respects as illustrative and not restrictive. As such, this disclosure is intended to cover the structures described herein and not only structural equivalents thereof, but also equivalent structures. Numerous modifications and variations are possible in light of the above teachings. It is therefore to be understood that within the scope of the appended claims, the invention (s) may be practiced otherwise than as specifically described herein. Thus, the scope of the invention(s), as set forth in the appended claims, and as indicated by the drawing and by the foregoing description, is intended to include variations from the to embodiments provided which are nevertheless described by the broad interpretation and range properly afforded to the plain meaning of the claims set forth below.

What is claimed is:

1. A hammer assembly for use in a pneumatic gun, said pneumatic gun for firing projectiles by use of compressed gas as a propellant, said pneumatic gun comprising:

(1) a recock chamber, and (2) a valve, said valve normally closed and impact openable, said valve comprising a valve seat;

said hammer assembly comprising:

(a) an impacter, said impacter slidably translatable within said recock chamber between a cocked position and a valve-opening position, said valve-opening position closer than said cocked position to said valve seat, said impacter biased toward said valve-opening position, said impacter comprising:

(i) an impacter body portion;

(ii) an impact imparting face, said valve receptive to an impact by said impact imparting face when said impacter moves to said valve-opening position, so that momentum is provided to said valve by said impacter to open said valve; and (iii) an impacter contact face;

(b) a recock piston, said recock piston slidably translatable within said recock chamber between a piston ready-to-fire position and an impacter-cocking position, said piston ready-to-fire position closer than said impacter-cocking position to said valve seat, said recock piston directly or indirectly biased toward said piston ready-to-fire position, said recock piston comprising:

(i) a pressure receiving face, said pressure receiving face slidable within said recock chamber; and (ii) a longitudinal passageway, said longitudinal passageway penetrating (A) said recock piston and (B) said pressure receiving face, to define in said pressure receiving face a transfer portal;

said transfer portal disposed between said impacter body portion and said valve seat, so that the momentum provided by said impacter to open said valve passes through said transfer portal;

said impacter contact face directly or indirectly engageable by said recock piston, wherein as said recock piston moves from said piston ready-to-fire position to said impacter-cocking position, said impacter moves from said valve opening position to said cocked position, and wherein said recock piston returns to said piston ready-to-fire position independently of said impacter;

whereby said impacter and said recock piston separately provide a valve opening function and a recock function, respectively, for said pneumatic gun.

2. A hammer assembly for use in a pneumatic gun, said pneumatic gun for firing projectiles by use of compressed gas as a propellant, said pneumatic gun comprising:

(1) a first end and a second end;

(2) a user actuable trigger (3) a gas reservoir, said gas reservoir for containing compressed gas therein;

(4) a valve, said valve normally closed and impact openable for releasing, when open, compressed gas from said gas reservoir, said valve comprising an impact receiving face;

(5) a recock chamber, said recock chamber comprising a sealable portion, said sealable portion in fluid communication with said valve so that when said valve is open a portion of the compressed gas released flows into said sealable portion, (6) an impacter sear, said impacter sear controlled by said user-actuable trigger;

said hammer assembly comprising:

(a) an impacter, said impacter slidably translatable within said recock chamber between a cocked position and a valve-opening position, said valve-opening position closer than said cocked position to said first end of said gun, said impacter biased toward said valve-opening position, said impacter comprising:

(i) an impact imparting face, said impact imparting face acting on said impact receiving face when said impacter moves to said valve-opening position, so that momentum is provided to said valve by said impacter to open said valve;

(ii) an impacter contact face; and (iii) a sear shoulder, said sear shoulder engageable by said impacter sear when said impacter is in said cocked position, so that said impacter is restrained in said cocked position until said impacter is released in response to actuation of said user-actuable trigger;

(b) a recock piston, said recock piston slidably translatable within said recock chamber between a piston ready-to-fire position and an impacter-cocking position, said piston ready-to-fire position closer than said impacter-cocking position to said first end of said gun, said recock piston directly or indirectly biased toward said piston ready-to-fire position, said recock piston comprising a pressure receiving face, said pressure receiving face slidable within said sealable portion of said recock chamber, said pressure receiving face responsive to the urging of the portion of compressed gas released into said sealable portion of said recock chamber to move said recock piston from said piston ready-to-fire position to said impacter-cocking position;

said impacter contact face directly or indirectly engageable by said recock piston, wherein as said recock piston moves from said piston ready-to-fire position to said impacter-cocking position, said impacter moves from said valve-opening position to said cocked position, and wherein said recock piston returns to said piston ready-to-fire position while said impacter is restrained in said cocked position by said impacter sear, whereby said impacter and said recock piston separately provide a valve opening function and a recock function, respectively, for said pneumatic gun.

3. A hammer assembly for use in a pneumatic gun, said pneumatic gun for firing projectiles by use of compressed gas as a propellant, said pneumatic gun comprising:

(1) a user-actuable trigger (2) a gas reservoir, said gas reservoir for containing compressed gas therein;

(3) a valve, said valve normally closed and impact openable for releasing, when open, compressed gas from said gas reservoir, said valve comprising an impact receiving face and a valve seat;

(4) a recock chamber, said recock chamber comprising a sealable portion, said sealable portion being in fluid communication with said valve so that when said valve is open a portion of the compressed gas released flows into said sealable portion;

(5) an impacter sear, said impacter sear controlled by said user-actuable trigger;

said hammer assembly comprising:

(a) an impacter, said impacter slidably translatable within said recock chamber between a cocked position and a valve-opening position, said valve-opening position closer than said cocked position to said valve seat, said impacter biased toward said valve-opening position, said impacter comprising:

(i) an impacter body portion;

(ii) an impact imparting face, said impact imparting face acting on said impact receiving face when said impacter moves to said valve-opening position, so that momentum is provided to said valve by said impacter to open said valve;

(iii) an impacter contact face; and (iv) a sear shoulder, said sear shoulder engageable by said impacter sear when said impacter is in said cocked position, so that said impacter is restrained in said cocked position until said impacter is released in response to actuation of said user-actuable trigger;

(b) a recock piston, said recock piston slidably translatable within said recock chamber between a piston ready-to-fire position and an impacter-cocking position, said piston ready-to-fire position closer than said impacter-cocking position to said valve seat, said recock piston directly or indirectly biased toward said piston ready-to-fire position, said recock piston comprising:

(i) a pressure receiving face, said pressure receiving face oriented toward said valve seat and slidable within said sealable portion of said recock chamber, said pressure receiving face responsive to the urging of the portion of compressed gas released into said sealable portion of said recock chamber to move said recock piston from said piston ready-to-fire position to said impacter-cocking position;

(ii) a longitudinal passageway, said longitudinal passageway penetrating (A) said recock piston and (B) said pressure receiving face, to define in said pressure receiving face a transfer portal, said transfer portal disposed between said impacter body portion and said valve seat, so that the momentum provided by said impacter to said valve to open said valve passes through said transfer portal;

said impacter contact face directly or indirectly engageable by said recock piston, so that as said recock piston moves from said piston ready-to-fire position to said impacter-cocking position, said impacter moves from said valve-opening position to said cocked position, and so that said recock piston returns to said piston ready-to-fire position while said impacter remains restrained in said cocked position by said impacter sear;

whereby said impacter and said recock piston separately provide a valve opening function and a recock function, respectively, for said pneumatic gun.

4. A hammer assembly for use in a pneumatic gun, said pneumatic gun for firing projectiles by use of compressed gas as a propellant, said pneumatic gun comprising:

(1) a user actuable trigger;

(2) a forward end and a rearward end;

(3) a gas reservoir, said gas reservoir for containing compressed gas therein;

(4) a valve, said valve normally closed and impact openable to release compressed gas from said gas reservoir, said valve comprising a rearwardly directed impact receiving face;

(5) a recock chamber, said recock chamber comprising forwardly a sealable portion, said sealable portion in fluid communication with said valve so that when said valve is open a portion of the compressed gas released flows into said sealable portion, (6) an impacter sear, said impacter sear controlled by said user-actuable trigger;

said hammer assembly comprising:

(a) an impacter, said impacter slidably translatable within said recock chamber between a cocked position and a valve-opening position, said impacter forwardly biased toward said valve-opening position, said impacter comprising:

(i) an impacter body portion;

(ii) an impact imparting face, said impact imparting face forwardly directed, said impact imparting face acting on said impact receiving face when said impacter moves to said valve-opening position, so that momentum is provided by said impacter to open said valve;

(iii) a forwardly-directed impacter contact face; and (iv) a forwardly-directed sear shoulder, said sear shoulder engageable on said impacter sear when said impacter is in said cocked position, so that said impacter is restrained in said cocked position until said impacter is released in response to actuation of said user actuable trigger;

(b) a recock piston, said recock piston slidably translatable within said recock chamber between a piston ready-to-fire position and an impacter-cocking position, said recock piston directly or indirectly biased forward toward said piston ready-to-fire position, said recock piston comprising a forwardly-directed pressure receiving face slidable within said sealable portion of said recock chamber, said pressure receiving face responsive to the urging of the portion of compressed gas released into said sealable portion of said recock chamber to move said recock piston from said piston ready-to-fire position to said impacter-cocking position;

said impacter body portion located rearward of said pressure receiving face of said recock piston;

said impacter contact face directly or indirectly engageable by said recock piston, wherein as said recock piston moves from said piston ready-to-fire position to said impacter-cocking position, said impacter moves from said valve-opening position to said cocked position, and wherein said recock piston returns to said piston ready-to-fire position while said impacter is restrained in said cocked position by said impacter sear;

whereby said impacter and said recock piston separately provide a valve opening function and a recock function, respectively, for said pneumatic gun.

5. A hammer assembly for use in a pneumatic gun, said pneumatic gun for firing projectiles by use of compressed gas as a propellant, said pneumatic gun comprising:

(1) a user actuable trigger;

(2) a forward end and a rearward end;

(3) a gas reservoir, said gas reservoir for containing compressed gas therein;

(4) a valve, said valve normally closed and impact openable to release compressed gas from said gas reservoir, said valve comprising a rearwardly directed impact receiving face;

(5) a recock chamber, said recock chamber comprising forwardly a sealable portion, said sealable portion in fluid communication with said valve so that when said valve is open a portion of the compressed gas released flows into said sealable portion, (6) an impacter sear, said impacter sear controlled by said user-actuable trigger;

said hammer assembly comprising:

(a) an impacter, said impacter slidably translatable within said recock chamber between a cocked position and a valve-opening position, said impacter forwardly biased toward said valve-opening position, said impacter comprising:

(i) an impacter body portion;

(ii) an impact imparting face, said impact imparting face forwardly directed, said impact imparting face acting on said impact receiving face when said impacter moves to said valve-opening position, so that momentum is provided by said impacter to open said valve;

(iii) a forwardly-directed impacter contact face; and (iv) a forwardly-directed sear shoulder, said sear shoulder engageable on said impacter sear when said impacter is in said cocked position, so that said impacter is restrained in said cocked position until said impacter is released in response to actuation of said user-actuable trigger;

(b) a recock piston, said recock piston slidably translatable within said recock chamber between a piston ready-to-fire position and an impacter-cocking position, said recock piston directly or indirectly biased forward toward said piston ready-to-fire position, said recock piston comprising:

(i) a forwardly-directed pressure receiving face, said pressure receiving face slidable within said sealable portion of said recock chamber, said pressure receiving face responsive to the urging of the portion of compressed gas released into said sealable portion of said recock chamber to move said recock piston from said piston ready-to-fire position to said impacter-cocking position: and (ii) a longitudinal passageway, said longitudinal passageway penetrating (A) said recock piston and (B) said pressure receiving face, to define in said pressure receiving face a transfer portal;

said transfer portal located forward of said impacter body portion, so that the momentum provided by said impacter to open said valve passes through said transfer portal;

said impacter contact face directly or indirectly engageable by said recock piston, wherein as said recock piston moves from said piston ready-to-fire position to said impacter-cocking position, said impacter moves from said valve-opening position to said cocked position, and wherein said recock piston returns to said piston ready-to-fire position while said impacter is restrained in said cocked position by said impacter sear;

whereby said impacter and said recock piston separately provide a valve opening function and a recock function, respectively, for said pneumatic gun.

6. The pneumatic gun as set forth in claim 5, further comprising:

(a) a bolt chamber;

(b) a loading port, said loading port when open accommodating the passage of a new projectile into said bolt chamber (c) a bolt, said bolt slidably translatable within said bolt chamber between:

(i) a bolt open position, said loading port open when said bolt is in said bolt open position, and (ii) a bolt ready-to-fire position, said bolt closing said loading port when in said bolt ready-to-fire position, said bolt chambering said new projectile as said bolt moves from said bolt open position to said bolt ready-to-fire position;

said bolt directly or indirectly biased forward toward said bolt ready-to-fire position;

(d) a connecting rod, said connecting rod constraining said bolt and said recock piston to translate in concert.

7. The pneumatic gun as set forth in claim 5, further comprising:

(a) a bolt chamber;

(b) a loading port, said loading port when open accommodating the passage of a projectile into said bolt chamber;

(c) a bolt, said bolt slidably translatable within said bolt chamber between:

(i) a bolt open position, said loading port open when said bolt is in said bolt open position, and (ii) a bolt ready-to-fire position, said bolt closing said loading port when in said bolt ready-to-fire position, said bolt chambering said new projectile as said bolt moves from said bolt open position to said bolt ready-to-fire position;

said bolt directly or indirectly biased forward toward said bolt ready-to-fire position;

(d) a bolt connection bar, said bolt connection bar comprising a forwardly-directed bolt contact face, said bolt contact face engageable with said recock piston so that (A) when said recock piston travels rearward to said impacter-cocking position said bolt is pushed rearward to said bolt open position, and (B) when said bolt travels forward to said bolt ready-to-fire position, said recock piston is pushed forward to said piston ready-to-fire position.

8. The apparatus as set forth in claim 5, wherein said valve further comprises a valve seat and a valve ball, said valve ball comprising a first surface providing said impact receiving face and a second surface providing a valve seal, said valve ball sealingly engageable on said valve seat, said valve ball displaceable from said valve seat in response to impact to open said valve.

9. The apparatus as set forth in claim 5, wherein said valve further comprises a valve pin, said valve pin comprising said impact receiving face.

10. The apparatus as set forth in claim 9, wherein said valve pin fits in sliding engagement within and effectively seals said transfer portal against the passage of compressed gas during at least a portion of the rearward travel of said recock piston from said piston ready-to-fire position to said impacter-cocking position.

11. The apparatus as set forth in claim 5, said impacter further comprises an elongated nose portion, said elongated nose portion comprising said impact imparting face, said elongated nose portion sized to fit slidably within said longitudinal passageway.

12. The apparatus as set forth in claim 11, wherein said elongated nose portion is sized to substantially seal said longitudinal passageway, so that during recocking of said gun said elongated nose portion effectively prevents the escape of compressed gas through said longitudinal passageway during a portion of the rearward movement of said recock piston from said piston ready-to-fire position to said impacter-cocking position.

13. The apparatus as set forth in claim 12, wherein said elongated nose portion is sufficiently short that when said impacter is in said cocked position, said longitudinal passageway is open during a portion the forward movement of said recock piston from said impacter-cocking position to said piston ready-to-fire position, so that compressed gas in said sealed portion of said recock chamber can escape through said longitudinal passageway and said transfer portal.

14. The apparatus as set forth in clam 12, wherein said elongated nose portion further comprises a flat extending longitudinally on said elongated nose portion so when said impacter is in said cocked position, said longitudinal passageway is open to the flow of compressed gas from said recock chamber during a portion the forward displacement of said recock piston from said impacter-cocking position to said piston ready-to-fire position, so that compressed gas in said sealed portion of said recock chamber can escape through said longitudinal passageway and said transfer portal.

15. The apparatus as set forth in claim 5, wherein said recock piston further comprises a transfer pin, said transfer pin situated interposed between said impact imparting face and said impact receiving face, said transfer pin transferring momentum of said impacter to said valve to open said valve, said transfer pin sized and shaped for close fitting engagement with, and slidingly translatable movement within, said transfer portal.

16. The apparatus as set forth in claim 5, wherein said transfer portal is slidably receptive therethrough of one or more members selected from the group consisting of (A) an elongated nose portion of said impacter, said elongated nose portion comprising said impact imparting face, (B) a valve pin portion of said valve, said valve pin portion comprising said impact receiving face, and (C) a transfer pin, said transfer pin comprising (i) a transfer pin impact receiving face engageable on said impact imparting face of said impacter, and (ii) a transfer pin impact imparting face engageable on said impact receiving face of said valve.

17. The apparatus as set forth in claim 5, said impacter body portion further comprises a middle portion, and wherein said recock piston further comprises a cavity, said cavity defined by interior sidewalls, said cavity sized and shaped so that said middle portion is slidable at least partially within said cavity.

18. The apparatus as set forth in claim 17, wherein said recock piston further comprises a registration slot, and wherein said impacter further comprises a registration boss, said registration boss traveling slidingly rearward and forward through said registration slot and substantially preventing said impacter from rolling on its longitudinal axis.

19. The apparatus as set forth in claim 18, wherein said registration boss is detachably affixable to said impacter.

20. The apparatus as set forth in claim 18, wherein said registration boss further comprises said impacter sear shoulder.

21. The apparatus as set forth in claim 5, said recock piston further comprises a recock piston bore defined by interior sidewalls, and wherein said impacter body portion fits slidably within said recock piston bore.

22. The apparatus as set forth in claim 5, wherein said impacter body portion further comprises a middle portion, and wherein said recock piston further comprises a generally horizontally U-shaped structure having an interior sidewall, said structure having a primary open end oriented rearward, said U-shaped structure sized and shaped so that said middle portion is slidable at least partially within said structure.

23. The apparatus as set forth in claim 5, wherein said gun further comprises a piston sear, and wherein said recock piston further comprises a piston sear engagement shoulder engageable on said piston sear to selectively restrain said recock piston in said impacter-cocking position.

24. A hammer assembly for use in a pneumatic gun, said pneumatic gun for firing projectiles by use of compressed gas as a propellant, said pneumatic gun comprising:

(1) a user actuable trigger, (2) a forward end and a rearward end;

(3) a gas reservoir, said gas reservoir for containing compressed gas therein;

(4) a valve, said valve normally closed and impact openable to release compressed gas from said gas reservoir, said valve comprising a rearwardly directed impact receiving face;

(5) a recock chamber, said recock chamber comprising forwardly a sealable portion, said sealable portion in fluid communication with said valve so that when said valve is open a portion of the compressed gas released flows into said sealable portion, (6) an impacter sear, said impacter sear controlled by said user-actuable trigger;

(7) a bolt chamber, (8) a loading port;

(9) a bolt, said bolt slidably translatable within said bolt chamber between:

(i) a bolt ready-to-fire position, said bolt when in said bolt ready-to-fire position closing said loading port, and (ii) a bolt open position, said bolt when in said bolt open position opening said loading port to accommodate the passage of a projectile into said bolt chamber forward of said bolt, said bolt directly or indirectly biased forward toward said bolt ready-to-fire position;

said hammer assembly comprising:

(a) an impacter, said impacter slidably translatable within said recock chamber between a cocked position and a valve-opening position, said impacter forwardly biased toward said valve-opening position, said impacter comprising:

(i) an impacter body portion;

(ii) an impact imparting face, said impact imparting face forwardly directed, said impact imparting face acting on said impact receiving face when said impacter moves to said valve-opening position, so that momentum is provided by said impacter to open said valve;

(iii) a forwardly-directed impacter contact face; and (iv) a forwardly-directed sear shoulder, said sear shoulder engageable on said impacter sear when said impacter is in said cocked position, so that said impacter is restrained in said cocked position until said impacter is released in response to actuation of said user-actuable trigger;

(b) a recock piston, said recock piston slidably translatable within said recock chamber between a piston ready-to-fire position and an impacter-cocking position, said recock piston directly or indirectly biased forward toward said piston ready-to-fire position, said recock piston comprising:

(i) a forwardly-directed pressure receiving face, said pressure receiving face slidable within said sealable portion of said recock chamber, said pressure receiving face responsive to the urging of the portion of compressed gas released into said sealable portion of said recock chamber to move said recock piston from said piston ready-to-fire position to said impacter-cocking position; and (ii) a longitudinal passageway, said longitudinal passageway penetrating (A) said recock piston and (B) said pressure receiving face, to define in said pressure receiving face a transfer portal;

said transfer portal located forward of said impacter body portion, so that the momentum provided by said impacter to open said valve passes through said transfer portal;

said impacter contact face directly or indirectly engageable by said recock piston, wherein as said recock piston moves from said piston ready-to-fire position to said impacter-cocking position, said impacter moves from said valve-opening position to said cocked position, and wherein said recock piston returns to said piston ready-to-fire position while said impacter is restrained in said cocked position by said impacter sear;

said bolt constrained to travel rearward when said recock piston travels rearward, and said recock piston constrained to travel forward when said bolt travels forward, so that when said recock piston moves rearward to said impacter-cocking position said bolt moves rearward to said bolt open position, and so that when said bolt moves forward to said bolt ready-to-fire position said recock piston moves forward to said piston ready-to-fire position;

whereby said impacter and said recock piston separately provide a valve opening function and a recock function, respectively, for said pneumatic gun.

25. The apparatus as set forth in claim 24, said bolt further comprising a rearwardly-directed bolt contact face, said bolt contact face engageable with said impacter so that as said recock piston moves rearward, said recock piston directly engages said bolt to move said bolt rearward, and said recock piston indirectly engages said impacter to move said impacter rearward.

26. The apparatus as set forth in claim 24, said gun further comprises a bolt spring, said bolt spring directly biasing said bolt forward, said bolt spring indirectly biasing said recock piston forward.

27. The apparatus as set forth in claim 24, said gun further comprises a frame, said frame comprising a single longitudinal cavity, said single longitudinal cavity comprising said recock chamber, and said bolt chamber.

28. The apparatus as set forth in claim 27, wherein said gun further comprises a connecting rod, said connecting rod comprising an elongated generally U-shaped link-like member having an extended body portion and relatively short first end and second end members, said first and said second end members fitting within corresponding first and second connecting rod recesses in said bolt and said recock piston, respectively, said connecting rod constraining said bolt and said recock piston to translate in concert.

29. The apparatus as set forth in claim 24, wherein said gun further comprises a frame, said frame comprising a first longitudinal cavity, said first longitudinal cavity comprising said bolt chamber, said frame further comprising a second longitudinal cavity, said second longitudinal cavity comprising said recock chamber.

30. A hammer assembly for use in a pneumatic gun, said pneumatic gun for firing projectiles by use of compressed gas as a propellant, said pneumatic gun comprising:

(1) a user actuable trigger;

(2) a forward end and a rearward end;

(3) a gas reservoir, said gas reservoir for containing compressed gas therein;

(4) a valve, said valve normally closed and impact openable to release compressed gas from said gas reservoir, said valve comprising a rearwardly directed impact receiving face;

(5) a recock chamber, said recock chamber comprising forwardly a sealable portion, said sealable portion in fluid communication with said valve so that when said valve is open a portion of the compressed gas released flows into said sealable portion, (6) an impacter sear, said impacter sear controlled by said user-actuable trigger;

(7) a bolt chamber (8) a loading port;

(9) a bolt, said bolt slidably translatable within said bolt chamber between:

(i) a bolt ready-to-fire position, said bolt when in said bolt ready-to-fire position closing said loading port, and (ii) a bolt open position, said bolt when in said bolt open position opening said loading port to accommodate the passage of a projectile into said bolt chamber forward of said bolt, said bolt directly or indirectly biased forward toward said bolt ready-to-fire position;

said hammer assembly comprising:

(a) an impacter, said impacter slidably translatable within said recock, chamber between a cocked position and a valve-opening position, said impacter forwardly biased toward said valve-opening position, said impacter comprising:

(i) an impacter body portion;

(ii) an impact imparting face, said impact imparting face forwardly directed, said impact imparting face acting on said impact receiving face when said impacter moves to said valve-opening position, so that momentum is provided by said impacter to open said valve;

(iii) a forwardly-directed impacter contact face; and (iv) a forwardly-directed sear shoulder, said sear shoulder engageable on said impacter sear when said impacter is in said cocked position, so that said impacter is restrained in said cocked position until said impacter is released in response to actuation of said user-actuable trigger;

(b) a recock piston, said recock piston slidably translatable within said recock chamber between a piston ready-to-fire position and an impacter-cocking position, said recock piston directly or indirectly biased forward toward said piston ready-to-fire position, said recock piston comprising:

(i) a forwardly-directed pressure receiving face, said pressure receiving face slidable within said sealable portion of said recock chamber, said pressure receiving face responsive to the urging of the portion of compressed gas released into said sealable portion of said recock chamber to move said recock piston from said piston ready-to-fire position to said impacter-cocking position; and (ii) a longitudinal passageway, said longitudinal passageway penetrating (A) said recock piston and (B) said pressure receiving face, to define in said pressure receiving face a transfer portal;

said transfer portal located forward of said impacter body portion, so that the momentum provided by said impacter to open said valve passes through said transfer portal;

said impacter contact face directly or indirectly engageable by said recock piston, wherein as said recock piston moves from said piston ready-to-fire position to said impacter-cocking position, said impacter moves from said valve-opening position to said cocked position, and wherein said recock piston returns to said piston ready-to-fire position while said impacter is restrained in said cocked position by said impacter sear;

said pneumatic gun further comprising a member selected from the group consisting of:

(i) a connecting rod, said connecting rod constraining said bolt and said recock piston to translate in concert, and (ii) a bolt connection bar, said bolt connection bar constraining said bolt to travel rearward when said recock piston travels rearward, and constraining said recock piston to travel forward when said bolt travels forward;

so that when said recock piston moves rearward to said impacter-cocking position said bolt moves rearward to said bolt open position, and so that when said bolt moves forward to said bolt ready-to-fire position said recock piston moves forward to said piston ready-to-fire position:

whereby said impacter and said recock piston separately provide a valve opening function and a recock function, respectively, for said pneumatic gun.

31. A hammer assembly for use in a pneumatic gun, said pneumatic gun for firing projectiles by use of compressed gas as a propellant, said pneumatic gun comprising:

(1) a user actuable trigger;

(2) a forward end and a rearward end;

(3) a gas reservoir, said gas reservoir for containing compressed gas therein;

(4) a valve, said valve normally closed and impact openable to release compressed gas from said gas reservoir, said valve comprising a rearwardly directed impact receiving face;

(5) a recock chamber, said recock chamber comprising forwardly a sealable portion, said sealable portion in fluid communication with said valve so that when said valve is open a portion of the compressed gas released flows into said sealable portion, (6) an impacter sear, said impacter sear controlled by said user-actuable trigger;

said hammer assembly comprising:

(a) an impacter, said impacter slidably translatable within said recock chamber between a cocked position and a valve-opening position, said impacter forwardly biased toward said valve-opening position, said impacter comprising:

(i) an impacter body portion;

(ii) an impact imparting face, said impact imparting face forwardly directed, said impact imparting face acting on said impact receiving face when said impacter moves to said valve-opening position, so that momentum is provided by said impacter to open said valve;

(iii) a forwardly-directed impacter contact face; and (iv) a forwardly-directed sear shoulder, said sear shoulder engageable on said impacter sear when said impacter is in said cocked position, so that said impacter is restrained in said cocked position until said impacter is released in response to actuation of said user-actuable trigger;

(b) a recock piston, said recock piston slidably translatable within said recock chamber between a piston ready-to-fire position and an impacter-cocking position, said recock piston directly or indirectly biased forward toward said piston ready-to-fire position, said recock piston comprising:

(i) a forwardly-directed pressure receiving face, said pressure receiving face slidable within said sealable portion of said recock chamber, said pressure receiving face responsive to the urging of the portion of compressed gas released into said sealable portion of said recock chamber to move said recock piston from said piston ready-to-fire position to said impacter-cocking position; and (ii) a longitudinal passageway, said longitudinal passageway penetrating (A) said recock piston and (B) said pressure receiving face, to define in said pressure receiving face a transfer portal;

said transfer portal located forward of said impacter body portion;

said transfer portal slidably receptive therethrough of one or more members selected from the group consisting of: (A) an elongated nose portion of said impacter, said elongated nose portion comprising said impact imparting face, (B) a valve pin portion of said valve, said valve pin portion comprising said impact receiving face, and (C) a transfer pin;

so that the momentum provided by said impacter to open said valve passes through said transfer portal;

said impacter contact face directly or indirectly engageable by said recock piston, wherein as said recock piston moves from said piston ready-to-fire position to said impacter-cocking position, said impacter moves from said valve-opening position to said cocked position, and wherein said recock piston returns to said piston ready-to-fire position while said impacter is restrained in said cocked position by said impacter sear, whereby said impacter and said recock piston separately provide a valve opening function and a recock function, respectively, for said pneumatic gun.

32. A firing mechanism for a pneumatic gun, said pneumatic gun comprising a frame, said frame comprising a forward end and a rearward end, said firing mechanism comprising:

(a) a gas reservoir, said gas reservoir for containing compressed gas therein;

(b) a recock chamber, said recock chamber comprising a forward end;

(c) a valve, said valve having a normally closed position wherein the gas in said gas reservoir is prevented from flowing, and an open position wherein said valve permits flow of compressed gas out of said gas reservoir, and a portion of said compressed gas is allowed to flow into said recock chamber, said valve responsive to impact to transition from said closed position to said open position;

(d) an impacter, said impacter forwardly biased and slidably translatable in said recock chamber between a rearward, cocked position and a forward, valve-opening position, said impacter comprising an impact imparting face;

(e) a recock piston, said recock piston directly or indirectly forwardly biased in said recock chamber and slidably translatable therein between a forward piston ready-to-fire position and a rearward impacter-cocking position, said recock piston comprising:

(i) a forwardly-directed pressure receiving face, (ii) a longitudinal passageway, said longitudinal passageway penetrating (A) said recock piston and (B) said pressure receiving face, to define in said pressure receiving face a transfer portal, and (iii) a rearwardly directed recock piston contact face, said recock piston contact face directly or indirectly engageable on said impacter as said recock piston moves from said piston ready-to-fire position to said impacter-cocking position, so that said impacter moves to said cocked position;

said impact imparting face of said impacter operable to impact said valve to actuate said valve from said closed position to said open position;

said impacter forwardly slidable in said recock chamber independently from said recock piston when said recock piston is in said piston ready-to-fire position.

33. A pneumatic gun for firing projectiles by use of compressed gas as a propellant, said pneumatic gun comprising:

(a) a forward end and a rearward end;

(b) a frame, said frame comprising a bolt chamber and a recock chamber;

(c) a bolt, said bolt forwardly biased and slidably translatable within said bolt chamber between an open, projectile-loading position and a closed, bolt ready-to-fire position;

(d) a firing chamber, said firing chamber adapted to hold a projectile for receipt of compressed gas to propel said projectile from said pneumatic gun;

(e) a loading port in said bolt chamber, said loading port providing when said bolt is in said open, projectile-loading position, a passageway for entry of a projectile into a position in front of said bolt for transport of said projectile by said bolt to said firing chamber;

(f) a gas reservoir, said gas reservoir for containing compressed gas therein;

(g) a normally closed valve, said valve situated to control release of compressed gas from said gas reservoir, said valve including a valve seat and a valve seal displaceable from said valve seat, wherein said valve prevents the flow of gas through said valve seat when said valve seat is sealingly engaged by said valve seal, and wherein said recock chamber is in fluid communication with said valve and adapted to receive compressed gas therefrom;

(h) a recock piston, said recock piston located in said recock chamber, said recock piston slidably translatable and forwardly biased in said recock chamber, said recock piston comprising:

(i) a forwardly-directed pressure receiving face responsive to compressed gas received by said recock chamber, and (ii) a longitudinal passageway, said longitudinal passageway penetrating (A) said recock piston and (B) said pressure receiving face, to define in said pressure receiving face a transfer portal;

(i) an impacter, said impacter comprising an impact imparting face, said impacter located in said recock chamber, said impacter slidably translatable in said recock chamber from a rearward,cocked position to a forward, valve-opening position, said impacter biased toward said valve-opening position;

said recock piston slidable in said recock chamber from a forward, piston ready-to-fire position to a rearward, impacter-cocking position;

said impacter responsive to rearward movement of said recock piston, so that when said recock piston moves rearward to said impacter-cocking position, said impacter moves rearward to said cocked position, and said recock piston forwardly slidable to said piston ready-to-fire position while said impacter remains rearward in said cocked position;

said valve seal responsive, directly or indirectly, to an impact from said impact imparting face of said impacter, to move from (1) a closed, sealed position to (2) an open, gas release position wherein gas is released, with one portion of the gas released provided into said recock chamber to move said recock piston rearward to said impacter-cocking position, which movement of said recock piston rearward (A) directly or indirectly moves said bolt rearward to said open, projectile-loading position, and (B) directly or indirectly moves said impacter rearward to said cocked position.

34. A pneumatic gun for firing projectiles by use of compressed gas as a propellant, said pneumatic gun comprising:

(a) a frame, said frame comprising a front end and a rear end;

(b) a gas reservoir, said gas reservoir for containing compressed gas therein;

(c) a normally-closed impact-openable valve, said valve situated to control release of compressed gas from said gas reservoir, said valve having a closed position wherein compressed gas in said gas reservoir is prevented from flowing, and an open position wherein said valve releases compressed gas from said gas reservoir, said valve comprising:

(i) a valve body, said valve body comprising a rearwardly directed face, and (ii) a valve seat;

(d) a recock chamber, said recock chamber defined within said frame rearward of said rearwardly directed face of said valve body; said recock chamber comprising forwardly a sealable portion;

(e) recock gas porting, said recock gas porting fluidly directing one portion of the gas released by said valve to said sealable portion of said recock chamber;

(f) propulsion gas porting, said propulsion gas porting fluidly directing another portion of the gas released by said valve to a projectile to be fired by said gun;

(g) an impacter, said impacter slidably translatable in said recock chamber between a forward, valve-opening position and a rearward, cocked position, said impacter forwardly biased in said recock chamber toward said valve-opening position, said impacter comprising:

(i) a forwardly-directed sear shoulder, (ii) an impacter body portion, and (iii) a forwardly-directed impact imparting face, said impact imparting face operable when said impacter moves to said valve-opening position to transfer momentum of said impacter to said valve and to actuate said valve from said closed position to said open position:

(h) a recock piston, said recock piston slidably translatable in said recock chamber between a forward, piston ready-to-fire position and a rearward, impacter-cocking position, said recock piston forwardly biased in said recock chamber, said recock piston comprising:

(i) a forwardly-directed pressure receiving face, said pressure receiving face slidable within said sealable portion of said recock chamber, and (ii) a longitudinal passageway, said longitudinal passageway penetrating (A) said recock piston and (B) said pressure receiving face, to define in said pressure receiving face a transfer portal;

said recock piston sufficiently responsive to force exerted by the portion of gas provided to said sealable portion of said recock chamber to recock said gun;

said impacter body portion larger in transverse cross section than said transfer portal, and said impacter body portion positioned rearward of said transfer portal;

so that when said recock piston moves rearward to said impacter-cocking position said impacter moves rearward to said cocked position, and so that said recock piston can move forward to said piston ready-to-fire position white said impacter is restrained in said cocked position.

35. A pneumatic gun which uses compressed gas as a propellant for firing projectiles, said pneumatic gun comprising:

(a) a frame, said frame comprising a front end, and a rear end;

(b) a user-actuable trigger;

(c) an impacter sear, said impacter sear operably linked to said user-actuable trigger;

(d) a gas reservoir, said gas reservoir for containing compressed gas therein;

(e) a normally-closed impact-openable valve, said valve situated to control release of compressed gas from said gas reservoir, said valve having a valve closed position wherein gas in said gas reservoir is prevented from flowing, and a valve open position wherein said valve releases gas from said gas reservoir, said valve comprising:

(i) a valve body, said valve body comprising:

(A) a rearwardly directed face, and (B) a valve seat;

(ii) a valve stem, said valve stem comprising:

(A) a seal body, said seal body comprising a rearwardly directed valve seal sealingly engageable with and forwardly displaceable from said valve seat, and (B) a valve pin, said valve pin terminating rearwardly in an impact receiving face;

(f) a recock chamber, said recock chamber extending rearwardly within said lower cavity from said rearwardly directed face of said valve body, said recock chamber comprising forwardly a sealable portion;

(g) recock gas porting, said recock gas porting fluidly directing one portion of the compressed gas released by said valve to said sealable portion of said recock chamber;

(h) propulsion gas porting, said propulsion gas porting fluidly directing another portion of compressed gas released by said valve to a projectile to be fired by the gun;

(i) an impacter, said impacter slidably translatable in said recock chamber between a rearward, cocked position and a forward, valve-opening position, said impacter biased toward said valve-opening position by an impacter power spring, said impacter comprising:

(i) an impacter body portion, (ii) a forwardly-directed impacter contact face, (iii) an elongated nose portion, said elongated nose portion terminating forwardly in an impact imparting face, and (iv) a forwardly-directed sear shoulder, said sear shoulder receptive when said impacter is in said cocked position to engagement by said impacter sear to restrain said impacter in said cocked position;

(j) a recock piston, said recock piston slidably translatable in said recock chamber between a piston ready-to-fire position and a rearward, impacter-cocking position, said recock piston comprising:

(i) a forwardly-directed pressure receiving face, said pressure receiving face slidable within said sealable portion of said recock chamber, and (ii) a longitudinal passageway, said longitudinal passageway penetrating (A) said recock piston and (B) said pressure receiving face, to define in said pressure receiving face a transfer portal;

(k) a bolt chamber, (l) a loading port, said loading port when open accommodating the passage of a projectile into said bolt chamber;

(m) a bolt, said bolt slidably translatable within said bolt chamber between a bolt ready-to-fire position and a rearward, bolt open position, said loading port open when said bolt is in said bolt open position, said bolt forwardly biased by a bolt spring;

(n) a connecting rod, said connecting rod constraining said bolt and said recock piston to translate in concert, so that said recock piston is thereby forwardly biased within said recock chamber by said bolt;

said recock piston sufficiently responsive to force exerted by the compressed gas provided to said sealable portion of said recock chamber to recock said gun;

said impacter body portion located rearward of said transfer portal;

said impacter body portion larger in transverse cross section than said transfer portal;

said elongated nose portion fitting slidably through said transfer portal;

said valve pin fitting slidably through said transfer portal;

said impact receiving face of said valve pin receptive to impact by said impact imparting face of said elongated nose portion, so that forward momentum of said impacter is transferred through said transfer portal and imparted to said valve to actuate said valve from said valve dosed position to said valve open position;

said impacter contact face of said impacter impingeable on said recock piston, so that when said recock piston moves rearward to said impacter-cocking position said impacter moves rearward to said cocked position, and so that said recock piston can move forward to said piston ready-to-fire position while said impacter is restrained in said cocked position.

36. A pneumatic gun for firing projectiles by use of compressed gas as a propellant, said pneumatic gun comprising:

(a) a frame, said frame comprising a front end and a rear end;

(b) a gas reservoir, said gas reservoir for containing compressed gas therein;

(c) a normally-closed impact-openable valve, said valve comprising an impact receiving face, said valve situated to control release of compressed gas from said gas reservoir;

(d) propulsion gas porting, said propulsion gas porting directing one portion of the compressed gas released by said valve when said valve is open to a projectile to be fired by said pneumatic gun:

(e) a recock chamber, said recock chamber comprising a forward chamber end, said recock chamber comprising at said forward chamber end a sealable portion, said sealable portion receptive of another portion of the compressed gas released by said valve when said valve is open:

(f) an impacter, said impacter slidably translatable in said recock chamber between a cocked position and a valve-opening position, said impacter forwardly biased in said recock chamber toward said valve-opening position, said impacter comprising:

(i) a forwardly-directed impact imparting face, said impact imparting face acting on said impact receiving face when said impacter moves to said valve-opening position, so that momentum is provided to said valve by said impacter to open said valve, and (ii) an impacter body portion;

(g) a recock piston, said recock piston slidably translatable in said recock chamber between a forward, piston ready-to-fire position and a rearward, impacter-cocking position, said recock piston directly or indirectly forwardly biased in said recock chamber, said recock piston comprising:

(i) a forwardly-directed pressure receiving face, said pressure receiving face slidable within said sealable portion of said recock chamber, and (ii) a longitudinal passageway, said longitudinal passageway penetrating said recock piston and said pressure receiving face and defining thereby a transfer portal in said pressure receiving face;

said recock piston sufficiently responsive to force exerted by the portion of compressed gas provided to said sealable portion of said recock chamber to recock said pneumatic gun:

said impacter body portion larger in transverse cross section than said transfer portal, and said impacter body portion located rearward of said transfer portal;

so that the momentum provided by said impacter to open said valve passes through said transfer portal;

and so that:

(A) when said recock piston moves rearward to said impacter-cocking position, said impacter is thereby moved rearward to said cocked position, and (B) when said impacter is in said cocked position, said recock piston is forwardly slidable independently of said impacter, and (C) when said recock piston is in said piston ready-to-fire position, said impacter is forwardly slidable independently of said recock piston.

37. A pneumatic gun for firing projectiles by use of compressed gas as a propellant, said pneumatic gun comprising:

(a) a frame comprising a front end and a rear end;

(b) a gas reservoir, said gas reservoir for containing compressed gas therein;

(c) a normally-closed impact-openable valve, said valve situated to control release of compressed gas from said gas reservoir;

(d) a propulsion gas porting, said propulsion gas porting directing one portion of the compressed gas released by said valve when said valve is open to a projectile to be fired by said pneumatic gun;

(e) a recock chamber, said recock chamber comprising a forward chamber end, said recock chamber comprising at said forward chamber end a sealable portion in fluid communication with said valve, said sealable portion receptive of another portion of the compressed gas released by said valve when said valve is open;

(f) an impacter, said impacter slidably translatable in said recock chamber between a cocked position and a valve-opening position, said impacter forwardly biased in said recock chamber toward said valve-opening position, said impacter comprising:

(i) a forwardly directed impact imparting face, said impact imparting face operable to impact said valve when said impacter moves to said valve-opening position, so that momentum is provided to said valve by said impacter to open said valve, (ii) an impacter body portion, and (iii) an impacter contact face;

(g) a recock piston, said recock piston slidably translatable in said recock chamber between a forward piston ready-to-fire position and a rearward impacter-cocking position, said recock piston forwardly biased in said recock chamber, said recock piston comprising:

(i) a forwardly-directed pressure receiving face, said pressure receiving face slidable within said sealable portion of said recock chamber, (ii) a longitudinal passageway, said longitudinal passageway penetrating (A) said recock piston and (B) said pressure receiving face, to define in said pressure receiving face a transfer portal;

(h) a bolt chamber within said frame;

(i) a loading port, said loading port when open accommodating therethrough the passage of a new projectile into said bolt chamber;

(j) a bolt, said bolt slidably translatable and forwardly biased in said bolt chamber between a rearward, open position, wherein said loading port is open, and a forward, bolt ready-to-fire position, wherein said loading port is closed;

said transfer portal slidably receptive therethrough of one or more members selected from the group consisting of: (A) an elongated nose portion of said impacter, said elongated nose portion comprising said impact imparting face, (B) a valve pin portion of said valve, said valve pin portion comprising said impact receiving face, and (C) a transfer pin;

said impacter body portion larger in transverse cross section than said transfer portal, and said impacter body portion positioned rearward of said transfer portal, so that the impact provided by said impacter to open said valve passes through said transfer portal;

said recock piston sufficiently responsive to force exerted by the gas provided to said sealable portion of said recock chamber to recock said gun;

said impacter contact face directly or indirectly engageable by said recock piston, so that:

(A) when said recock piston moves rearward to said impacter-cocking position, said impacter moves rearward to said cocked position, and (B) when said impacter is in said cocked position, said recock piston is forwardly slidable independently of said impacter, and (C) when said recock piston is in said piston ready-to-fire position, said impacter is forwardly slidable independently of said recock piston;

said bolt constrained to travel rearward when said recock piston travels rearward, and said recock piston constrained to travel forward when said bolt travels forward, so that when said recock piston moves rearward to said impacter-cocking position said bolt moves rearward to said bolt open position, and so that when said bolt moves forward to said bolt ready-to-fire position said recock piston moves forward to said piston ready-to-fire position.

38. A method of opening a normally-closed impact-openable valve in a pneumatic gun, said method comprising the steps of:

(a) providing a gas reservoir, said gas reservoir for containing compressed gas in said pneumatic gun;

(b) providing a recock chamber in said pneumatic gun;

(c) positioning said valve in said pneumatic gun to control the release of compressed gas from said gas reservoir;

(d) providing said valve with a valve seat;

(e) providing in said pneumatic gun an impacter, said impacter slidably translatable in said recock chamber between a cocked position and a valve-opening position, said valve-opening position closer than said cocked position to said valve seat, said impacter restrainable in said cocked position, said impacter comprising an impacter body portion;

(f) biasing said impacter toward said valve-opening position;

(g) providing said valve with an impact receiving face, said impact receiving face receptive of impact by said impacter to open said valve;

(h) providing in said pneumatic gun a recock piston, said recock piston slidably translatable in said recock chamber between a piston ready-to-fire position and an impacter-cocking position, said piston ready-to-fire position closer than said impacter-cocking position to said valve seat;

(i) biasing said recock piston toward said piston ready-to-fire position;

(j) providing a pressure receiving face on said recock piston, said pressure receiving face disposed between said impacter body portion and said valve seat;

(k) providing a longitudinal passageway in said recock piston, said longitudinal passageway penetrating (A) said recock piston and (B) said pressure receiving face, to define in said pressure receiving face a transfer portal;

(l) restraining said impacter in said cocked position;

(m) releasing said impacter to travel to said valve-opening position;

(n) passing the momentum provided by said impacter through said transfer portal and to said valve;

(o) opening said valve.

39. A method of opening a normally-closed impact-openable valve in a pneumatic gun, said pneumatic gun comprising a forward end and a rearward end, said method comprising the steps of:

(a) providing a gas reservoir, said gas reservoir for containing compressed gas in said pneumatic gun;

(b) providing a recock chamber in said pneumatic gun;

(c) positioning said valve in said pneumatic gun to control the release of compressed gas from said gas reservoir;

(d) providing in said gun an impacter, said impacter slidably translatable in said recock chamber between a cocked position and a valve-opening position, said valve-opening position forward of said cocked position;

(e) providing said impacter with an impacter body portion and a forwardly-directed sear shoulder:

(f) biasing said impacter toward said valve-opening position;

(g) providing in said gun an impacter sear, said impacter sear for restraining said impacter in said cocked position;

(h) providing in said gun a user actuable trigger, said user actuable trigger operably linked to said impacter sear for releasing said impacter from said cocked position;

(i) providing said valve with an impact receiving face, said impact receiving face receptive of impact by said impacter to open said valve;

(j) providing in said gun a recock piston, said recock piston slidably translatable in said recock chamber between a piston ready-to-fire position and an impacter-cocking position, said piston ready-to-fire position forward of said impacter-cocking position;

(k) biasing said recock piston toward said piston ready-to-fire position;

(l) providing a forwardly-directed pressure receiving face on said recock piston;

(m) positioning said impacter body portion rearward of said pressure receiving face in said recock chamber;

(n) providing a longitudinal passageway in said recock piston, said longitudinal passageway penetrating (A) said recock piston and (B) said pressure receiving face, to define in said pressure receiving face a transfer portal;

(o) restraining said impacter in said cocked position;

(p) releasing said impacter to travel to said valve-opening position;

(q) passing the momentum provided by said impacter through said transfer portal and to said valve;

(r) opening said valve.

40. A method of operating a pneumatic gun, said gun comprising a forward end and a rearward end, said method comprising the steps of:

(a) providing in said gun a gas reservoir, said gas reservoir for containing compressed gas;

(b) providing in said gun a recock chamber, (c) providing in said gun a normally-closed impact-openable valve, said valve in fluid communication with said recock chamber and with said gas reservoir, said valve when open permitting release of compressed gas from said gas reservoir;

(d) providing in said gun an impacter, said impacter slidably translatable within said recock chamber between a rearward, cocked position and a forward, valve-opening position;

(e) providing said impacter with an impacter body portion, a forwardly-directed impact imparting face, a forwardly-directed impacter contact face and a forwardly-directed sear shoulder;

(f) providing said valve with a valve seat, and with a rearwardly directed impact receiving face receptive to an impact by said impact imparting face when said impacter moves to said valve-opening position;

(g) providing impacter bias, said impacter bias forwardly biasing said impacter;

(h) providing in said gun an impacter sear, said impacter sear for restraining said impacter in said cocked position;

(i) providing in said gun a user actuable trigger, said trigger operably linked to said impacter sear for releasing said impacter from said cocked position;

(j) providing in said gun a recock piston, said recock piston slidably translatable within said recock chamber between a forward, ready-to-fire position and a rearward, impacter-cocking position;

(k) providing a forwardly-directed pressure receiving face on said recock piston, said pressure receiving face disposed between said impacter body portion and said valve seat;

(l) providing a longitudinal passageway, said longitudinal passageway penetrating (A) said recock piston and (B) said pressure receiving face, to define in said pressure receiving face a transfer portal;

(m) providing piston bias, said piston bias forwardly biasing said recock piston, either directly or indirectly;

(n) restraining said impacter in said cocked position in preparation for firing;

(o) moving said recock piston to said ready-to-fire position in preparation for firing;

(p) releasing said impacter from said cocked position;

(q) moving said impacter in response to said impacter bias to said valve-opening position;

(r) passing momentum of said impacter through said transfer portal and to said valve;

(s) opening said valve;

(t) releasing compressed gas from said gas reservoir;

(u) passing one portion of said released gas to a projectile to be propelled from said gun;

(v) passing another portion of said released gas into said recock chamber;

(w) moving said recock piston from said ready-to-fire position toward said impacter-cocking position in response to the urging of the portion of released gas passed into said recock chamber;

(x) engaging said impacter contact face with said recock piston;

(y) moving said recock piston to said impacter-cocking position, (z) moving said impacter to said cocked position;

(aa) restraining said impacter in said cocked position; and (ab) moving said recock piston to said ready-to-fire position;

so that said pneumatic gun is again ready to fire.

41. A method of opening a loading port of a pneumatic gun for the introduction of a new projectile as said gun is being recocked after firing, and of subsequently closing said loading port and chambering said new projectile while leaving said gun cocked and ready to fire again, said gun comprising a forward end and a rearward end, said method comprising the steps of:

(a) providing a bolt chamber in said gun:

(b) providing in said gun said loading port, said loading port when open providing space to accommodate the passage of said new projectile into said bolt chamber forward of said bolt;

(c) providing in said gun a bolt, said bolt slidably translatable within said bolt chamber between:

(i) a rearward bolt open position, said loading port open when said bolt is in said bolt open position, and (ii) a forward bolt ready-to-fire position, said bolt closing said loading port when in said bolt ready-to-fire position, said bolt chambering said new projectile as said bolt moves from said bolt open position to said bolt ready-to-fire position;

(d) providing in said gun a spring, said spring forwardly biasing said bolt;

(e) providing in said gun a recock chamber;

(f) providing in said gun a gas reservoir, said gas reservoir for containing compressed gas;

(g) providing in said gun a normally-closed impact-openable valve, said valve openable in response to momentum of a forwardly-biased impacter moving forward from a cocked position, said valve when open releasing compressed gas from said gas reservoir, a portion of the released compressed gas flowing to said recock chamber to recock said gun;

(h) providing in said gun a recock piston, said recock piston slidably translatable within said recock chamber between a forward, ready-to-fire position and a rearward, impacter-cocking position, (i) constraining said bolt to move rearward when said recock piston moves rearward;

(j) constraining said recock piston to move forward when said bolt moves forward;

(k) providing on said impacter a forwardly-directed impacter contact face, said impacter contact face engageable by said recock piston as said recock piston moves rearward to said impacter-cocking position;

(l) providing on said recock piston a forwardly-directed pressure receiving face, said pressure receiving face receptive of the rearward urging of the compressed gas provided to said recock chamber;

(m) providing a longitudinal passageway in said recock piston, said longitudinal passageway penetrating (A) said recock piston and (B) said pressure receiving face, to define in said pressure receiving face a transfer portal;

(n) restraining said impacter in said cocked position in preparation for firing;

(o) providing urging by said spring to move said recock piston to said piston ready-to-fire position, and said bolt to said bolt ready-to-fire position, in preparation for firing;

(p) releasing said impacter to move forward from said cocked position;

(q) passing the momentum of said impacter through said transfer portal to open said valve and release compressed gas from said gas reservoir, (r) passing a portion of the released gas into said recock chamber;

(s) moving said recock piston rearward from said piston ready-to-fire position to said impacter-cocking position in response to the urging of the portion of compressed gas in said recock chamber;

(t) imparting the rearward motion of said recock piston to said impacter to move said impacter to said cocked position;

(u) imparting the rearward motion of said recock piston to said bolt to move said bolt to said bolt open position, opening said loading port and compressing said spring;

(v) introducing said new projectile into said bolt chamber through said open loading port;

(w) moving said bolt and said recock piston forward in response to the urging of said spring, chambering said new projectile and closing said loading port.

42. The method as set forth in claim 41, wherein said gun further comprises a connecting rod, said connecting rod constraining said bolt and said recock piston to translate in concert.

43. The method as set forth in claim 41, said gun further comprises a bolt connection bar, said bolt connection bar comprising a forwardly-directed bolt contact face, said bolt contact face engageable with said recock piston so that (A) when said recock piston travels rearward to said impacter-cocking position said bolt is pushed rearward to said bolt open position, and (B) when said bolt travels forward to said bolt ready-to-fire position, said recock piston is pushed forward to said piston ready-to-fire position.

* * * * *